US009475636B2

(12) United States Patent
Mekata et al.

(10) Patent No.: US 9,475,636 B2
(45) Date of Patent: Oct. 25, 2016

(54) VALVE ASSEMBLY AND AEROSOL CONTAINER EQUIPPED WITH THE SAME, AND AEROSOL PRODUCT AND PROCESS FOR PRODUCTION THEREOF

(75) Inventors: Satoshi Mekata, Osaka (JP); Hidetoshi Miyamoto, Kyoto (JP); Masazumi Tanaka, Kyoto (JP); Kazuhiro Yamaguchi, Kyoto (JP)

(73) Assignee: DAIZO CORPORATION, Osaka (JP)

( * ) Notice: Subject to any disclaimer, the term of this patent is extended or adjusted under 35 U.S.C. 154(b) by 335 days.

(21) Appl. No.: 13/996,752

(22) PCT Filed: Dec. 22, 2011

(86) PCT No.: PCT/JP2011/079944
§ 371 (c)(1),
(2), (4) Date: Sep. 26, 2013

(87) PCT Pub. No.: WO2012/086818
PCT Pub. Date: Jun. 28, 2012

(65) Prior Publication Data

US 2014/0008389 A1 Jan. 9, 2014

(30) Foreign Application Priority Data

| | | |
|---|---|---|
| Dec. 22, 2010 | (JP) | 2010-286748 |
| Dec. 22, 2010 | (JP) | 2010-286763 |
| Dec. 22, 2010 | (JP) | 2010-286771 |
| Jun. 6, 2011 | (JP) | 2011-126808 |
| Aug. 22, 2011 | (JP) | 2011-181021 |
| Aug. 23, 2011 | (JP) | 2011-182055 |
| Oct. 7, 2011 | (JP) | 2011-223502 |

(51) Int. Cl.
*B65D 83/00* (2006.01)
*B65D 83/48* (2006.01)

(Continued)

(52) U.S. Cl.
CPC ..... *B65D 83/48* (2013.01); *B65D 83/20* (2013.01); *B65D 83/206* (2013.01); *B65D 83/32* (2013.01); *B65D 83/425* (2013.01); *B65D 83/62* (2013.01); *B65D 83/682* (2013.01)

(58) Field of Classification Search
CPC ..... B65D 83/44; B65D 83/48; B65D 83/52; B65D 83/54; B65D 83/543; B65D 83/68; B65D 83/682
USPC ..... 222/402.1
See application file for complete search history.

(56) References Cited

U.S. PATENT DOCUMENTS 3,114,483 A * 12/1963 Kappel ..... 222/402.24
3,992,003 A 11/1976 Visceglia et al.

(Continued)

FOREIGN PATENT DOCUMENTS

EP 1 065 156 A1 1/2001
JP 43-10851 Y 5/1968

(Continued)

OTHER PUBLICATIONS

International Search Report for the Application No. PCT/JP2011/079944 mailed Apr. 3, 2012.

*Primary Examiner* — Patrick M Buechner
(74) *Attorney, Agent, or Firm* — Cheng Law Group, PLLC

(57) ABSTRACT

A valve assembly in which contents respectively packed in multiple storage parts which cannot be reacted with each other in the middle of passage, an aerosol container equipped with the valve assembly, and an aerosol products are provided.
An aerosol container comprises an outer container, two inner bags inserted into the outer container, and valve assembly which closes inner bags and outer container. The valve assembly comprises aerosol valves which are separated independently from each other and a holding member for holding the aerosol valves and for fixing the aerosol valves to the outer container.

19 Claims, 58 Drawing Sheets

(51) Int. Cl.

| | |
|---|---|
| ***B65D 83/20*** | (2006.01) |
| ***B65D 83/32*** | (2006.01) |
| ***B65D 83/42*** | (2006.01) |
| ***B65D 83/62*** | (2006.01) |
| ***B65D 83/68*** | (2006.01) |

(56) References Cited

U.S. PATENT DOCUMENTS

| | | | | |
|---|---|---|---|---|
| 4,211,347 | A | 7/1980 | Mildern | |
| 5,697,532 | A * | 12/1997 | Wilde et al. | 222/402.16 |
| 5,746,354 | A | 5/1998 | Perkins | |
| 5,775,386 | A | 7/1998 | Connan | |
| 6,315,173 | B1 * | 11/2001 | Di Giovanni et al. | 222/402.2 |
| 6,651,847 | B2 * | 11/2003 | Mekata et al. | 222/105 |
| 6,736,288 | B1 | 5/2004 | Green | |
| 7,036,685 | B1 | 5/2006 | Green | |
| 2002/0121528 | A1 | 9/2002 | Mekata et al. | |
| 2006/0049205 | A1 | 3/2006 | Green | |
| 2006/0054634 | A1 * | 3/2006 | Mekata | 222/94 |
| 2008/0041387 | A1 | 2/2008 | Boeck | |

FOREIGN PATENT DOCUMENTS

| | | | |
|---|---|---|---|
| JP | 53-43197 | U | 4/1978 |
| JP | 63-28684 | U | 2/1988 |
| JP | 63-91473 | U | 6/1988 |
| JP | 1988-91473 | | 6/1988 |
| JP | 6-53478 | U | 7/1994 |
| JP | 6-336272 | A | 12/1994 |
| JP | 9-95870 | A | 7/1997 |
| JP | 2001-122364 | A | 5/2001 |
| JP | 2001-130656 | A | 5/2001 |
| JP | 2003-20082 | A | 1/2003 |
| JP | 2003-267462 | A | 9/2003 |
| JP | 2003-292072 | A | 10/2003 |
| JP | 2005-231644 | A | 9/2005 |
| JP | 2006-264767 | A | 10/2006 |
| JP | 2006-300082 | A | 11/2006 |
| JP | 2007-175358 | A | 7/2007 |
| JP | 4332444 | B2 | 9/2009 |
| JP | 2009-227286 | A | 10/2009 |
| JP | 4648501 | | 3/2011 |

* cited by examiner (a)

(b)

(a)

(b)

(a)

(b)

VALVE ASSEMBLY AND AEROSOL CONTAINER EQUIPPED WITH THE SAME, AND AEROSOL PRODUCT AND PROCESS FOR PRODUCTION THEREOF

FIELD OF INVENTION

The present invention relates to a valve assembly and an aerosol container equipped with the same, and an aerosol product and a process for production thereof.

DESCRIPTION OF BACKGROUND ART

A product in which two aerosol containers are coupled is known for a discharging product for discharging multiple contents at once. Further, an aerosol container equipped with an outer container having two storage parts and a valve fixed to the opening of the outer container for discharging contents is known.

For example, an aerosol container having a outer container, two storage parts accommodated in the outer container, and a valve assembly communicating with each storage part is disclosed in FIG. 2 of Patent Document 1, FIG. 2 of Patent Document 2, and FIG. 1 of Patent Document 3.

PRIOR ART DOCUMENTS

Patent Documents

Patent Document 1: Japanese Patent No. 4332444
Patent Document 2: U.S. Pat. No. 3,992,003
Patent Document 3: U.S. Pat. No. 7,036,685

DESCRIPTION OF THE INVENTION

Problems to be Solved

However, although the aerosol container of FIG. 2 of Patent Document 1 has two independent paths from each storage part to the stem hole, both paths share same stem and the housing of the aerosol valve, as common member. Therefore, when two liquid type reaction ingredients are used, the reaction may occurs in the valve, despite that the contents do not directly contacts with each other, due to the penetration of one or both of the content through the stem or the housing. For the aerosol container of FIG. 2 of Patent Document 2 and FIG. 1 of Patent Document 3, it also has two independent valve in which each valve opens and closes the path of the each content delivered from each inner bag. However, both valves share the housing member of aerosol valve used in the valve assembly as common member. Therefore, the contents of two liquid type reaction ingredients also may reacts in the housing member, despite that both contents do not directly contacts with each other, due to the penetration of contents through the housing member. Especially, two liquid type hair color dye of the two liquid type reaction ingredients has high penetration against the synthetic resins. And it is known that the intended effect of hair dye can not be obtained due to reaction and discolor of the content before using, caused by the penetration of the contents.

The present invention is directed to a valve assembly in which the contents charged in storage parts do not react in the middle of the path, and aerosol container using the same, and aerosol product and process for production thereof.

Means of Solving the Problem

The present invention of a valve assembly is characterized in that it comprises aerosol valves in which each aerosol valve is independent and isolated, and a holding member holding aerosol valves and fixing aerosol valves on an opening of an outer container having pressure resistance. The independent and isolated aerosol valve, in this invention, means that each aerosol vale is composed of an individual housing having a pathway for passing the contents, and each fulfill its valve function in isolated states.

In a valve assembly of the present invention, the holding member may be equipped with a valve holder holding aerosol valves, and a mounting cover covering aerosol valves and the valve holder, and the valve holder may be equipped with holding parts penetrating the valve holder in vertical direction and holding the aerosol valve by inserting the aerosol valve, and stem inserting holes may be formed on an upper face of a cover part of the mounting cover for the stem of the aerosol valve to be inserted.

Especially, the valve holder may further equipped with a flange portion arranged on an upper end of an opening of the outer container, and the mounting cover may be equipped with the cover part fixing the aerosol valves to the valve holder and a fixing part fixing the flange portion of the valve holder to the outer container.

On the other hand, the valve holder may be equipped with a lid part of a column shape, and a flange portion formed on a lower end of the lid part, the mounting cover may be equipped with the cover part fixing the aerosol valves on the lid part, and an outer shape of the lid part of the valve holder and an outer shape of the cover part of the mounting cover may be a round shape with a part notched.

In a valve assembly of the present invention having the valve holder, the valve holder may be equipped with a plug part inserting along an inner surface of an opening of the outer container, and a sealing member is provided between the inner surface of the opening of the outer container and an outer surface of the plug part of the valve holder.

In a valve assembly of present invention having the valve holder, a valve gasket of a ring shape may be provided between an inner surface of the holder part and an outer surface of a housing of the aerosol valve.

In a valve assembly of present invention having the valve holder, a recessed portion holding aerosol valves may be formed on an upper face of the mounting cover.

In a valve assembly having the valve holder with a flange portion, a channel for the gas to pass may be formed on an upper end of the opening of the outer container, or formed on an under surface of the flange portion of the valve holder.

In a valve assembly having the valve holder with plug member, a sealing channel of an annular shape for holding the sealing member may be formed on an outer surface of the plug member or an inner surface of the opening of the outer container.

An aerosol container of present invention is characterized in that it comprises an outer container having pressure resistance, a propellant storage part for charging a propellant, partitioned or compartmentalized in the outer container, content storage parts for charging contents respectively, compartmentalized in the outer container and any of valve assembly of present invention closing the outer container and comprising aerosol valves which communicates with the content storage part respectively.

In an aerosol container of above, it may further comprises tubes which communicate the aerosol valves with the content storage parts respectively and in which a bottom is inserted into the content storage part, and a position of the bottom of at least two tubes in the content storage parts are out of alignment in vertical direction.

In an aerosol container of the present invention, it may further equipped with a activating part attached to the aerosol valve, in which the activating part has two stem engaging portions where stems of the aerosol valves are attached respectively, a discharging opening discharging two content having a rectangular cross sectional view, and an inner path which communicates the stem engaging portion with the discharging opening. Further, the inner path has two independent paths which communicate with the stem engaging portions respectively, and an unified path which extends to the discharging opening in horizontal direction, and in which the contents served from independent paths are converged. Moreover, a width of the discharging opening and a distance of two independent path is substantially same.

On the other hand, an aerosol container of the present invention may equipped with activating parts connected to stems of the aerosol valves respectively.

For an outer container of the aerosol container of present invention, the outer container made of synthetic resin may be used.

It is preferable to have two content storage parts. Specifically, it is preferable that the content storage part is a first inner container and a second inner container respectively, which are inserted in the outer container, the first inner container has an inner layer made of synthetic resin, and a first gas barrier layer made of metallic foil provided on the outside of the inner layer, and the second inner container has an inner layer made of synthetic resin, and a second gas barrier layer made of non metal provided on the outside of the inner layer. In this case, it is preferable that the outer container and the second inner container have translucency.

In an aerosol container of present invention, the content storage part may be a flexible pouch formed by bonding a periphery of two planate side walls, which are inserted in the outer container, and the outer container may be equipped with an outer window portion having translucency, and it may be structured so that a sign which notice the remaining of the contents can be seen from the outer window portion, when the contents are discharged and the volume of the pouch is reduced. In this case, it is preferable that the pouch has an inner window portion having translucency which can be seen from the outer window portion, and a contents which are to be charged in the pouch is an opaque, and it is preferable to be structured so that the sign can be seen from the inner window portion, when the contents are discharged and the volume of the pouch is reduced.

In an aerosol container of present invention, the content storage part may be an inner container, where the inner container has a barrel portion in which the content is charged, and a leg portion integrally formed on a lower end of the barrel portion, and when inner containers are connected to the aerosol valves respectively and laid on a bottom surface of the outer container, a position of the valve assembly is higher than the position of the valve assembly to be fixed to the outer container, supported by the leg portion of the inner container, and the leg portion is bent when the valve assembly is fixed to the outer container. In this case, it is preferable that the inner container is a pouch formed by bonding two flexible sheet, and the leg portion is a lower end bonded part in which a lower end of the sheets are bonded.

An aerosol product of present invention is characterized in that it comprises an aerosol container of present invention having two content storage part, a propellant charged into the propellant storage part, and two contents charged into the content storage part respectively, and the two contents are a two liquid type reaction ingredients. In this case, it is preferable that the two liquid type reaction ingredients are two liquid type hair dye agents.

A manufacturing method of an aerosol product of present invention in which to charge the content and to charge the propellant into the aerosol container equipped with the inner container having leg portion is characterized in that the inner container and the aerosol valve are connected, the inner container is inserted into the outer container in the connected state, the inner container is laid on the bottom surface of the outer container having the leg portion of the inner container to support the inner container and secure the space between the valve assembly and the outer container, the propellant is charged from the space into the propellant storage part formed between the outer container and the inner container, the valve assembly is lowered, covered on the outer container, and fixed to the outer container by bending the leg portion, and the contents are charged into the inner container.

Effect of the Invention

In the present invention of the aerosol assembly, because it is equipped with aerosol valves in which each aerosol valve is independent and isolated, and a holding member holding aerosol valves and for fixing aerosol valves on an opening of an outer container having pressure resistance, the contents passing each aerosol valve can be discharged in independent state. Therefore, the material of the aerosol valve can be selected according to the contents. Further, because it can prevents the penetration of the content inside the valve assembly, the contents with high reactivity can be stored stably for long period time.

In the case where the holding member has a valve holder holding aerosol valves, and a mounting cover covering aerosol valves and the valve holder, where the valve holder has holding parts penetrating the valve holder in vertical direction and holding the aerosol valve by inserting the aerosol valve, and where stem inserting holes are formed on an upper surface of a cover part of the mounting cover for the stem of the aerosol valve to be inserted, the penetration of the contents between the aerosol valve can be further prevented enhancing the stability of the contents. Further, the retaining of the aerosol valve are more secured, it enhances the manufacturability.

Especially, in the case where the valve holder has a flange portion arranged on an upper end of an opening of the outer container, and where the mounting cover has the cover part fixing the aerosol valves to the valve holder and a fixing part fixing the flange portion of the valve holder to the outer container, the valve holder can be stably placed on the top of the opening of the outer container and it ensure the fixing of the aerosol valve and the valve holder.

On the other hand, in the case where the valve holder has a lid part of a column shape, and a flange portion formed on a lower end of the lid part, where the cover part of the mounting cover fixes aerosol valves on the lid portion, and where an outer shape of the lid portion of the valve holder and the cover portion of the mounting cover is a round shape with a part notched, the direction of the valve assembly may be adjusted according to the shape of the mounting cover, while charging the contents from the stem.

In the case of the valve assembly of present invention having the valve holder, that the valve holder has a plug part inserting along an inner surface of an opening of the outer container, and a sealing member is provided between the inner surface of the opening of the outer container and an outer surface of the plug part of the valve holder, the hermetical sealing can be obtained between the valve holder and the outer container despite the crimping condition of the mounting cover, therefore the sealing function between the outer container and the air is enhanced.

In the case of the valve assembly of present invention having the valve holder, that a valve gasket of a ring shape is provided between an inner surface of the holder part and an outer surface of a housing of the aerosol valve, the hermetical sealing can be obtained between the valve holder and the aerosol valve by crimping the mounting cover while pressing the aerosol valve to the valve holder direction. Therefore, the sealing method is easy.

In the case of the valve assembly of present invention having the valve holder, that the recessed portion holding aerosol valves is formed on an upper surface of the mounting cover, the aerosol valve will be secured by crimping the mounting cover, and the sealing function of the stem inserting hole of the mounting cover can be maintained high.

In the case of the valve assembly of present invention having the valve holder with the flange portion, that a channel for a gas to pass is formed on an upper end of the opening of the outer container, or formed on an under surface of the flange portion of the valve holder, the undercup charging of the propellant which is to charge the propellant through the space between the flange portion of the valve holder and the top of the opening of the outer container, can be operated easy. Further, when the inner pressure increases abnormally due to the high temperature atmosphere or etc. and the outer container deforms due to the strength reduction, the propellant may be discharged outside from the channel on the beginning of the deformation, and the jumping of the valve assembly and bursting of the outer container may be prevented.

In the case of valve assembly equipped with a valve holder having the plug member, that a sealing channel of an annular shape for holding the sealing member is formed on an outer surface of the plug member or an inner surface of the opening of the outer container, the fall off of the sealing member from the valve assembly can be prevented, while in the transportation of the valve assembly and while in charging of the propellant.

In the present invention of the aerosol container, because it is equipped with an outer container having pressure resistance, a propellant storage part for charging a propellant, compartmentalized in the outer container, content storage parts for charging contents respectively, compartmentalized in the outer container and the valve assembly of present invention having the aerosol valve which communicates with the content storage part, the contact of the contents can be prevented, and the degradation of the contents due to the penetration of the contents can also be prevented. Therefore, it can store the high quality contents stably.

In such the aerosol container, where tubes which communicates the aerosol valve with the content storage part, and in which a bottom is inserted into the content storage part, and where a position of the bottom of at least two tubes in the content storage parts are out of alignment in vertical direction, the contents can be discharged stably. In other words, because the contents are vacuumed from the lower end opening of the dipping tube connected to the content storage part and the content storage part shrunk from the vicinity of the lower end opening of the dipping tube, the shrinking shape of the two content storage parts can be made differently. That is, two content storage parts may be shrunk without interfering with each other.

In the case of the aerosol container of present invention, that further equips the activating part attached to the aerosol valve, in which the activating part has two stem engaging portion where each stem of the aerosol valve are attached respectively, a discharging opening discharging two content having a rectangular cross sectional view, and an inner path which communicates the stem engaging portion with the discharging opening, and where the inner path has two independent path which communicates with the stem engaging portion respectively, and an unified path which extends to the discharging opening in horizontal direction, and in which the contents served from each independent path are converged, and where a width of the discharging opening and a distance of two independent path is substantially same, the contents flows the unified path from the independent path to the discharging opening parallelly and converges just before the discharging opening. Therefore, the flow velocity of two contents in the unified path will be same. Resultantly the discharging amount of two contents can be controlled.

In the case where the activating part has a translucency, the discharging rate of the contents can be visually seen by the width of each contents flowing in the unified path. Therefore, if the boundary line is formed on the middle of the unified path, the discharging rate of two contents are same. Further, discharging rate of two contents can be noticed accurately by providing scale marks in the width direction of the unified path.

On the other hand, in the case where the activating parts are attached to each of the stem of the aerosol valve, the independency of contents can be secured until it is discharged.

In the case that the outer container of the aerosol container of the present invention is made of synthetic resin, the remaining of the contents in the content storage part can be visually noticed.

In the case that two content storage part are a first inner container and a second inner container respectively, which are inserted in the outer container, the first inner container has an inner layer made of synthetic resin, and a first gas barrier layer made of metallic foil provided on the outside of the inner layer, the second inner container has an inner layer made of synthetic resin, and a second gas barrier layer made of non metal provided on the outside of the inner layer, the first inner container has higher gas barrier function. Therefore, even content having high reactant ingredient is stored for a long period of time, the component penetrated the second inner container will not reach the first inner container. Specifically, the component which generates the gas by decomposition such as hydrogen peroxide, is charged in the second inner container, the gas formed in the second inner container is ejected outside by penetrating. Therefore, it can prevent the gas pile in the second inner container. As a result it prevents the spattering of the content when discharging, and prevents the bursting of the second inner container due to the rise of the inner pressure at the time of storage. Further, it can have the second inner container to shrink when discharging the contents.

In the case where the outer container and the second inner container have translucency, the condition of the inner container and the remaining of the contents can be confirmed visually.

In the case where the content storage part is a flexible pouch formed by bonding a periphery of two planate side walls, which are inserted in the outer container, and the outer container has an outer window portion having translucency, and it is structured so that a sign which notice the remaining of the contents is seen from the outer window portion, when the contents are discharged and the volume of the pouch is reduced, the user can notified the remaining of the content from outside.

Specifically, in the case, where the pouch has an inner window portion having translucency which can be seen from the outer window portion, and contents which are to be charged in the pouch is an opaque, and it is structured so that the sign can be seen from the inner window portion, when the contents are discharged and the volume of the pouch is reduced, user can notice the remaining of the content by looking the inner window portion.

In the case of aerosol container of present invention, where the content storage part is an inner container, and the inner container has a barrel portion in which the content is charged, and a leg portion integrally formed on a lower end of the barrel portion, and where when the inner containers are connected to the aerosol valves and laid on a bottom surface of the outer container, a position of the valve assembly is higher than the position of the valve assembly to be fixed to the outer container, supported by the leg portion of the inner container, and the leg portion is bent when the valve assembly is fixed to the outer container, the inner container can be inserted into the outer container without having the barrel portion deforms. Therefore, when the content is charged in from the valve, the inner container expands as predetermined shape, and prevents the burst of the inner container due to the pressuring of the limited area.

In the case that the inner container is a pouch formed by bonding two flexible sheet, and the leg portion is a lower end bonded part in which a lower end of the sheets are bonded, the structure of the inner container is simple.

In the present invention of the aerosol product, because it is equipped with an aerosol container of present invention having two content storage part, a propellant charged into the propellant storage part, and two contents charged into the content storage part respectively, and where the two contents are a two liquid type reaction ingredients, the content can be stably stored for long period of time.

In the case of aerosol product of above, that the two liquid type reaction ingredients are two liquid type hair dye agents, the contents can be stored stably for the long period of time, even the two liquid type hair dye has component having high penetration and high reactivity.

In the present invention of the manufacturing method of an aerosol product of present invention in which to charge the content and to charge the propellant into the aerosol container equipped with the inner container having leg portion, because the inner container and the aerosol valve are connected, the inner container is inserted into the outer container in the connected state, the inner container is laid on the bottom surface of the outer container having the leg portion of the inner container to support the inner container and secure the space between the valve assembly and the outer container, the propellant is charged from the space into the propellant storage part formed between the outer container and the inner container, the valve assembly is lowered, covered on the outer container, and fixed to the outer container by bending the leg portion, and the contents are charged into the inner container, the contents can be charged into the inner container without having the inner container deforms in disorder. Therefore, it prevents the burst of the inner container due to the pressure force of the charging, and stable aerosol products are manufactured. Specifically, in the case where the slit is formed on the leg portion, the inner container is supported by the leg portion being separated into plural, the wobble of the inner container and the valve assembly in horizontal direction is limited, and the sealing function between the propellant charging device and the valve assembly can be obtained easily, when charging the propellant.

BRIEF DESCRIPTION OF THE DRAWINGS

FIG. 32*c* is a side cross sectional view showing the other embodiment of the pouch.

EMBODIMENT FOR CARRYING OUT THE INVENTION

Figure 1:
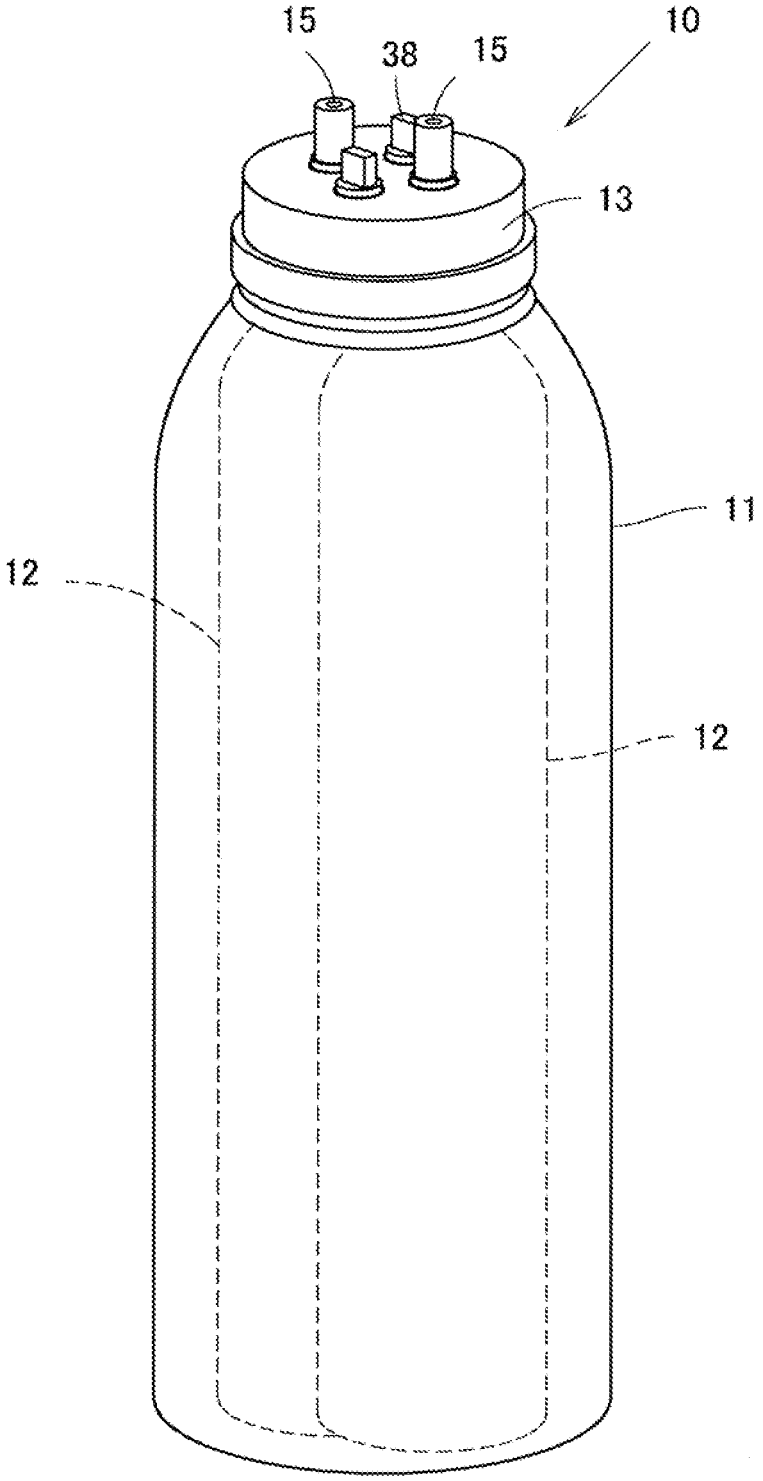
FIG. 1 A perspective view showing an embodiment of the aerosol container of the present invention.

The aerosol container 10 of FIG. 1 is equipped with an outer container 11 of a tubular shape having a bottom, two inner bag 12 inserted inside of the outer container, a valve assembly 13 closing both inner bags 12 and the outer container 11. The valve assembly 13 retains an aerosol valves 15 which are independent and separate. Because this aerosol container 10 has two separate aerosol valve 15, the path of the content in the valve assembly 13 do not intersect with each other and can prevent the direct contact of contents. Further, the material of the aerosol valve 15 can be selected according to two contents to be discharged. Therefore, the aerosol container 10 can prevent the degradation cause by one content penetrating to the other content.

The outer container 11 is a metallic pressure resistance container like shown in FIGS. 2*a, b*. The outer container 11 comprises a barrel portion 11*a* having a tubular shape, a shoulder portion 11*b* having a tapered shape, and a bead portion 11*c* formed on the top. The outer container 11 is integrally manufactured by forming tubular body from the metal slag using impact processing, and forming the barrel portion and the shoulder portion from the tubular body using draw processing. However, the outer container may be three pieced bottle attaching three member of bottom member, barrel member and head member manufactured separately. Further, it may be integrally mold using synthetic resin or glass. These structure of the outer container are selected according to the content and usage, etc.

Figure 3:
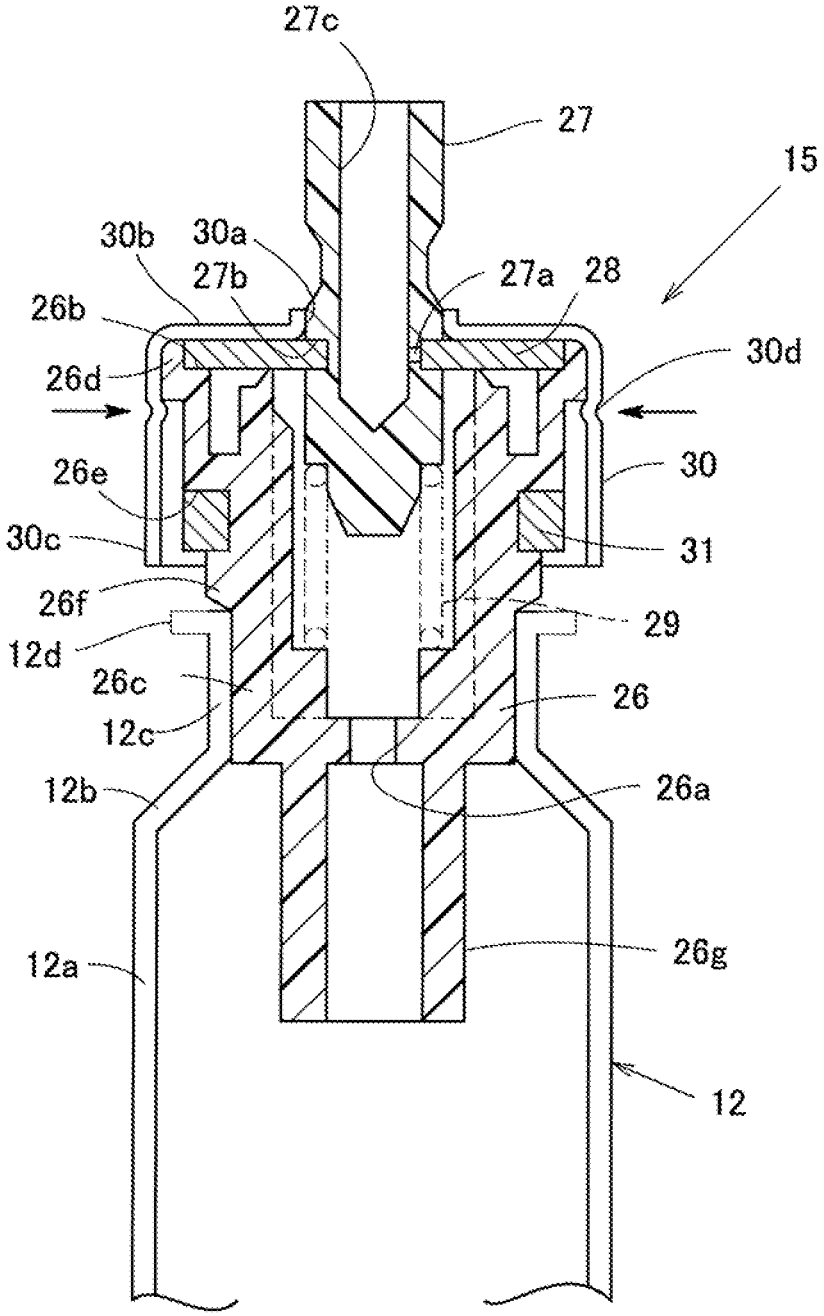
FIG. 3 A side cross sectional view of the aerosol valve of the aerosol container of FIG. 1.

The inner bag 12 is a flexible container like shown in FIG. 3. The inner bag 12 comprises a barrel portion 12*a* having a tubular shape, a shoulder portion 12*b* having a tapered shape, a neck portion 12*c* having a tubular shape, and flange portion 12*d* formed on the top. The inner bag 12 is manufactured using blow processing expanding the tubular parison made of synthetic resin by blowing the air inside. However, the pleated part may be formed on the inner bag from the bottom to the shoulder portion, so the inner bag can be inserted inside the outer container with a small volume and the inner bag can store the contents with a large volume. Moreover, the inner bag may be a tube formed of synthetic resin or rubber etc, or a pouch etc. formed of a synthetic resin sheet or metal sheet of a single layer or multiple layers.

In this embodiment, the two inner bags 12 work as two content storage parts partitioned (compartmentalized) in the outer container, and the space between the outer container and the inner bags 12 works as a propellant storage part partitioned in the outer container.

The valve assembly 13, like shown in FIGS. 2*a,b*, is composed of two independent aerosol valves 15, a valve holder 21 receiving these aerosol valve 15, and a mounting cover 22 covering the aerosol valve 15 and the valve holder 21 and fixing the aerosol valve to the valve holder 21. The valve assembly 13 is engaged to the outer container 11 with the annual sealing member 23 in between, and by deforming the lower end 22*c* of the outer periphery of the mounting cover 22 inside while pressing the valve assembly 13 downwardly to the bead portion 11*c* of the outer container. In this embodiment, the valve holder 21 and the mounting cover 22 work as the retaining member. Further, the sealing member 23 seals the outer container 11 and the valve assembly 13.

The aerosol valve 15 controls the flow of the content served from the inside of the inner bag 12, like shown in FIG. 3. Particularly, the aerosol valve 15 is equipped with a housing 26 having a tubular shape engaged to the inner bag 12, a stem 27 inserted in the housing 26 movable in up and down direction, a stem rubber 28 closing the stem hole 27*a* of the stem, a spring 29 pressuring the stem upward, and a cover 30 fixing the stem 27 and stem rubber 28 to the housing 26. The aerosol valve 15 is structured so the stem 27, the stem rubber 28, and the spring 29 stored in the housing 26 are fixed using the cover 30, and the inside of the housing 26 and the inner bag 12 are hermetically sealed when the housing 26 is engage to the inner bag 12.

The centered hole of the housing 26 is a space which partially stores the content served from the inner bag 12. Particularly, the housing 26 has a communicating hole 26*a* formed on the center of the bottom face communicating with the inner bag 26, a stem rubber retaining part 26*b* formed on the top retaining the stem rubber 28, and an inner bag engaging part 26*c* formed on the lower outer periphery inserting and engaging the neck portion 12*c* of the inner bag 12. Further, the flange portion 26*d* is formed on the upper end outer periphery extending outwardly, and a first step portion 26*e* is formed on the middle outer periphery in which the diameter decreases downwardly. Moreover, a second step portion 26*f* is formed below the first step portion in which the diameter decreases downwardly. The valve gasket 31 having ring shape is attached to the first step portion 26*e* sealing the aerosol valve 15 and the valve holder 21. The engaging tubular portion 26*g* is formed on the lower end protruding downwardly for attaching the dipping tube or a pouch (see FIG. 7) used in other disclosure. However, the engaging tubular portion 26*g* can be omitted in this.

The stem 27 is a member which directly operated when the content stored in the housing is discharged. Particularly, the stem 27 is a tubular body having the bottom portion, where the annular recessed part 27*b* is formed on the lateral face, and the stem hole 27*a* for communicating the annular recessed part 27*b* and centered hole 27*c* is formed on the lateral face.

The stem rubber 28 is a ring shaped body engaged to the annular recessed part 27*b* of the stem, and is retained by the stem rubber retaining portion 26*b* formed on the top of the housing.

The spring 29 is supported between the lower end of the stem 28 and the bottom face of the housing 26.

The cover is cup shaped body having the top face 30*b*, where the centered hole 30*a* is formed on the top face 30*b* for passing the stem 27. The top face 30*b* of the cover 30 prevents the stem rubber 28 from jumping out of the housing 26.

The assembling of the aerosol valve 15 is by inserting the stem 27, the stem rubber 28 and the spring 29 into the housing 26, and fixing the members by covering with the cover 30. Specifically, fixing the cover to the housing 26 by deforming the plural part of the lateral face 30*d* of the cover 30 annually or deforming entire circumference of the lateral face 30*d* of the cover 30 to the housing direction (arrow of FIG. 3), positioned at the lower part of the flange 26*c* of the housing 26, while pressing the cover 30 to the housing 26 direction (downward). Therefore, the stem rubber 28 and the stem 27 engaged to the stem rubber 28 is fixed in the housing 26 in the state of being pressed by the cover receiving the elastic force of the spring 29, and the stem hole 27*a* is sealed by the stem rubber 28. The lower end 30*c* of the cover 30 is in the state where it is extended straightly downward The aerosol valve 15 is operated by lowering the stem 27 against the housing 26, so the seal structure of stem hole 27*a* by the stem rubber 28 is freed and the inside of the housing 26 communicates with the atmosphere.

Each of the aerosol valve 15 is independent and separated and has an airtight structure inside of the housing, and each has the housing equipped with independent path for each content, and each has the valve function which can be obtained separately.

The valve holder 21 comprises a column shape base portion (lid part) 36, two holder portion penetrating the base part up and down in vertical direction, and two positioning protrude 38 protruding upwardly from the upper end of the base part.

The base part 36 has an upper end and a lower end where the cross sectional view is round, and a lateral face 36*a* connecting the both ends where it has tapered shape with the diameter slightly increases downwardly. The lateral face 36*a* has flange portion 36*b* at the lower part protruding outwardly. However, the lateral face may be tubular shape extending straight downwardly. The flange 36*b* is placed on the top of the opening of the outer container.

The holder part 37 is configured from the penetrating hole penetrating the base part 36 up and down in vertical direction, it receives and retains the aerosol valve 15. The holder part 37 comprises an upper tubular portion 37*a*, a lower tubular portion 37*b* where the diameter decreases against the upper tubular portion 37*a*, and an annular step portion 37*c* connecting the lower end of the upper tubular portion 37*a* and the upper end of the lower tubular portion 37*b*. The upper tubular portion 37*a* receives the housing 26 of the aerosol valve 15, and the annular step portion 37*c* (upper end of the lower tubular portion 37*b*) supports the aerosol valve 15. Specifically, the annular step portion 37*c* (upper end of the lower tubular portion 37*b*) support the aerosol valve 15 and seals between the holder part 37 and aerosol valve 15 by engaging the valve gasket 31 attached to the first step portion 26*e* of the aerosol valve 15. Further, the annual groove portion 37*d* is formed around the periphery of the annual step portion 27*c*, and the lower end part 30*c* of the cover 30 of the aerosol valve is inserted to the annual groove portion 37*d*. The two holder parts 37 are formed facing each other centering the centered axis of the base part 36 (see FIG. 4).

Figure 17:
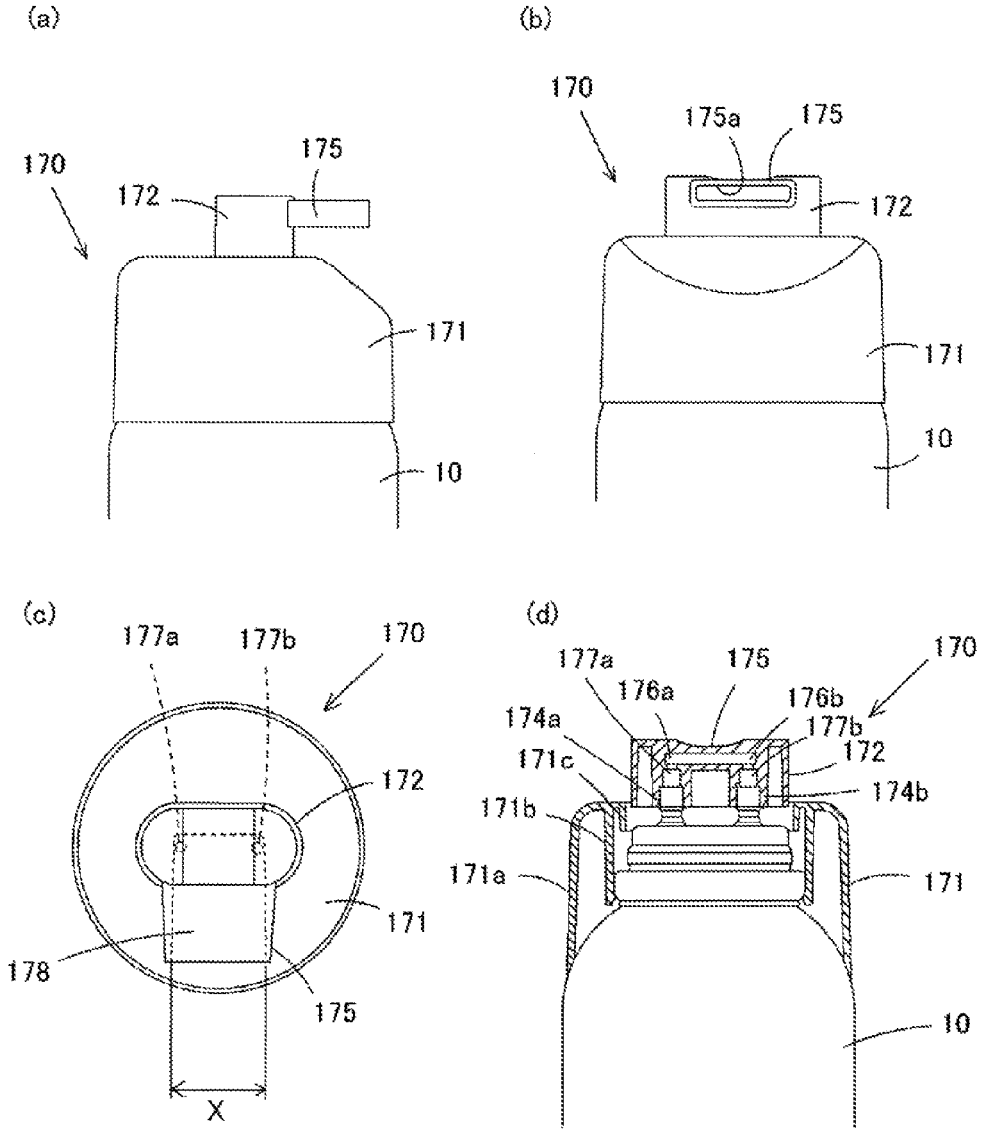
FIGS. 17*a* to *d* are a side view, a front view, a plan view and a side cross sectional view showing a discharging member which can be used to the aerosol container of the present invention.

The positioning protrusion 38 is a protrusion having cuboid shape protruding from the upper surface of the base part 36. The positioning protrusion 38 is formed facing each other centering the centered axis of the base part and formed so that the line connecting the center of the positioning protrusion 38 is perpendicular to the line connecting the center of the holder part 37. The positioning protrusion 38 is a position setting means and direction setting means of valve assembly and aerosol container. Particularly, for setting the positioning of the content charging device and the aerosol valve when charging the contents, for setting the positioning of the gas charging valve and the gas charging device when charging the propellant, or for setting the direction of the design or display disclosed on the outer surface of the aerosol container with the discharging member when attaching the discharging member to the valve assembly. The number and the location of the positioning protrusion 38 is not limited as long as the setting of the positioning and the direction are available. For this, the discharging member to be described (see, FIGS. 17, 18) can be accurately attached to the valve assembly 13. Moreover, the positioning protrusion 38 is preferably located to the outside of the stem from the centered axis of the valve assembly (aerosol container), so that the setting of the direction (or positioning) can be prosecuted outside the stem, preventing the device for setting the direction (or positioning) hit the stem and avoids the crippling or the fracturing of the stem.

Figure 5:
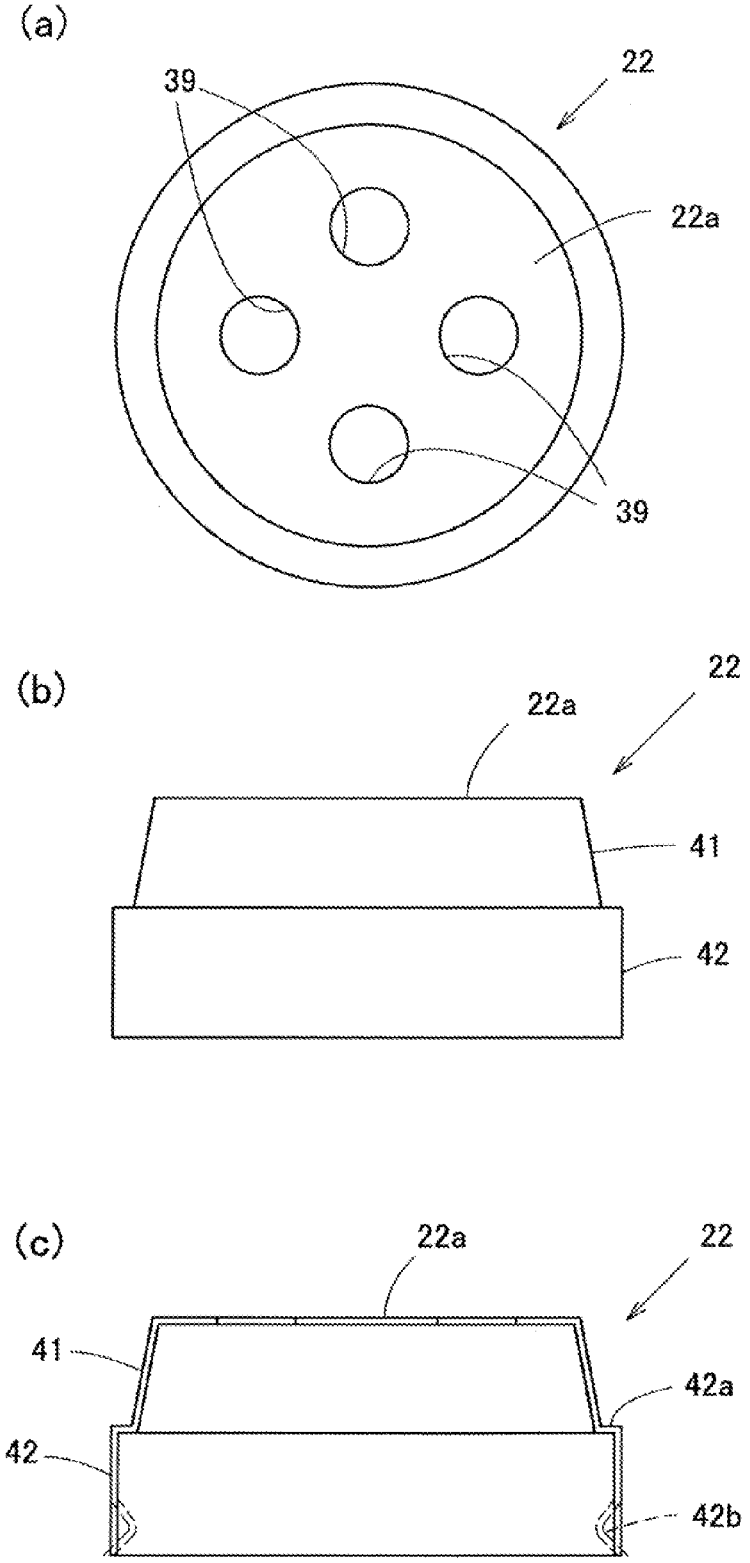
FIGS. 5*a* to *c* are a plan view, a side view, and a side cross sectional view of mounting cover of the aerosol container of the FIG. 1.

The mounting cover 22 is a tubular body having a top face 22*a*, like shown in FIG. 5. The mounting cover 22 comprises a cover part covering the aerosol valve 15 and the valve holder 21 and fixing the aerosol valve 15 to the valve holder 21, and the fixing part 42 having the tubular shape and fixing the valve holder 21 and the outer container 11. The shape of the cover part 41 is tapered where the diameter increases downwardly, and is configured to fit with the lateral face 36*a* of the base part of the valve holder. Four path hole 39 is formed on the top face 22*a* of the cover part 41 for inserting or passing the stem 27 and the positioning protrusion 38 of the aerosol valve 15. The fixing part 42 has an upper jaw portion 42*a* contacting with the upper surface of the flange portion 36*b* of the valve holder. The fixing part 42 is formed by forming a lower jaw portion 42*b* contacting with the under surface of the bead portion of the outer container. The lower jaw portion 42*b* is formed by crimping the lower part while pressing flange portion 36*b* and bead portion 11*c*. The formation of the lower jaw portion 42*b* secures the fixing of the valve assembly to the outer container.

Figure 2:
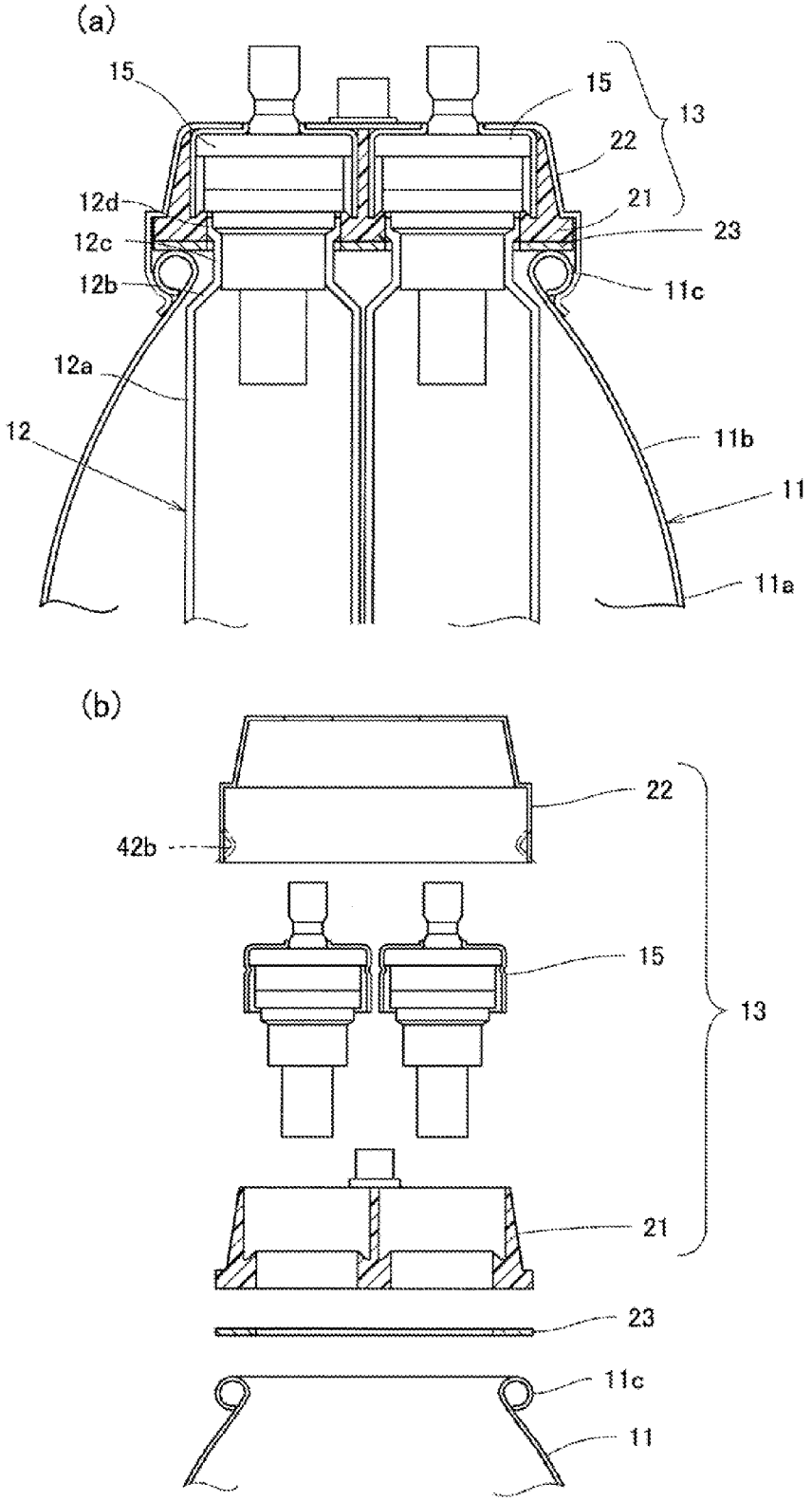
FIG. 2*a* is a side cross sectional view of the part of the aerosol container of FIG. 1.
FIG. 2*b* is its schematic view.

Back to FIG. 2, the valve assembly 13 is assembled by placing two aerosol valves 15 on the prescribed valve holder 21, covering the mounting cover 22, and placing the sealing member 23 on the bead portion 11*c* of the outer container (see, FIG. 2*b*). In this state, the lower end of the mounting cover 22 is crimped forming the lower jaw portion 42*b* of the fixing part (see, broken line of FIGS. 2*b* and 5*c*), while pressing the valve assembly 13 to the outer container direction. Therefore, the valve assembly 13 can be fixed to the outer container 11 with maintaining the sealing function. Further, the sealing functions of the valve assembly are maintained by engaging the upper end of the lower tubular portion 37*b* of the valve holder 37 and the valve gasket 31 of the aerosol valve 15.

Because the valve assembly 13 has two independent and separate aerosol valve, each content passing each aerosol valve can be discharged outside maintaining the independent condition. In other word, because the inside (housing 26) of each aerosol valve 15 is independently sealed, the material of the aerosol valve can be selected according to the content. Therefore, not only the degradation due to the direct contact of the content in the valve assembly can be prevented, the degradation due to the penetration of the content can also be prevented.

The aerosol container 10 can be manufactured by, for example, placing the sealing member 23 and the valve holder 21 on the outer container 11, and hooking the flange portion 12*d* of the inner bag 12 to the lower tubular portion 37*b* of the valve holder 21, like shown in imaginary line of FIG. 4*b*. Next, the aerosol valve 15 is inserted inside of the holder portion 37 of the valve holder 21 together with closing the neck portion 12*c* of the inner bag 12. Then the mounting cover 22 is attached. And the valve assembly in which the mounting cover and valve holder 21 are united, is slightly elevated for charging the propellant between the outer container 11 and the inner bag 12. The aerosol container 10 is then manufactured by forming the lower jaw portion 42*b* of the mounting cover using crimping process while pressing the valve assembly to the outer container (see, FIGS. 2*a*, 2*b*). The content may be charged in from the stem 27 of the aerosol valve 15 after attaching the aerosol valve 15 and inner bag 12. In this case, the content may be charged before or after the charging of the propellant.

The aerosol product simultaneously discharging different content may be produced by charging different kind of the content in the inner bag 12 of the aerosol container 10. When the content is two liquid type reaction ingredients, the reaction effect of the contents can be obtained by simultaneously discharging the contents, and mixing it afterward. For such a two liquid type reaction ingredients, two liquid type hair dyes, two liquid type permanent wave agents, two liquid type adhesive agents may be cited. Particularly, when it is two liquid type hair dyes, because the discharged object is used for the hair which the user can not see directly, the discharging both content in one container will ease the hair dye procedure.

Moreover, the propellant is charged in space between the space (propellant storage part) of the outer container 11 and the inner bag 12, the propellant may be charged together with aqueous solution such as water. Specifically in the two liquid type hair dye, it is known that the high permeability ingredient (ammonia) is included in the content, however the charging of the aqueous solution in the space between the outer container 11 and the inner bag 12 can trap the high permeability ingredient in the space by dissolving in the aqueous solution. Therefore, it can prevent the mixture of two contents due to the penetration.

Figure 6:
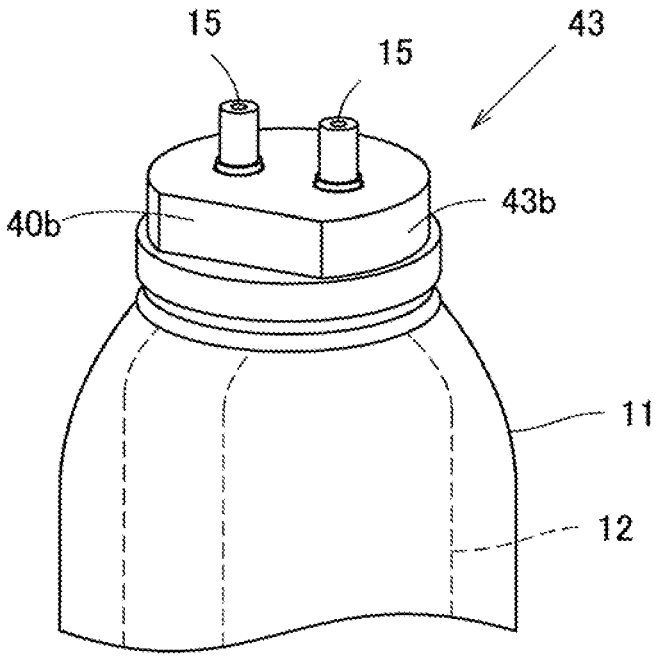
FIGS. 6*a, b* are a perspective view and a side cross sectional view showing a part of another embodiment of the aerosol container of the present invention.
Figure 6:
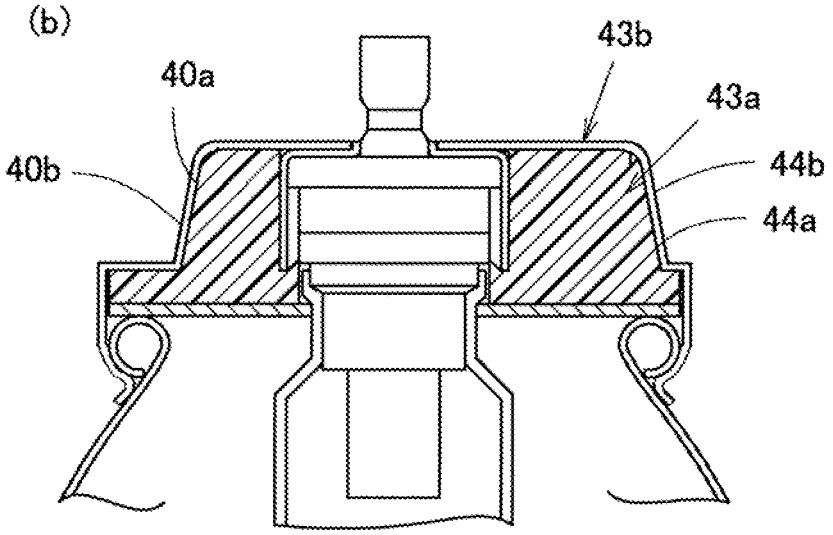

The aerosol container 43 of FIG. 6 has a valve holder 43 and mounting cover 43*b* in which the shape of cross section of the base portion (lid portion) 44 of the valve holder and the cover part 44*b* of the mounting cover 43*b* are a circle with notch. In other word, the lateral face of the base part 44*a* of the valve holder 43*a* and the cover part 44*b* of the mounting cover 43*b* has a notch surface 40*a* and 40*b*, respectively. The notch surface 40*b* of the mounting cover 43*b* is a position setting means and direction setting means of valve assembly and aerosol container. The effect is substantially same as the positioning protrusion 38 of FIG. 1. The plural of notch surface may be formed.

The other compositions of the valve holder 43*a* are substantially same as the valve holder 21 of the aerosol container 10 of FIG. 1, and comprises the holder part 37 and base part 44*a* having the flange portion 36*b*, except that it does not equipped with the positioning protrusion 38.

The other composition of the mounting cover 43*a* are substantially same as the mounting cover 22 of the aerosol container 10 of FIG. 1, and comprises the fixing part 42 and cover part 44*b* having pass hole for inserting or passing the stem of the aerosol valve 15.

Figure 7:
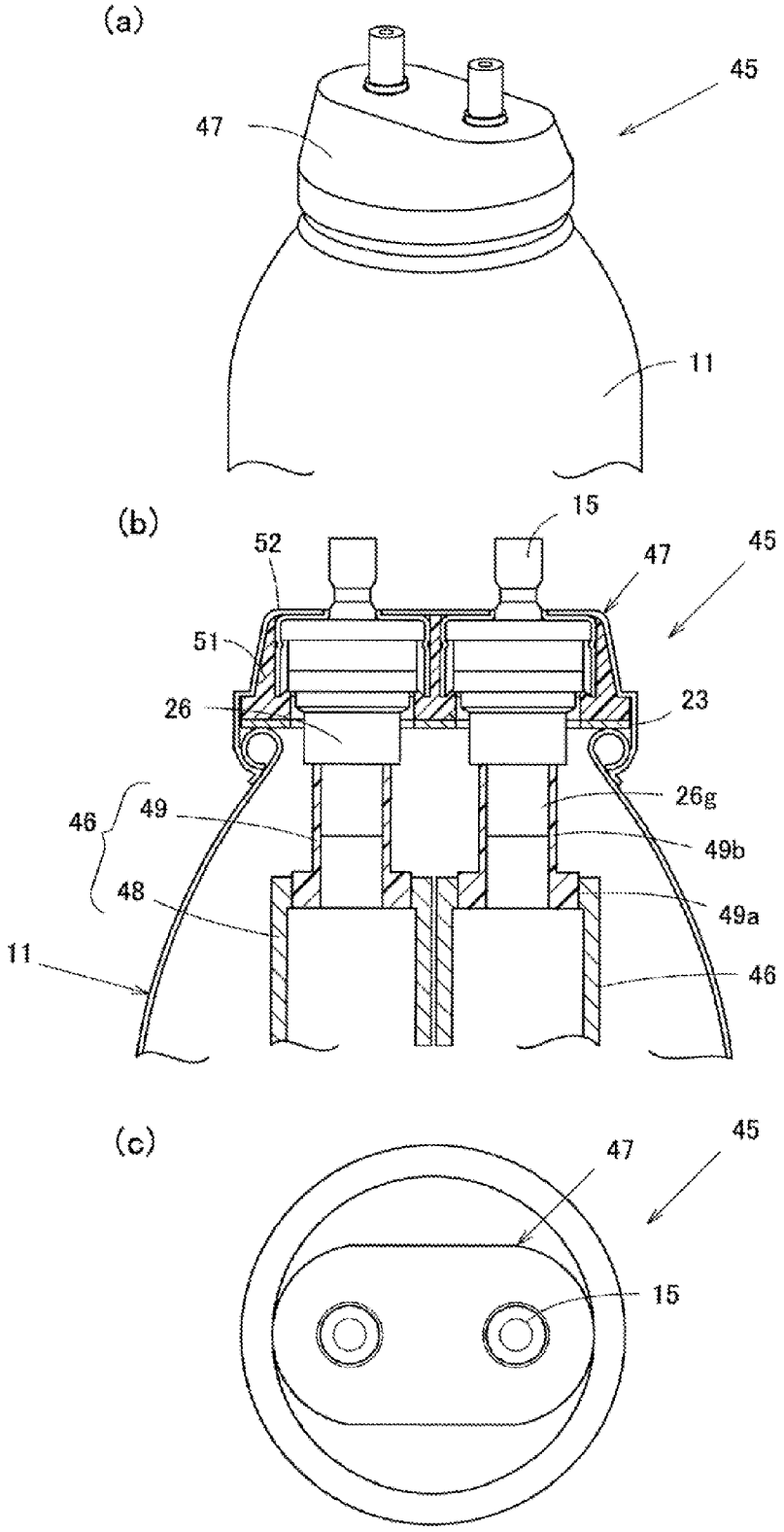
FIGS. 7*a* to *c* are a perspective view, a side cross sectional view, and a plan view showing a part of other embodiment of the aerosol container of the present invention.
Figure 8:
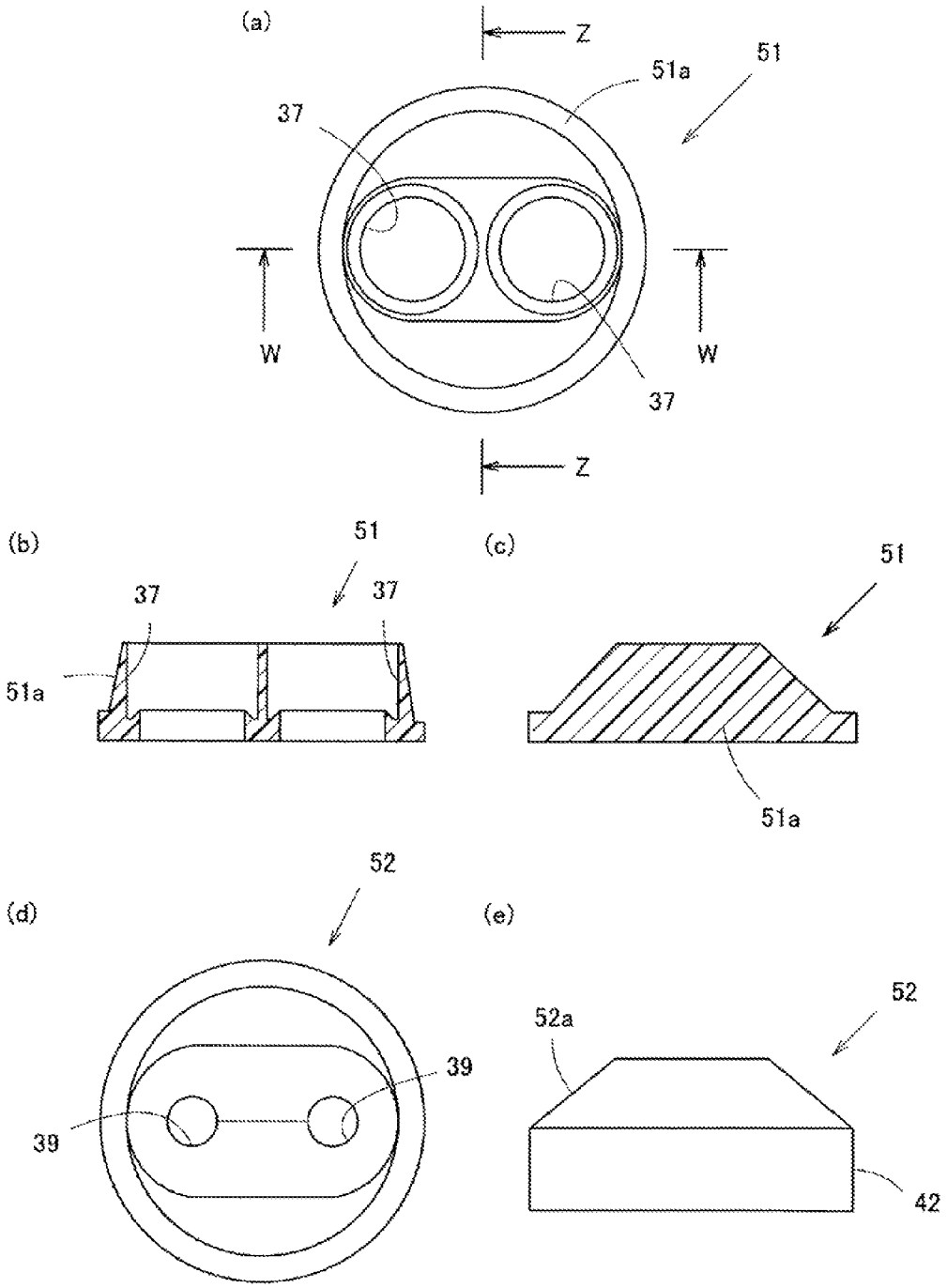
FIGS. 8*a* to *c* are a plan view, a W-W line cross sectional view of the plan view, and a Z-Z line cross sectional view of the valve holder of the aerosol container of FIG. 7, and FIGS. 8*d, e* are a plan view and a side view of the mounting cover of the aerosol container of FIG. 7.

The shape of the cover part of the mounting cover may be formed other than circle like shown in FIGS. 7 and 8 and uses as a position setting means and direction setting means of valve assembly and aerosol container.

The aerosol container 45 of FIG. 7 has a outer container 11, two pouches 46 inserted therein, and a valve assembly 47 closing both pouches and the outer container. The outer container 11 is substantially same as the outer container 11 of FIG. 1. In this, the two pouches 46 work as two content storage part partitioned in the outer container, and the space between the outer container and the pouches 46 work as a propellant storage part partitioned in the outer container.

The pouch 46 is equipped with a bag body 48 formed by bonding the periphery of the sheet, and the connecting member 49 attached to the opening of the bag body.

For the sheet used in the bag body 48, a synthetic resin sheet of polyethylene, polypropylene, polyethylene terephthalate, nylon, ethylene-vinyl alcohol copolymer, and etc; a vapor deposited sheet in which the silica, alumina, and etc are vapor deposited on the synthetic resin sheet; a metallic sheet of aluminum etc; a laminated sheet laminating at least two sheets selected from the synthetic resin sheet, the vapor deposited sheet, and the metallic sheet may be cited. The bag body 48 is formed by overlapping two sheets or folding the sheet and then bonding or heating adhering the periphery. The material of the sheet may be selected according to the ingredient of the contents.

The connecting member 49 has an adhesive portion formed on the lower part, and a part formed on the upper part for connecting with the engaging tubular part 26*g* formed on the lower end of the housing.

Such a pouch 46, has high selectivity of material against the inner bag 12 of the FIG. 1, and the metallic sheet or metal foil which can shut the penetration of the content can be used. Therefore more stable product can be obtained.

The valve assembly 47 is equipped with two independent aerosol valve 15, a valve holder 51 receiving these aerosol valves 15, and a mounting cover 52 covering the aerosol valve 15 and the valve holder 51 and fixing the aerosol valve 15 to the valve holder 51. The valve assembly 47 is also engaged with the outer container 11 holding the annual sealing member 23 in between. The aerosol valve 15 is substantially same as the aerosol valve 15 of FIG. 3.

The valve holder 51 comprises a base part 51*a* and a holder part 37, like shown in FIG. 8*a* to *c*. The shape of base part 51*a* is that the cross sectional view of the upper end is an oval shape where the line connecting the stem 27 of the aerosol valve constructs the long axis, the cross sectional view of the lower end is a round shape where a line parallel to above line connecting the stem constructs the diameter, and the lateral face connects the upper end and the lower end. In other word, it has a mountain shape where the lateral face contracts upwardly to the line connecting the stem 27 of the aerosol valve. Further, the positioning protrusion is not formed on the top face of the base part. The other configuration is substantially same as the valve holder 21 of FIG. 4.

The mounting cover 52 comprises a cover part 52*a* having upper surface of oval shape in which two passing hole 39 are formed, and a fixing part 42 of cylinder shape, like shown in FIGS. 8*d, e*. The shape of the cover part 52 is that the upper surface has an oval shape, the opening of the lower end has a round shape, and the lateral face has the shape which connects the cover part and the opening. In other word, it has a mountain shape fits with the base part of the valve holder where the lateral face contracts upwardly to the line connecting the passing hole 39 (imaginary line). The other configuration is substantially same as the mounting cover of FIG. 5.

The valve assembly has a shape of mountain where the outer face contracts upwardly to the line connecting stem 27, so the direction of the aerosol container 45 can be easily acknowledges and may be easily adjusted. Therefore, the discharging member (see FIGS. 17*a, b*) can be attached to the valve assembly in accurate direction.

The valve assembly 47 of the aerosol container 45 has two independent and separate aerosol valve 15, therefore, the contents may be discharged from the pouch 46 maintaining its independency.

Figure 9:
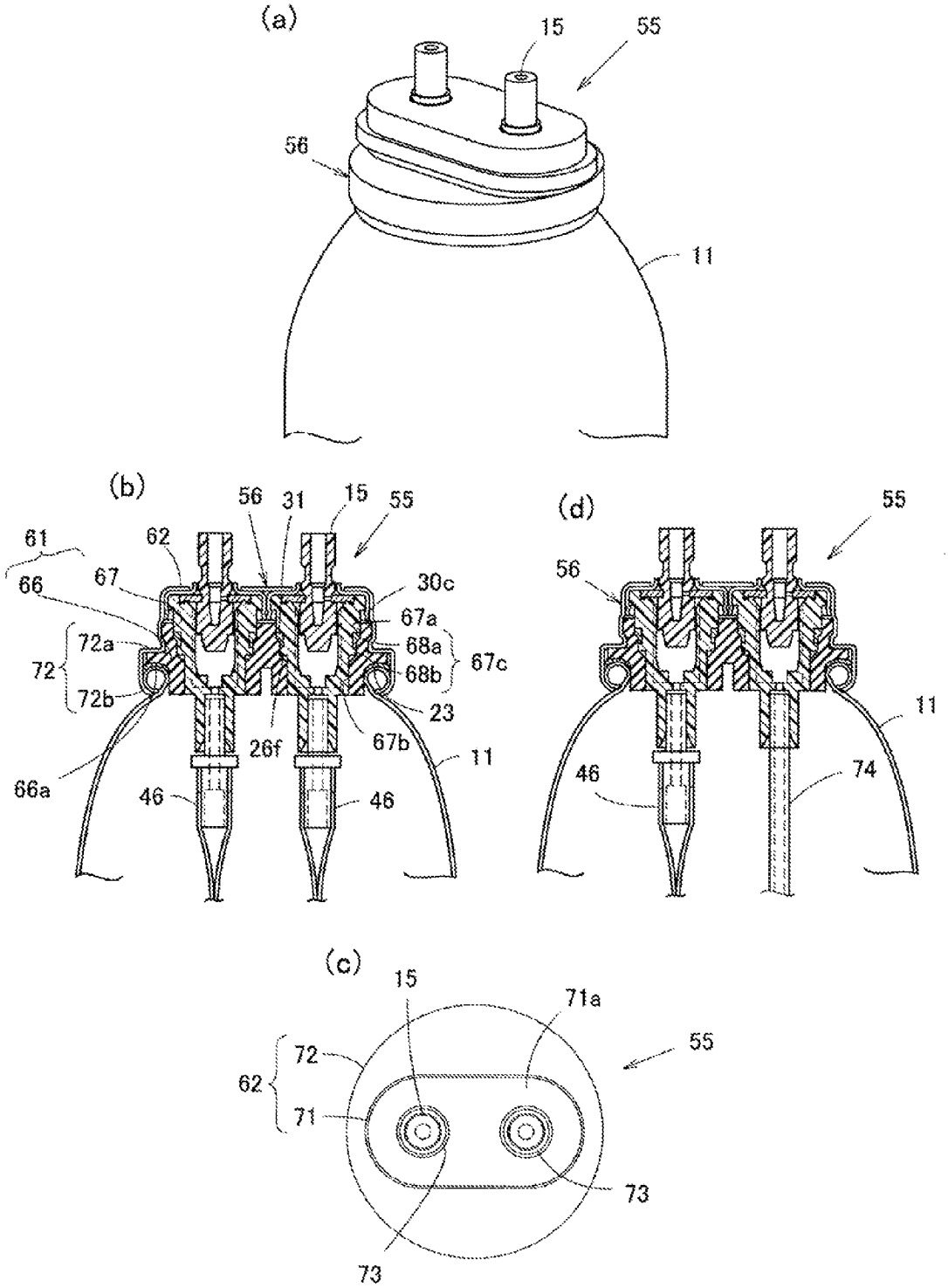
FIGS. 9*a* to *c* are a perspective view, a side cross sectional view, and a plan view showing a part of other embodiment of the aerosol container of the present invention.
FIG. 9*d* is a side cross sectional view showing a part of other embodiment of the aerosol container of the present invention.

The aerosol container 55 of FIG. 9*a* to *c* has an outer container 11, two pouches 46 inserted in the outer container, and a valve assembly 56 closing both pouches 46 and outer container 11. The outer container 11 is substantially same as the outer container 11 of FIG. 1. The pouch 46 is substantially same as the pouch 46 of FIG. 7.

The valve assembly 56 has two independent aerosol valve 15, a valve holder 61 receiving both aerosol valves 15, and a mounting cover 62 covering the aerosol valve 15 and aerosol valve 61 and fixing the aerosol valve 15 to the valve holder 61. The valve assembly 56 and the outer container 11 is engaged or fixed with an annual sealing member in between. The aerosol valve 15 is substantially same as aerosol valve 15 of FIG. 3.

The valve holder 61 comprises a base part 66 having column shape, and a holder part 67 which penetrates the base part up and down in vertical direction.

The base part 66 is oval column body, where the flange 66*a* protruding outwardly is formed on the lower part. The base part 66 is not equipped with the positioning protrusion, but it may be equipped with the positioning protrusion.

The holder part 67 is composed of an upper tubular portion 67*a*, a lower tubular portion 67*b* where the diameter is smaller than the upper tubular portion, and an annular step portion 67*c* connecting the lower end of the upper tubular portion 67*a* and the upper end of the lower tubular portion 67*b*. The annular step portion 67*c* has an upper step portion 68*a* and a lower step portion 68*b*. The upper tubular portion 67*a* of the holder part 67 receives the housing 26 of the aerosol valve. In this disclosure, the lower end 30*c* of the cover 30 of the aerosol valve is located on the upper surface of the upper tubular portion 67*a*. The holder part 67 supports the aerosol valve 15 by the lower step portion 68*b* engaging with the second step portion 26*f* of the aerosol valve, and the upper step portion 68*a* engaging with the valve gasket 31 attached to the first step portion 26*e* of aerosol valve 15. Further, the sealing function of the inside of the valve assembly 56 is maintained by the engaging of the upper step portion 68*a* and valve gasket 31. Two holder parts 67 are formed facing each other centering the centered axis of the base part 66 (see FIG. 4*a*).

The mounting cover 62 has a cover part 71 covering the aerosol valve 15 and valve holder 61, and a fixing part 72 fixing the valve holder 61 and outer container 11. The cover part 71 is a oval shaped tubular body which fits with the lateral face of the base part of the valve holder. Two passing holes 73 are formed on the upper surface 71*a* of the cover 71 for inserting or passing the stem 27 of the aerosol valve 15. The number of the passing hole may be increased when the positioning protrusion is formed on the base part. The fixing part 72 has an upper jaw portion 72*a* contacting with the upper surface of the flange 66*a* of the valve holder. The lower jaw portion 72*c* is formed by crimping the lower end when the valve assembly 56 is fixed to the outer container 11 (see FIG. 9*b*).

The valve assembly 56 of the aerosol container 55 has two independent and separate aerosol valves, like aerosol container 10 of FIG. 1 and aerosol container 45 of FIG. 7, so the contents are discharged from pouches 46 maintaining its independency.

The disclosure of FIG. 9*d* has same structure as aerosol container 55 of FIG. 9*a* except that the pouch 46 is attached to one aerosol valve 15 and the dipping tube 74 is attached to the other aerosol valve 15. That is one content is charged in the pouch 46 and the other content is charged in the outer container with the propellant. The contents of this aerosol container are discharged maintaining its independency like the aerosol container 45 of FIG. 7.

Figure 10:
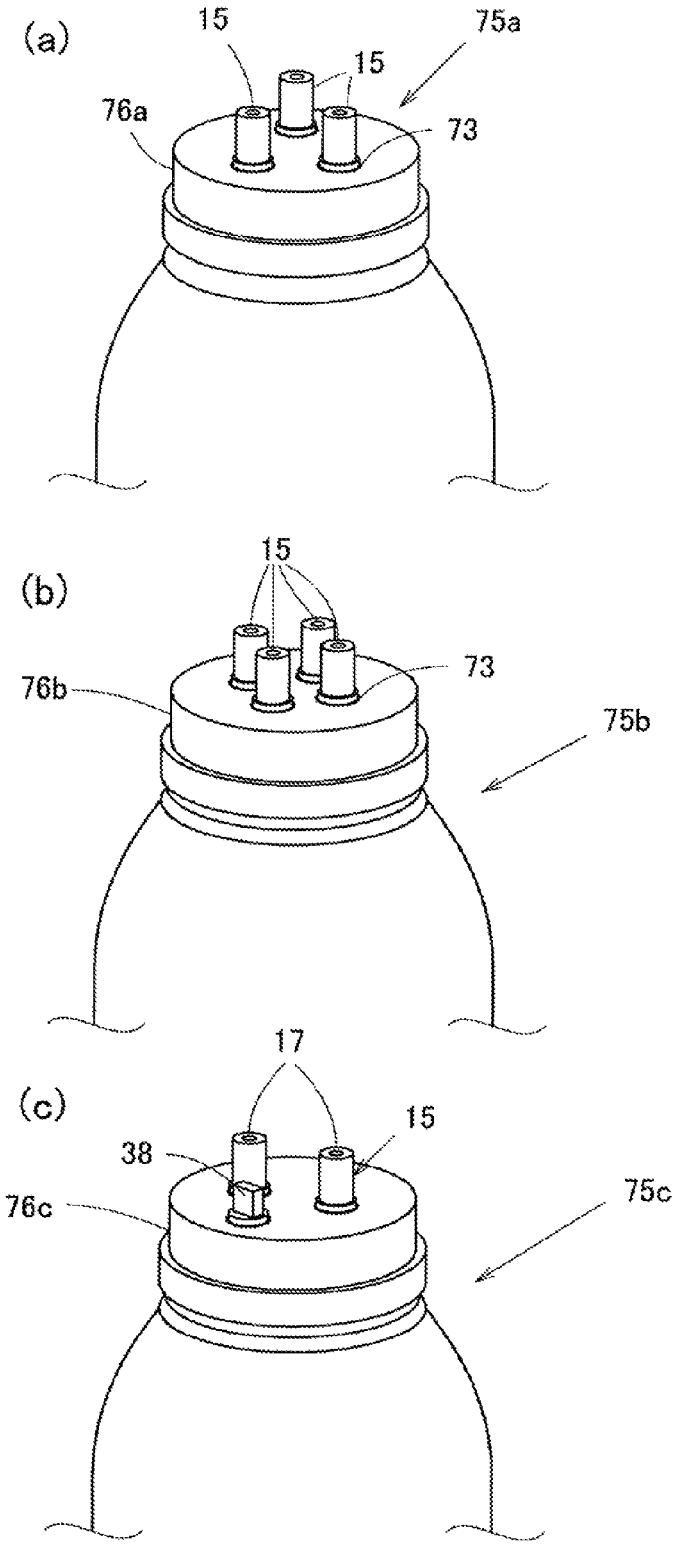
FIGS. 10*a* to *c* are a perspective views each showing a part of other embodiment of the aerosol container of the present invention.

The aerosol containers 75*a*, 75*b* of FIGS. 10*a, b* are that it is equipped with three aerosol valves 15 and four aerosol valves 15, respectively. The aerosol assembly 76*a*, 76*b* have a valve holder in which three or four holder parts are formed, and has a mounting cover in which three or four passing holes 73 are formed. The other configuration are substantially same as the aerosol container 10 of FIG. 1. Like the disclosure of FIGS. 10*a, b*, the valve assembly of the present invention may retain three or more aerosol valves. Three or more contents may be simultaneously discharged by charging the contents in the inner bag, pouch, tube container dipping tube or etc. attached to the aerosol valves, and charging the propellant in the outer container 11.

The aerosol container 75*c* of FIG. 10*c* is that the positioning protrusion 38 is formed outside of the stem 27 of the aerosol valve 15 from the center axis of the valve assembly 76*c* (aerosol container). This can prevent the damaging of the stem due to the direct contact of the device setting the direction with the stem.

Figure 11:
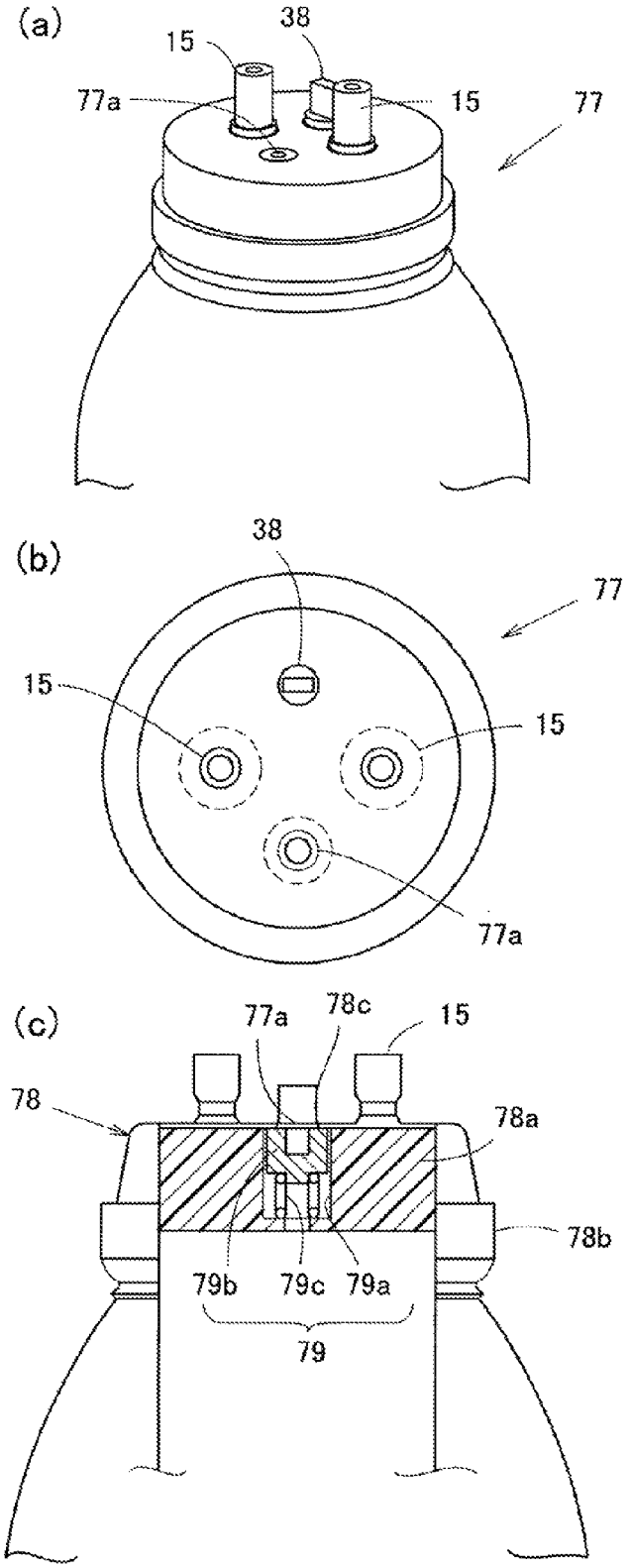
FIGS. 11*a* to *c* are a perspective view, a side cross sectional view, and a plan view showing a part of other embodiment of the aerosol container of the present invention.

The aerosol container 77 of FIGS. 11*a, b* are that equipped with two aerosol valves 15, positioning protrusion 38, and gas charging valve 77*a*. The gas charging valve 77*a* is composed of a check valve 79, and a charging hole 78*c* formed on the upper surface of the mounting cover 78*b* corresponds to the opening of the check valve 79. The check valve 79 has a pore portion 79*a* having a cross sectional view of round and penetrating the valve holder 78*a* up and down in vertical direction, a sealing member 79*b* stored in the pore portion 79*a* movable in up and down direction, and a spring 79*c* pressurizing the sealing member upward. The sealing member 79*b* is a tubular body having an opening at the top and bottom. The sealing member 79*b* is located so the opening of the sealing member and the periphery of the gas charging hole 78*c* are to be contacted. Therefore, the outer container 11 and the atmosphere communicate with each other by inserting the gas charging nozzle (not shown) into the gas charging hole 78*c* and moving the sealing member 79*b* downward. The aerosol valve 15 which communicates the inside of the outer container and the atmosphere may be used as alternate of the check valve.

Figure 12:
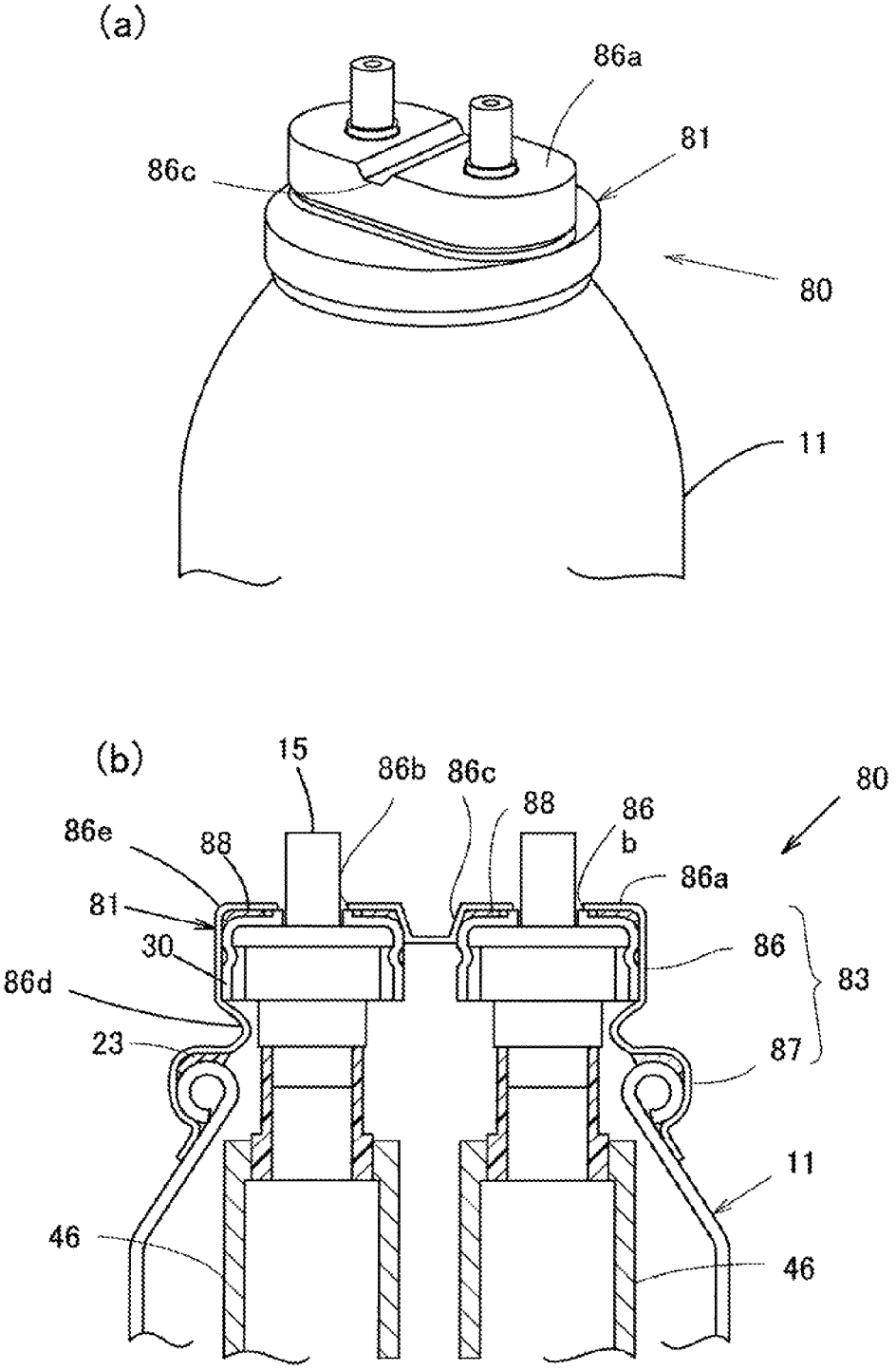
FIGS. 12*a, b* are a perspective view, and a side cross sectional view showing a part of other embodiment of the aerosol container of the present invention.

The aerosol container 80 of FIGS. 12*a, b* is equipped with an outer container 11 having tube shape with the bottom, two pouches 46 inserted in the outer container 11, and a valve assembly 81 closing both pouches 46 and outer container 11. The valve assembly 81 of the aerosol container 80 has mounting cover 83 which covers and retains two independent aerosol valves 15. In other word, the mounting cover 83 works as the retaining member, and the aerosol container 80 does not equipped with the valve holder. The valve assembly 81 and the outer container 11 are engaged with the sealing member 23 in between. The aerosol valve 15 is substantially same as the aerosol valve of FIG. 3.

The mounting cover 83 comprises a cover part 86 covering two aerosol valves 15, and a fixing part 87 fixing itself to the outer container 11. The cover part 86 is a oval shape tubular body where two passing holes 86*b* are formed on the upper surface 86*a* and a retaining groove 86*c* formed on the center of these two passing holes 86*b*. The passing hole 86*b* is a hole which passes or inserts the stem of the aerosol valve like said previously. The retaining groove 86*c* is formed for sandwiching the upper end of the aerosol valve (upper end of the cover 30) with the periphery of the upper end 86*e* of the cover part 86 to retain the aerosol valve. Further, lower jaw portion 86*d* is formed by crimping the lower end of the cover part 86 after inserting the aerosol valves 15 by inverting the mounting cover 83. Because the aerosol valve is pinched between the retaining groove 86*c* and periphery of the upper end 86*e* of the cover portion 86, the valve holder may be omitted and the aerosol valve can be retained without the valve holder. Further, to maintain the sealing function between the cover part 86 and the cover 30 of the aerosol valve, annular sealing member 88 is provided around the opening of passing holes 86*b*.

The aerosol container 90*a* of FIGS. 13*a, b* is equipped with a outer container 91 made of synthetic resin, two pouches 92 inserting in the outer container, and a valve assembly 93 closing both pouches 92 and outer container 91. The pouch 92 is substantially same as the pouch 46 of FIG. 7.

The outer container 91 is a pressure resistant container made of synthetic resin, which comprises a barrel portion 91*a* having a tubular shape, a shoulder portion 91*b* having a tapered shape, a neck portion 91*c* having a tubular shape, and a thick flange 91*d* formed on the top. The inside surface of the neck portion 91*c* and the flange portion 91*d* are continued constructing an opening of inner surface 91*e* of cylinder shape. The outer container 91 is manufactured by two axis extending blow processing in which the tubular parison of synthetic resin, such as polyethylene terephthalate, nylone, polypropylene, and etc, is expanded by blowing the air inside, while extending in axis direction. However, it may be manufactured by mold injection processing. The synthetic resin material transmissive to the light may be used, and the vapor deposited layer of carbon, alumina, silica and etc, may be provided on the inside and/or outside surface of the outer container.

The valve assembly 93 is equipped with two independent aerosol valves 15, a valve holder 96 receiving these aerosol valves 15, and a mounting cover 97 covering the aerosol valve 15 and valve holder 96, and fixing the aerosol valve 15 to the valve holder 96. The aerosol valve 15 is substantially same as the aerosol valve 15 of FIG. 3.

The valve holder 96 has a base part 101, two holder part 102 having tubular shape which is formed by penetrating the base part up and down, a positioning protrusion 38 formed on the top of the base part extending upward, and a check valve 79. The positioning protrusion 38 is substantially same as the positioning protrusion 38 of FIG. 4, and the check valve 79 is substantially same as the check valve 79 of FIG. 11. Further, the aerosol valve 15 may be alternately used as check valve.

The base part 101 has a main body (lid part) 103 of column shape, and a sealing part (plug part) 104 extend downward from the lower end of the sealing part. The flange portion 103*a* extending outward is formed on the lower part of the main body 103. The sealing part 104 is a part inserted into the outer container, and the outer diameter is slightly smaller than the inner diameter of the flange portion 91*d* (neck portion 91*c*) of the outer container 91. The annular recessed part 104*a* is formed on the outer surface of the sealing part 104 for inserting the annular gasket (O-ring) 105. The gasket 105 is a sealing member having an annular shape and having cross sectional view of circle. That is the sealing structure between the valve holder 96 and outer container 91 is obtained with the gasket 105 by inserting the sealing part 104 in which the gasket 105 is engaged with the annular recessed part 104*a* into the outer container 91.

The holder part 102 is formed of penetrating hole which penetrate the base part 101 up and down and receives and support the aerosol valve 15. The holder portion 102 has an upper tubular portion 102*a*, a lower tubular portion 102*b* where the diameter is smaller than the upper tubular portion 102*a*, and an annular step portion 102*c* connecting the lower end of the upper tubular portion 102*a* and upper end of the lower tubular portion 102*b*. The annular step portion 102*c* has an upper step portion 102*d* and a lower step portion 102*e*. The holder portion 102 also support the aerosol valve 15 in which the upper tubular portion 102*a* receives the housing of the aerosol valve 15, the upper step portion 102*d* and the lower step portion 102*e* engages with the first step portion 26*e* and the second step portion 26*f*, respectively. Further, the aerosol valve 15 and the valve holder 96 are sealed by providing the annular valve gasket between the upper step portion 102*d* and/or the lower step portion 102*e* of the annular step portion 102*c*, and the first step portion 26*e* and/or the second step portion 26*f* of the aerosol valve.

The mounting cover 97 is composed of a cylindrical shaped cover part 97*a* covering the aerosol valve 15 and valve holder 96, a cylindrical shaped fixing part 97*b* fixing the valve holder 96 and outer container 91 and have a larger diameter than the cover part. The cover part 97*a* has three pass holes formed on the top surface passing the stem of the aerosol container and the positioning protrusion, and a gas charging hole communicates with the opening of the check valve. The fixing part 97*b* has an upper jaw portion 106*a* which contacts with the upper surface of the flange 103*a*, and has a lower jaw portion 106*b*. The lower jaw portion 106*b* is formed by crimping the lower end when fixing the valve assembly 93 to the outer container 91.

In the aerosol container 90*a*, the valve assembly 93 and the outer container 91 are sealed by the gasket (O-ring) 105 provided between the inside surface of the tubular opening (neck portion 90*c* or flange portion 90*d*) of the outer container 91 and the sealing part 104 of the valve holder. Therefore, the sealing function is not influenced by the dimensional of the crimping process of the mounting cover 97 to the outer container 91. Further, to secure the fixing of the valve holder, the lower end (upper jaw portion 106*a* and lower jaw portion 106*b*) of the mounting cover is crimped while the pressing of the flange portion 103*a* of the valve holder and the flange portion 91*d* of the outer container in vertical direction. Therefore, the aerosol valve is pressed downward and the gasket 105 is compressed and the sealing function between the outer container and the valve holder is secured.

Figure 13:
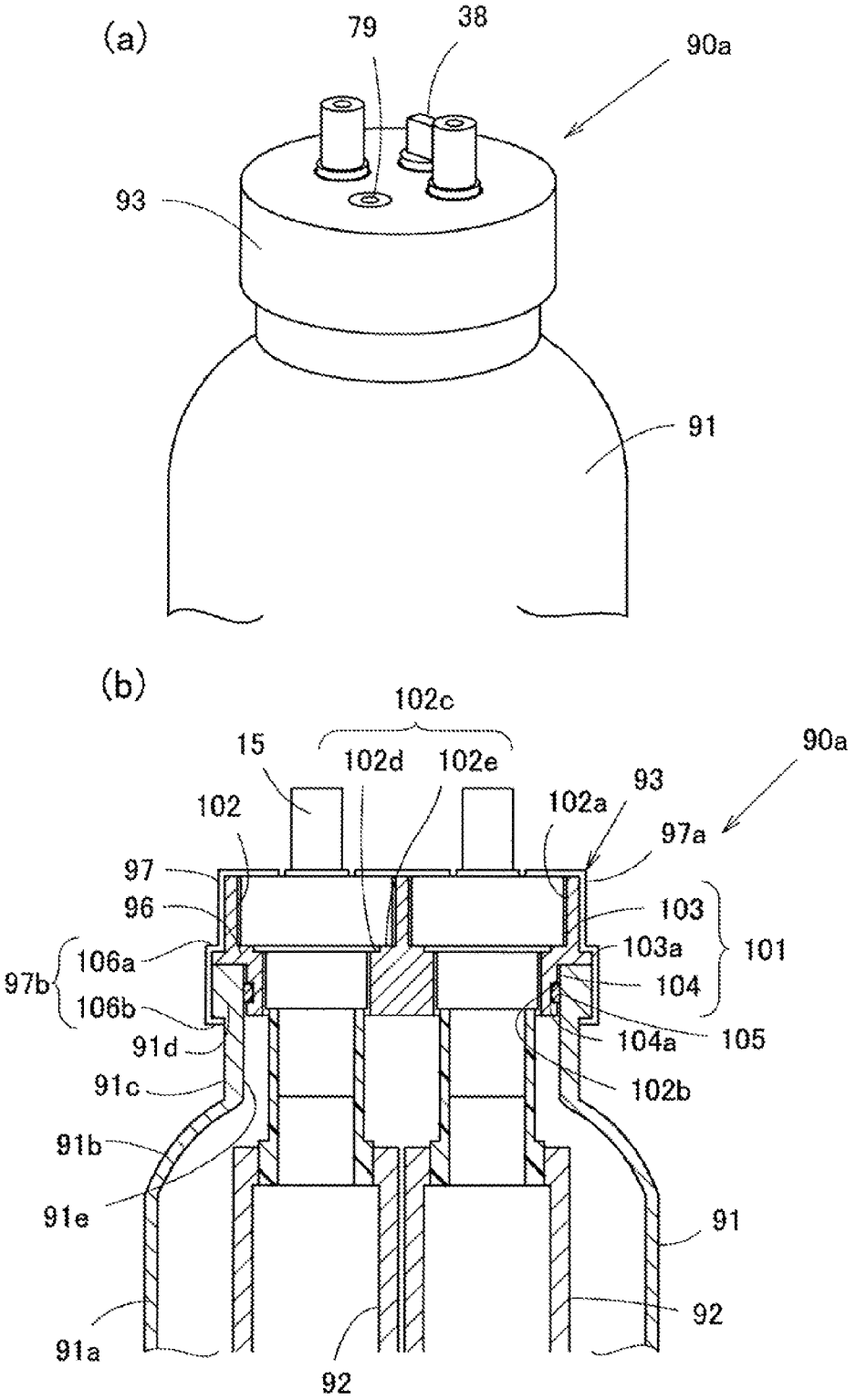
FIGS. 13*a, b* are a perspective view, and a side cross sectional view showing a part of other embodiment of the aerosol container of the present invention.

The aerosol containers 90*b, c, d* of FIGS. 14*a, b, c* are that the structure of the bag inserting inside of the aerosol container 90*a* of FIG. 13 is different.

The aerosol container 90*b* of FIG. 14*a* is equipped with a pouch 110 that has a bag body 111 where two storage part 110*a, b* are provided, and two connecting members 112 attached to the aerosol valves 15 and close the opening of the storage parts 110*a, b*. The connecting member 112 is a column shaped body, having communicating paths 113*a, b*, which communicate with the storage parts 110*a, b* with the atmosphere. The aerosol valve 15 is attached to these communicating paths 113*a, b*. The metal tube may be inserted in the communicating path in order to avoid the penetration of the content, prevents the degradation of the content. The bag body 111 of the pouch 110 is manufactured by overwrapping three sheets (upper sheet 111*a*, middle sheet 111*b*, lower sheet 111*c*) and bonding the periphery of the sheet by ultrasonic wave adhesion, heating adhesion, and etc. It is preferable to use the sheet that has at least one synthetic resin layer, and it is more preferable to use the sheet that has at least metallic foil layer and synthetic resin layer. The type of the sheet may be selected according to the type of the content to be charged. One of the sheet may be transmissive sheet, so that the user can recognize the remaining amount and the color of the content. The two storage part 110*a, b* of the pouch 110 are paralleled and partitioned by the middle sheet 111*b*. Therefore, both storage parts 110*a, b* always receive same pressure despite of the deforming degree of storage parts, and the discharging amount are always stable.

In this embodiment, the content storage part is formed of one bag body, and the propellant storage area is formed between the outer container and the inner bag 12 in the outer container.

The aerosol container 90*c* of FIG. 14*b* is that the inner bag 12 and the pouch 46 are attached to the aerosol valves 15 respectively. The inner bag 12 is substantially same as the inner bag of FIG. 1 and the pouch 46 is substantially same as the pouch 46 of FIG. 7.

The aerosol container 90*d* of FIG. 14*c* is that the tube container 117 made of synthetic resin is attached to the aerosol container 15. The tube container 117 has a body part 117*a* made of synthetic resin and a mouth portion 117*b* of truncated cone shape bonded to the upper end of the body portion. The mouth portion 117*b* is closed with thin film (not shown) before the use. When the tube container 117 is used, the charging process of the contents can be done easy. That is the contents are charged from the bottom of the body portion 117*a* of the tube containers 117, and the bottom is closed after the charging. Then the tube container 117 is attached to the aerosol valve 15 while breaking the thin film.

Figure 14:
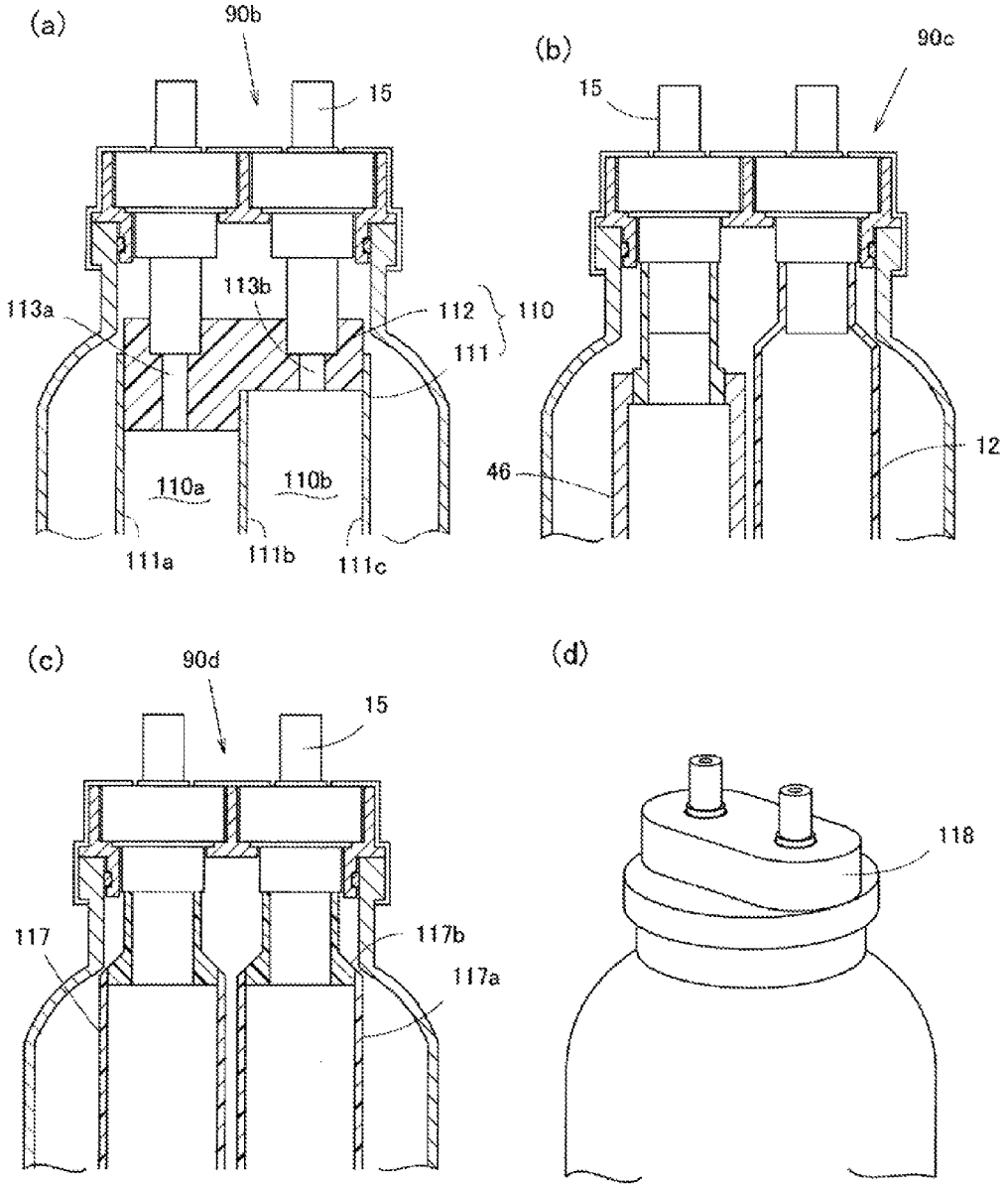
FIGS. 14*a* to *d* are a side cross sectional view, a side cross sectional view, a side cross sectional view and perspective view each showing a part of other embodiment of the aerosol container of the present invention.

For all the aerosol container 90*b* to *d* of FIG. 14 *a* to *c*, the shape of the upper part 118 of the valve assembly can be made in oval column shape like shown in FIG. 14*d*. On the other hand, the valve assembly 56 of FIG. 9 may be used to the outer container 91.

The aerosol container 120 of FIGS. 15*a, b* has an outer container of three pieced bottle mentioned above, and which does not have the integral body. The aerosol container 120 is equipped with the outer container 121, pouch 46 inserting in the outer container, and the valve assembly 121*a*. The connecting member 49 of the pouch 46 is attached to the side of the bag body 48.

The outer container 121 has a barrel member 122 of tubular shape, a bottom member coupled with the lower end of the barrel member by double seaming structure, and a head member 123 coupled with the upper end of the barrel portion.

The head member 123 has a shoulder portion 123*a* having the tapered shape, a neck portion 123*b* formed on the upper end of the shoulder portion, and the top face portion 123*c*, where the lower end of the shoulder portion 123*a* is coupled with the upper end of the barrel member by double seaming structure. The annual groove 123*d* is formed between the shoulder portion 123*a* and the neck portion 123*b* to hold the valve holder 125. The neck portion 123*b* and the top face portion 123*c* of the head member 123 shares the same role as the mounting cover.

The valve assembly 121*a* is equipped with two independent aerosol valve 15, a valve holder 125 receiving both aerosol valves 15, and the head member 123 covering the aerosol valve and the valve holder 125 and fixing the aerosol valve to valve holder 125. Two annular sealing members 124 are provided between the top of the valve holder 125 and the head member 123.

The valve holder 125 has base part 126 and two holder part 127 penetrating the base part in vertical direction.

The base part 126 has a main body 128 of column shape and a supporting flange 129 extending downward and outward from the lower end of the base part, and the annular recessed part 130 is formed between the main body 128 and flange 129. The gasket 131 is provided above the supporting flange 129. The gasket 131 is sandwiched between the flange 129 and the annular recessed part 130.

The holder part 127 is formed of an upper tubular portion 127*a*, a lower tubular portion 127*b*, and an annular step portion 127*c* connecting the upper tubular portion and the lower tubular portion. The upper tubular portion 127*a* receives the aerosol valve, and the aerosol valve 15 contacts with the annular step portion 127*c* (upper end of the lower tubular portion).

On the upper face part 123*c* of the head member 123, two passing hole 123*e* passing the stem is formed. Two sealing member 124 are provided below the lower surface of the upper face part 123*c*, and provided so as to have same axis as the passing hole.

The method for assembling of the valve assembly 121 is that first the aerosol valve 15 is set on the valve holder 125, and the sealing members 124 are set on the valve holder by inserting the stem inside. Next, the head member 123 in which the annular groove 123*d* is not yet formed is covered on the valve holder 125. Then, the valve assembly is assembled by forming the annular groove 123*d* by crimping the part between the shoulder portion and neck portion of the head member against upper surface of the supporting flange 129 and crushing the gasket 131. The aerosol container 120 is manufactured by attaching the valve with the pouch 46, and engaging the lower end of the head member 123 with the upper end of the barrel member 122 by double seaming.

In this valve assembly 121, the valve holder 125 is provided inside the outer container 121, so the appearance of aerosol container is substantially same as the conventional aerosol container.

Figure 16:
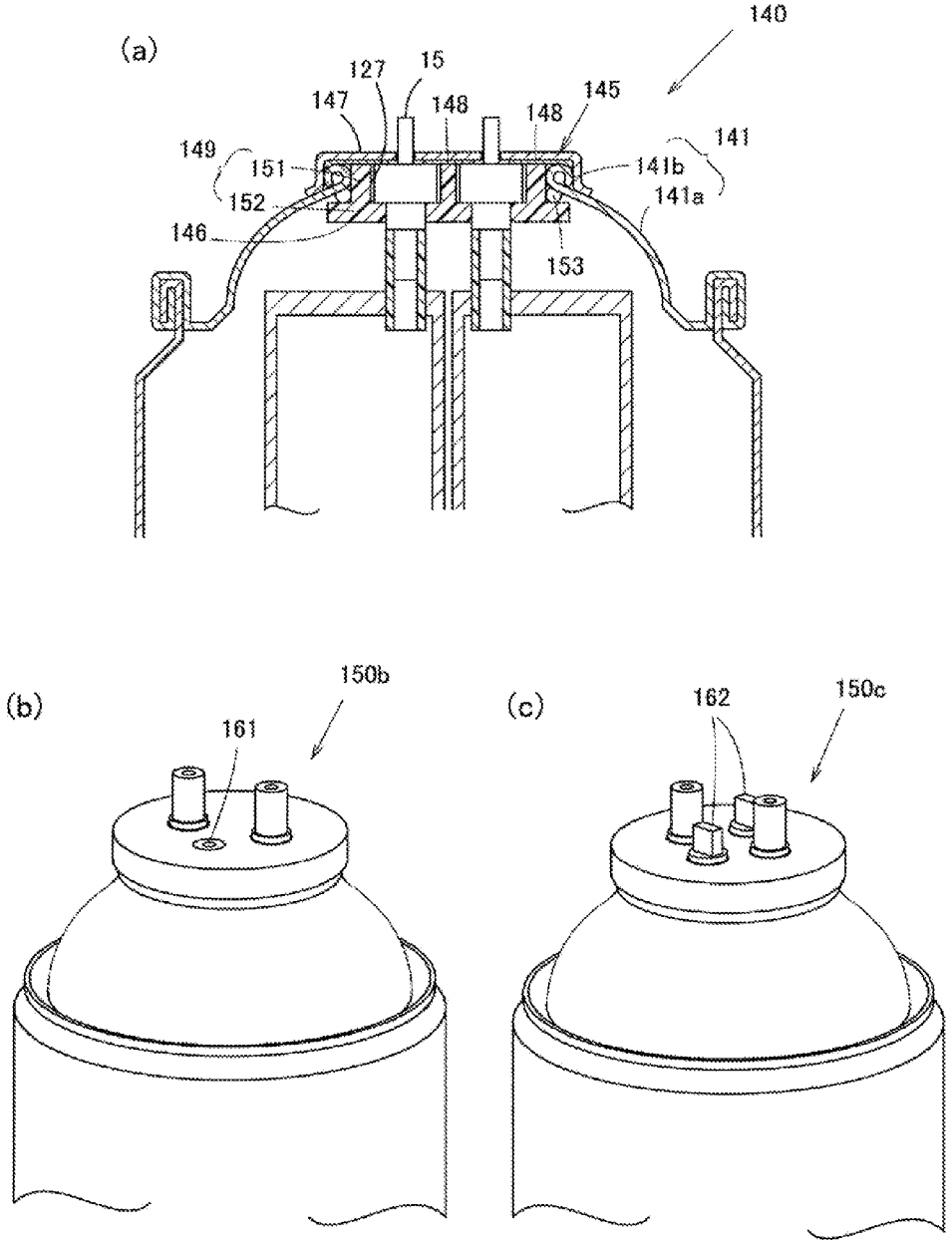
FIGS. 16*a* to *c* are a side cross sectional view, a perspective view, and a perspective view each showing a part of other embodiment of the aerosol container of the present invention.

The aerosol container 140 of FIG. 16 is equipped with a head member 141 having a shoulder portion 141*a* of tapered shape, and the bead portion 141*b* formed on the top. Further, the valve assembly 145 is equipped with aerosol valve 15, valve holder 146, and the mounting cover 147. Two sealing members 148 are provided between the upper end of the valve holder 146 and the mounting cover 147.

The valve holder 146 has a base portion 149, and the holder portion 127 penetrating the base part in vertical direction. The holder part 127 is substantially same as the holder part 127 of FIG. 15.

The base part 149 has a main body 151 of column shape, and a supporting flange 152 extending outward from the lower part of the main body. The gasket 153 is provided on the supporting flange 152.

The mounting cover 147 is a tubular body having the upper face. The lower end of the mounting cover 147 is fixed to the bead portion of the head member by crimping. On the upper face, the two passing holes are formed. Two sealing member 148 are provided below the upper face, and provided so as to have same axis as the passing hole.

The method for assembling of the valve assembly 121 is that first the valve holder 125 which the aerosol valve 15 is attached is prepared, then the head member 141 is mounted on top of the valve holder. Next, the mounting cover 147 is mounted after the sealing member 148 is set. Then, lower end of the mounting cover 147 is crimped against the bead portion of the head member while pressing the valve holder 146 and the mounting cover 147.

Figure 15:
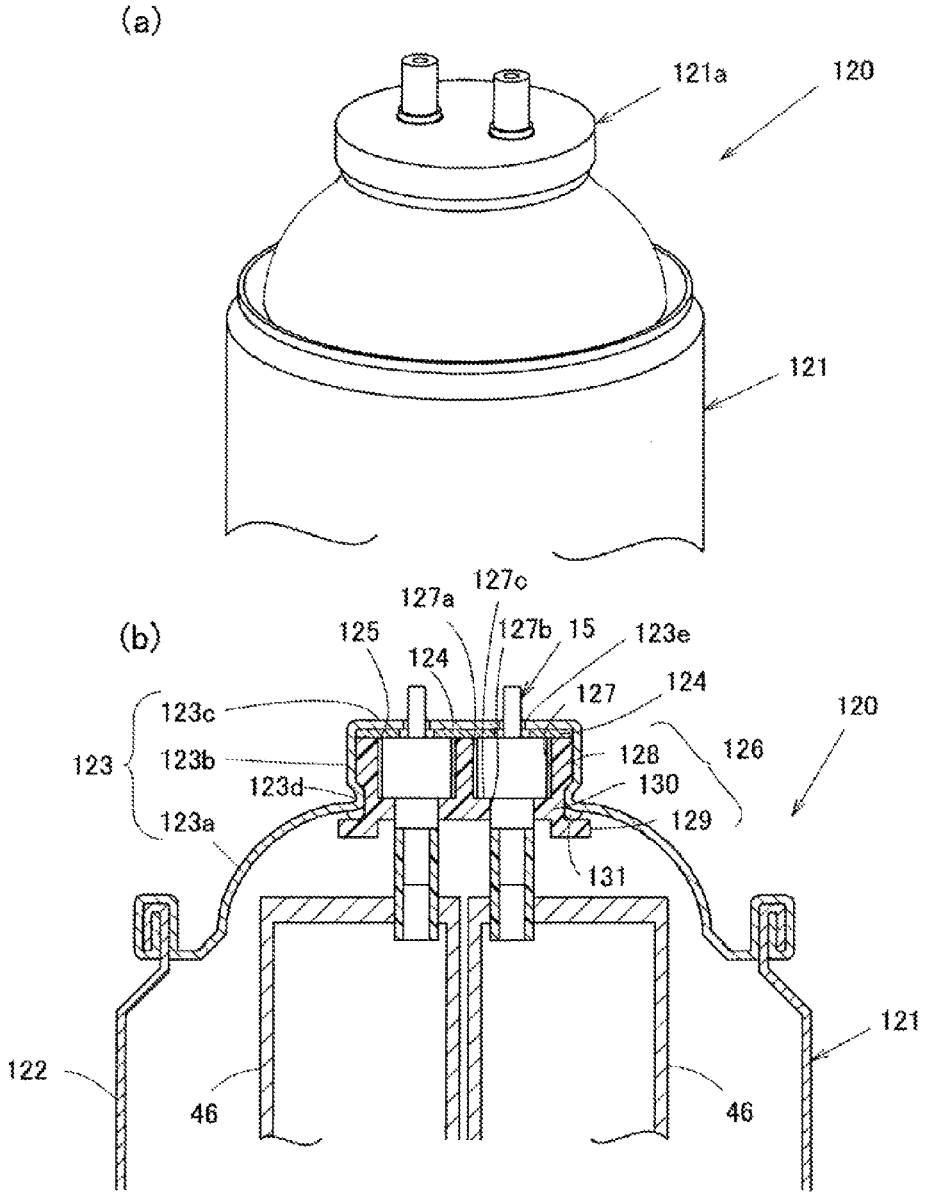
FIGS. 15*a, b* are a perspective view, and a side cross sectional view showing a part of other embodiment of the aerosol container of the present invention.

The aerosol container 120 of FIG. 15 and aerosol container 140 of FIG. 16 both retains two independent and separate aerosol valve 15, therefore the content passing the aerosol valve 15 will be discharged with maintaining the independency.

The aerosol container 150*b, c* of FIGS. 16*b, c* is that the gas charging valve 161 or the positioning protrusion 162 are provided on the aerosol container 140 of FIG. 16. The gas charging valve 161 and the positioning protrusion 162 are substantially same as the gas charging mechanism of FIG. 11 and the positioning protrusion 38 of FIG. 1, respectively. Further, one of the positioning protrusion 152 of the aerosol container 150*c* of FIG. 16*c* may be changed with gas charging valve, and have it composed with both the gas charging valve and the positioning protrusion.

The discharging member which can be assembled to the aerosol container of the present invention (for example, aerosol container 10) are disclosed.

The discharging member 170 of FIG. 17*a* to *d* are composed of a attachment part 171 of tubular shape, and a handling part 172 placed inside of the attachment part movable in a vertical direction.

The assembling part 171, like shown in FIG. 17*b*, has an outer tubular portion 171*a*, an intermediate tubular portion 171*b*, and an inner tubular portion 171*c* in which the handling part 172 is inserted. The outer tubular portion 171*a* guards the upper part of the aerosol container, and the lower end of the outer tubular portion 171*a* contacts with the shoulder portion or the top of the barrel portion of the outer container. The intermediate tubular portion 171*b* engages with the fixing part of the mounting cover of the valve assembly at its lower end.

The handling part 172 has engaging portions 174*a, b* which engages with stems of the aerosol valves, a nozzle portion 175 having a discharging hole 175*a* discharging the content in which the cross section shape is rectangle, and a passage way 176*a, b* each communicating the discharging holes 175*a* with the engaging portions 174*a, b*. The passage way 176*a, b* has an independent path 177*a, b* each extending from the engaging portion 174*a, b*, and a unified path 178 communicated with the upper end of both independent path 174*a, b* and extend horizontally to the discharging hole 175*a*. It is constructed so as the sum of the diameter of the independent path 177*a, b* is substantially same as the width X of the unified path. Further, it is preferable that the independent path 177*a, b* extends straight up from the engaging portion 174*a, b*, however it may be bended or tapered so that the distance of the independent path 177*a, b* is shorter than the distance of the engaging portion 174*a, b*. The upper end distance of the independent path 177*a, b* is determined according to the width of the discharging hole 175*a*. The partition may be provided at the base end side of the unified path 178 to have the upper stream of the unified path to be independent and have it converge at one point. The unified path 178 may be divided into two independent path by providing the partition from the base end side to the front edge side (discharging hole), and have the discharging hole divide into two.

By attaching the discharging member 170 to the aerosol container having two independent aerosol valve of the present invention, two contents charged inside the aerosol container may be simultaneously discharged. It can be operated by lowering the handling portion 172 against the aerosol container. Further, because the discharging hole 175*a* of the nozzle part 175 is protruded outward from the opening of the inner tubular portion, the residual which fall off from the discharging hole 175*a* will not infiltrate inside the discharging member 170. Therefore, the aerosol container 10 having mounting cover made of metal, such as aluminum, can be protected.

On the other hand, the content flowing the passage way may be seen by forming the handling part 172 with a transparent or transmissive resin, such as polypropylene, styrene-butadiene copolymer, or etc. Specifically, it is preferable to have the width of the introducing hole supplying the content from the engaging part 174*a, b* and the width of the discharging hole 175*a* (the sum of the distance between the independent path 177*a, b* and the diameter of both independent path 177*a, b*) to be substantially same, and have the handling portion 172 with transparency, like the passage way of handling portion 172 of FIG. 17*c*, like shown in FIG. 17*c*. By supplying the content into the handling portion 172, two content will flow in parallel and flow to the discharging hole with same speed after the interflow. Therefore the amount of the content supplied into the unified path 178 is visually comfirmable by the width of contents in the unified path 178. As a result, the user can visually acknowledge the problem that the contents are provided inappropriately when the discharged amount of two contents are different, due to such that the handling part is lowered in a slant condition, or that the handling part has defects.

The handling part 172 in which the sum of distance between the two independent path 177*a, b* and the diameter of the independent path 177*a, b* is substantially same as the width X of the unified passage 178, can also be used to the double type aerosol device in which two aerosol container are combined as one, or the aerosol device in which the aerosol valve has two stem. At both cases, the contents can be provided in same speed. Further, by providing the transparency, the user can visually confirm that the contents are being discharged appropriately. Moreover, by providing a scale on the width direction of the unified passage, the ratio of the flow volume of two contents can be clearly verified.

Figure 18:
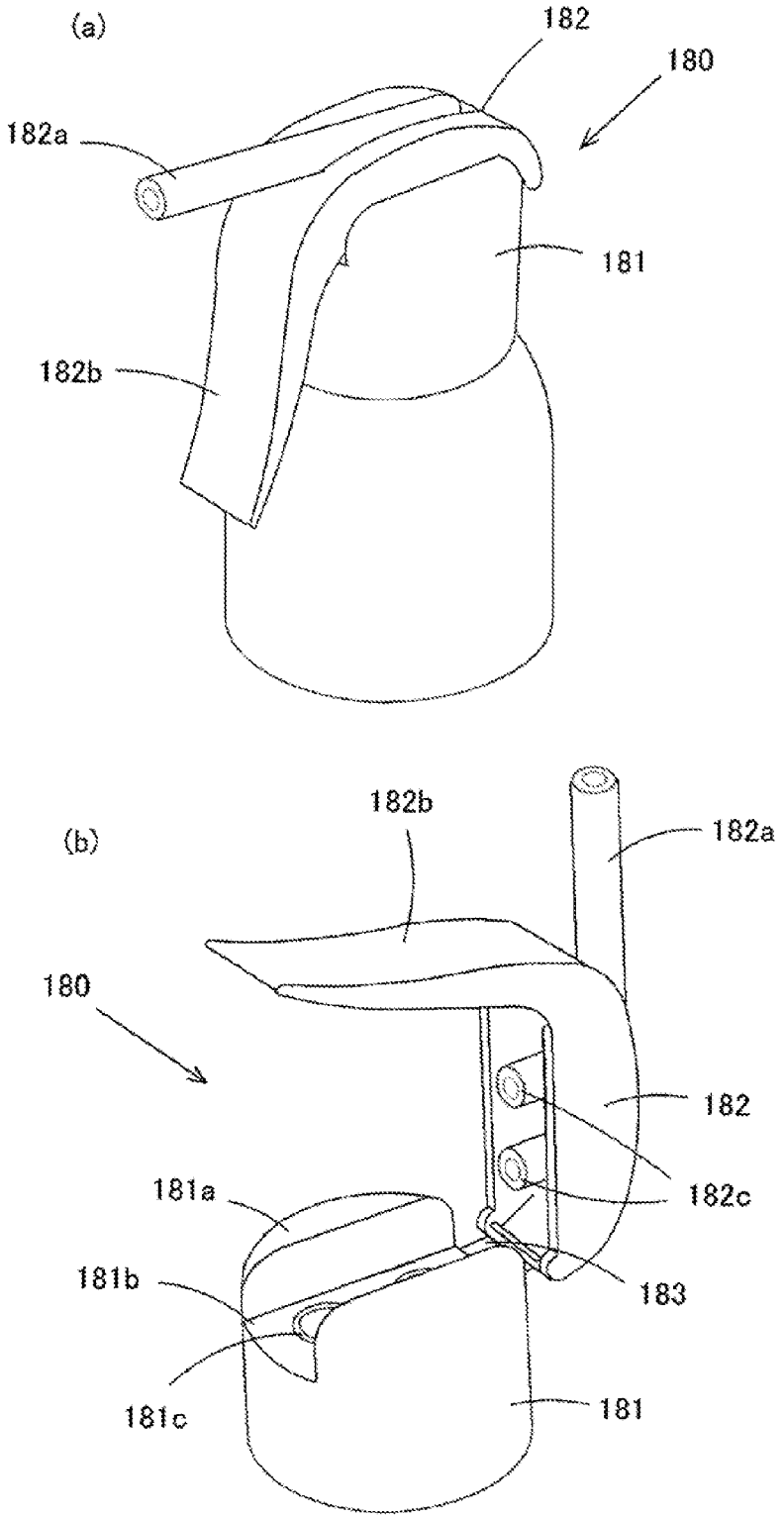
FIGS. 18*a, b* are a perspective views each showing a discharging member which can be used to the aerosol container of the present invention.

The discharging member 180 of FIG. 18 has a tubular attachment part 181, and a handling part 182 placed inside of the attachment part movable in a vertical direction, where the attachment part 181 and the handling part 182 are connected with the hinge.

The attachment part 181 has a tubular shape, where the lower end of the attachment part engages within the fixing part of the mounting cover of the valve assembly. The attachment part 181 has a top surface 181*a* where the recessed part 181*b* extending front and back of the top surface 181*a* is formed. And two penetrating hole 181*c* is formed on the recessed part 181*b* formed side by side.

The handling part 182 is an approximately cuboid shaped body which is inserted into the recessed part 181*a*. The handling part 182 has a nozzle 182*a* extending frontward from the upper part, a lever 182*b* extending frontward and downward from the lower part, and two stem engaging part 182*c* extending downward from the lower end. Further, the nozzle 182*a* and two stem engaging part 182*c* are communicated with the passage. Moreover, hinge 183 which connects the handling part 182 with the attachment part 181 is provided at the backside.

The aerosol container can be operated by pulling the lever 182*b* of the handling part 182, so the handling part 182 will round upon the hinge as its axis, in other word, the handling part 182 will be lowered against the aerosol container.

Figure 19:
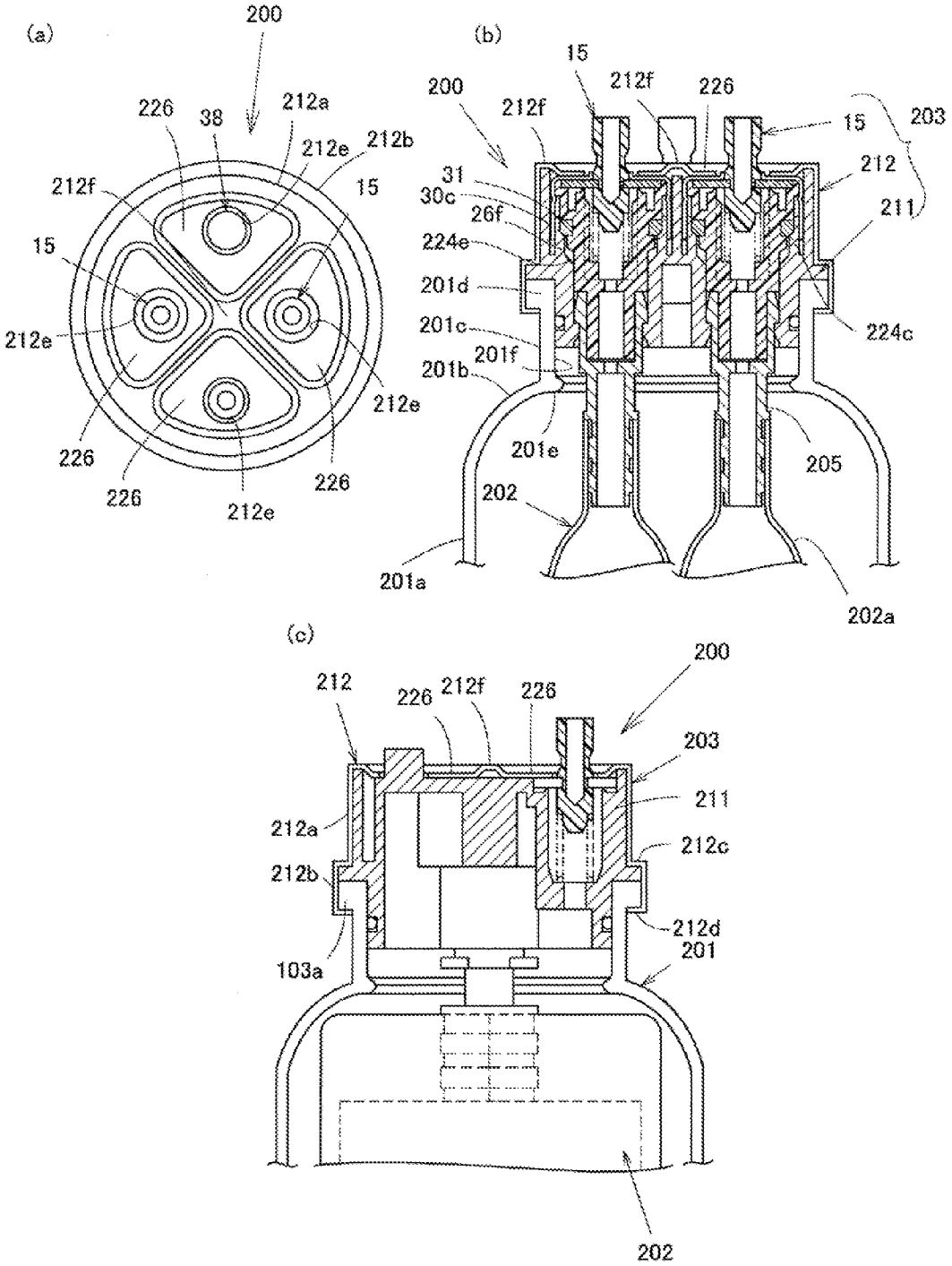
FIGS. 19*a* to *c* are a plan view, a front cross sectional view, and a side cross sectional view showing a part of other embodiment of the aerosol container of the present invention.

The aerosol container 200 of FIG. 19 is equipped with an outer container 201 having tubular shape, two pouches 202 inserted in the outer container, and a valve assembly 202 closing both pouches 202 and the outer container 201. The valve assembly 292 retains two independent and separated aerosol valves 15.

The outer container 201 is a pressure resistant container made of synthetic resin. The outer container 201 has a tubular barrel portion 201*a*, a tapered shoulder portion 201*b*, a tubular neck portion 201*c*, and a thick flange portion 201*d* formed on the top opening. The annular protrusion 201*e* protruding inwardly in the radial direction is formed on the inner surface between the shoulder portion 201*b* and the neck portion 201*c* The neck portion 201*c* and the flange portion 201*d* shares same inner face, and this inner face 201*f* configures the opening of the outer container 201. The manufacturing method of the outer container 201 is substantially same as the outer container 91 of FIG. 13. Further, it is also preferable that the outer container 201 is transmissive.

The pouch 202 is composed of a bag body 202*a* and the connecting member 205 fixed to the opening of the bag body. The bag body 202*a* is substantially same as the bag body 48 of FIG. 7.

The connecting member 205 has a tubular bonding part 206 in which the opening of the bag body 202*a* is bonded by the heating adhesion or ultrasonic adhesion; a tubular valve engaging part 207 formed above of the bonding part 206 sharing same axis, and engaged to the lower end of the aerosol valve 15; and a tubular middle part formed in between the bonding part 206 and the valve engaging part 207 sharing same axis. All, the bonding part 206, middle part 208, and valve engaging part 207, shares same centered hole. The connecting member 205 is an integrally made member made of synthetic resin such as polyethylene or polypropylene, or etc.

The bonding part 206 is an approximately diamond shaped column body, where the horizontal rib 206*a* is formed on its lateral face and the flange 206*b* is formed on its top.

The valve engaging part 207 is a tubular body having flange part 207*a* formed on the lower end.

The valve assembly 203 is equipped with two independent aerosol valve 15, a valve holder 211 receiving these aerosol valves 15, and a mounting cover 212 covering the aerosol valve 15 and the valve holder 211, fixing the aerosol valve to the valve holder 211 and fixing valve holder to the opening of the outer container 201, like shown in FIG. 19*b*. The aerosol valve 15 is substantially same as the aerosol valve 15 of FIG. 3.

The valve holder 211 has a base part 216 of tubular shape, two tubular holder part 217 penetrating the base part 216 in vertical direction; a positioning protrusion 38 formed on the top of the base part extending upwardly; and a charging part 218 penetrating the base part 216 in vertical direction, like shown in FIG. 20*d* to *f*.

The base part 216 is composed of a main body (lid part) 103 and a sealing part (plug part) 104. The top surface 103*b* of the main body 103 has a ring part 216*a* which extend from the periphery. In other word, the top surface 103*b* of the main body 103 is lower than the ring part 216*a*. The other configuration of the main body 103 is substantially same as the base part 101 of FIG. 3, and comprises a flange portion 103*a* on the lower part, and is attached with the gasket 105 around the annular recessed part 104*a* of the sealing part 104.

Figure 4:
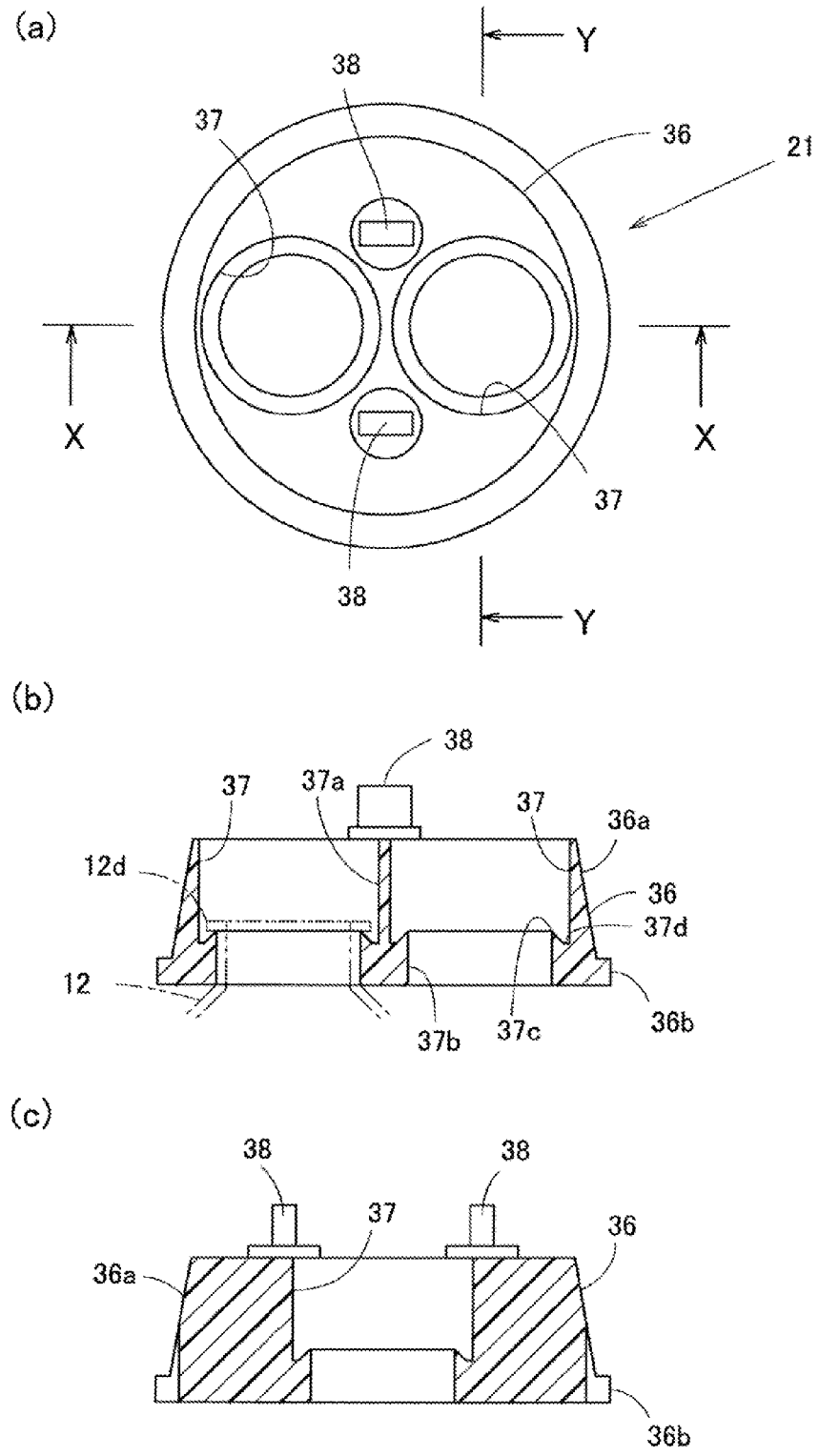
FIGS. 4*a* to *c* are a plan view, an X-X line cross sectional view of the plan view, and a Y-Y line cross sectional view.

The positioning protrusion 38 is substantially same as the positioning protrusion 38 of FIG. 4 and is extended from the top surface 103*b* of the main body 103.

The charging part 218 has an annular rubber retaining part 218*a* on the upper end, like shown in FIG. 20*f*. The valve is assembled by inserting the stem 219*a* for gas charging into the charging part 218, setting the stem rubber 219*b* on the rubber retaining part 218*a*, and setting the spring 219*c* so as to press the stem 219 upward. However, the valve in which the stem is not protruded outside may be used. The providing of the valve having the stem 219*a* for the gas charging eases the charging of the propellant, and can obtain high sealing function. The stem rubber 219*b* is fixed to the charging part 218 by to be discussed mounting cover 212. In this case, the upper surface of the stem rubber locates below the ring part 216*a* of the base part.

The holder part 217 is formed so as to penetrate the base part in vertical direction and receives and holds the aerosol valve 15, like shown in FIG. 20*e*. The holder part 217 has an upper tubular portion 221, a lower tubular portion 222 which has smaller diameter than the upper tubular portion, an annular step portion 223 connecting the lower end of the upper tubular portion 221 and the upper end of the lower tubular portion, and a tubular sealing portion 224 extending upward (upper tubular portion 221 side) from the annular step portion. An annular groove portion 225 is formed between the upper tubular portion 221 and the sealing portion 224. The sealing portion 224 is composed of an upper part 224*a* of tubular shape, a lower part 224*b* of tubular shape in which the lower part 224*b* has smaller diameter, and a first tapered step part 224*c* connecting the upper part 224*a* and the lower part 224*b*. Further, the inside surface of the sealing part 224 and the lower tubular portion 222 are connected with a second tapered step portion 224*e* (annular step portion 223). An annular engaging portion 222*a* is formed on the lower part of the inner surface of the lower tubular portion 222 for engaging with the flange 207*a* formed on the lower end of the valve engaging portion 207 of the connecting member 205.

The aerosol valve 15 are inserted into the holder part 217 like shown in FIG. 19*b*, that is the upper part of the aerosol valve 15 are inserted into the upper tubular portion 221, and the lower part of the aerosol valve 15 is inserted into the lower tubular portion 222. On the other hand, the gasket 31 of the aerosol valve 15 engages with the first tapered step part 224*c* of the sealing portion 224 and seals the holder part 217. In this condition the flange part 207*a* formed on the lower end of the valve engaging part of the connecting member 205 meats with the annular engaging portion 222*a* of the lower tubular portion. Further, the lower periphery end of the cover 30 of the aerosol valve 15 is inserted into the annular groove portion 225.

The valve holder 211 is composed so that the upper surface of the cover 30 of the aerosol valve 15 is located slightly lower than the top of the ring part 216*a* of the base portion 216, in the state where the aerosol valve 15 is inserted in the valve holder 211.

The mounting cover 212 has a cover part 212*a* of tubular shape covering the aerosol valve 15 and the valve holder 211, and a fixing part 212*b* of tubular shape fixing the flange portion 103*a* of the valve holder 211 to the outer container 201, like shown in FIGS. 19*a, b, c*. The diameter of the fixing part 212*b* is larger than the diameter of the cover part 212*a*. The cover part 212*a* has four passing holes 212*e* on its upper base for passing or inserting the stem of aerosol valve, the stem for gas charging and the positioning protrusion. The cover part 212*a* is crimped so that the under surface of the upper base and the upper surface of the cover 30 of the aerosol valve, the under surface of the upper base and the upper surface 103*b* of the main body 103 of the base part around the positioning protrusion 38, and the under surface of the upper base and the upper surface of the stem rubber 219*b* of the charging part 218 are engages in a state with pressure. The cover part 212*a* has four recessed part 226 on the top surface. In this embodiment, four recessed part 225 of approximately isosceles triangle shape are formed, and it is configured so as the peak face the axis of the aerosol container 200. In other word, the ringed and crossed shape protruded part 212*f* is formed viewing from above of the mounting cover like shown in FIG. 19*a*. The fixing part 212*b* has an upper jaw portion 212*c* which contacts with the upper surface of the flange portion 103 of the valve holder, and a lower jaw portion 212*d* which is formed by crimping the lower end to the outer container side when fixing the valve assembly 203 to the outer container 201.

The aerosol container 200 has a mounting cover 212 provided with the recessed part 226, therefore it can secure the stem rubber 219*b* of the gas charging and it can obtain high sealing function. Further, it can also secure the aerosol valve to valve holder 211 and obtain high sealing function from the gasket 31. Moreover, the recessed part 226 has a rib effect for the mounting cover 212, where the strength against the inner pressure of the aerosol container 200 enhances. Resultantly, it prevent the expansion of the mounting cover 212, and prevent the lowering of the sealing function.

Figure 21:
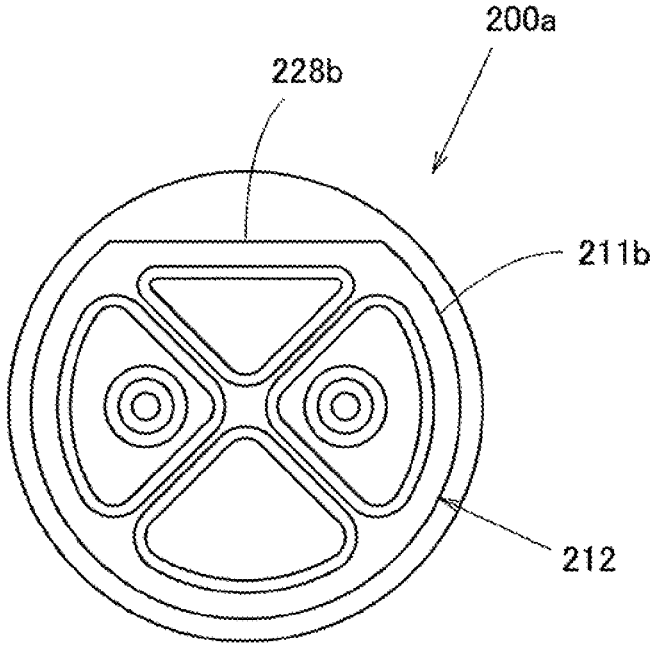
FIGS. 21*a, b* are a plan view and a side cross sectional view showing a part of other embodiment of the aerosol container of the present invention.
Figure 21:
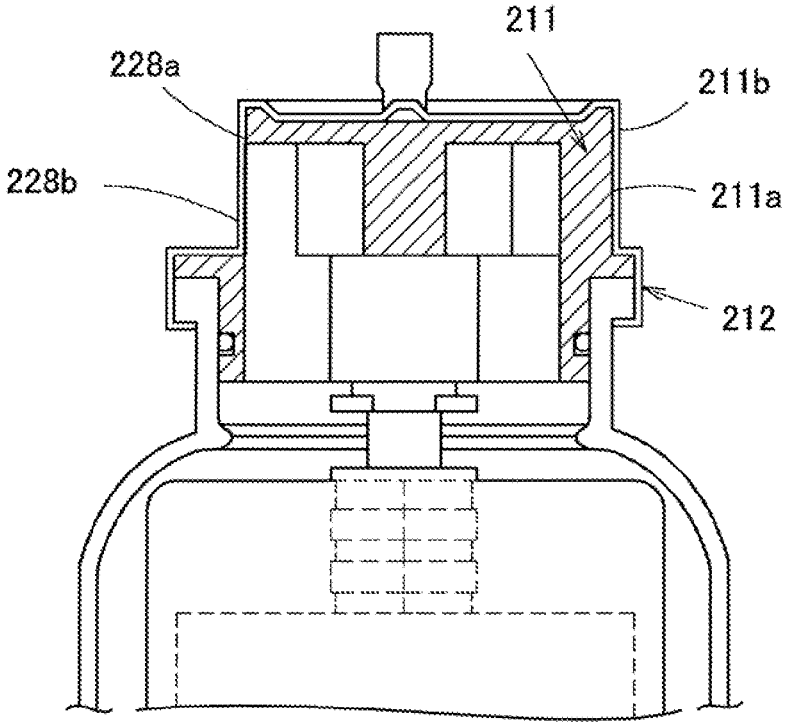

In the aerosol container 200*a* of FIG. 21, the plan cross sectional shape of the valve holder 211 and mounting cover 212*a* are notch circle. In other word, the lateral face 211*a* of the valve holder 211 and the cover part 211*b* of the mounting cover 212*a* has a notch surface 228*a* and 228*b*, respectively. The notch surface 228*b* of the mounting cover 212 is a position setting means and direction setting means of valve assembly and aerosol container, same as the aerosol container 43 of FIG. 6. The other configurations are substantially same as the aerosol container 200 of FIG. 19.

Figure 22:
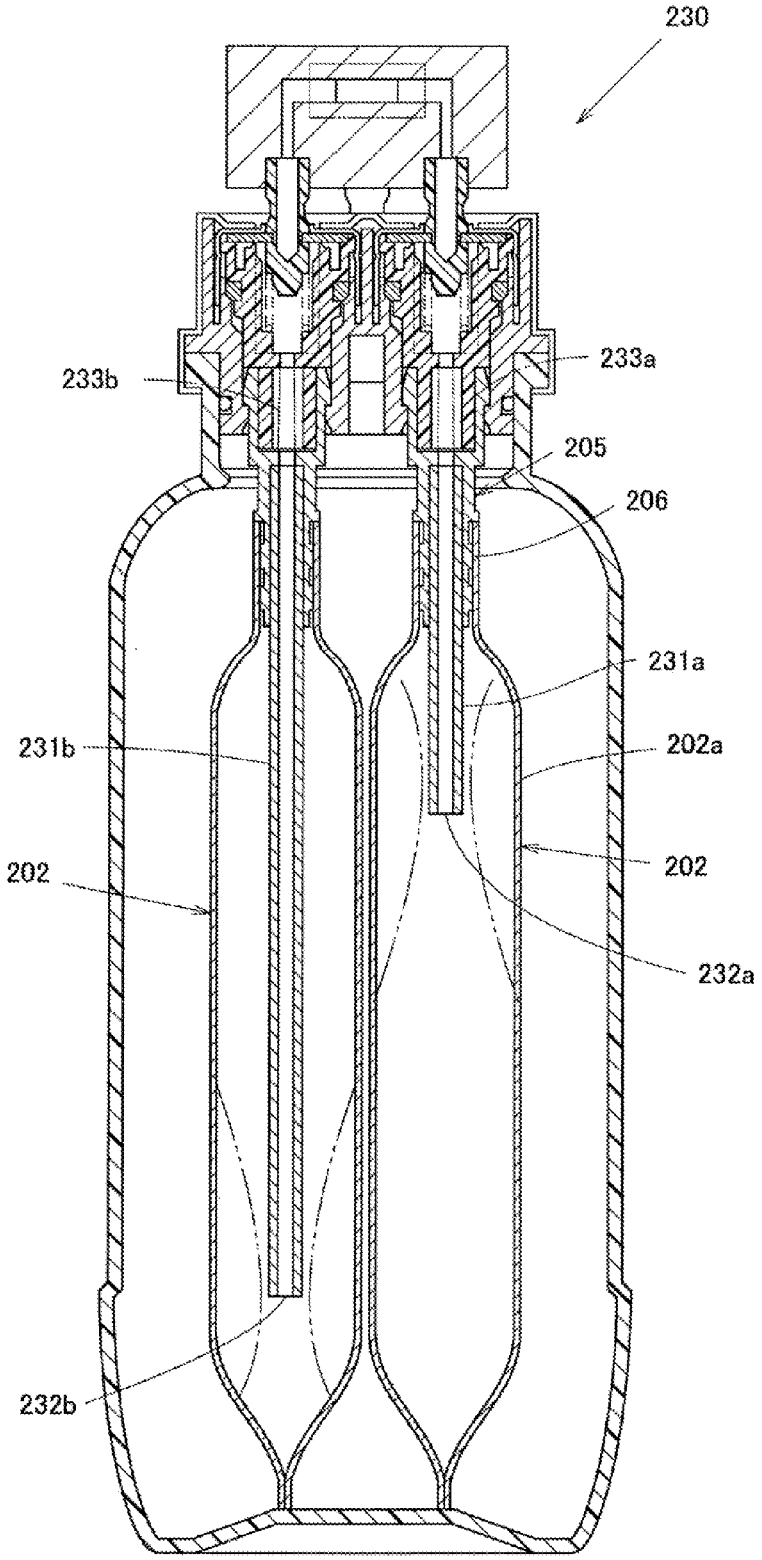
FIG. 22 A front cross sectional view showing the other embodiment of the aerosol container of the present invention.

The aerosol container 230 of FIG. 22 has a dipping tube 231*a, b* communicating housing 26 of the aerosol valve 15 and the pouch 202. Specifically, the top opening of the dipping tube 231*a, b* are inserted in the bonding part 206 of the connecting member 205. Further, the location of the bottom opening of the dipping tube 231*a*, 231*b* are configured to be different. The other configurations are substantially same as the aerosol container 200 of FIG. 19.

In this condition, the bag body 202*a* of the pouch 202 shrink (imaginary line) from the location where the lower end of dipping tube 231*a, b* are located. And because the lower end of the dipping tube 231*a, b*, the deformation of the pouch due to the discharging of the content can be controlled. That is the pouch 202 engaged with the shorter dipping tube 231*a* (location of the lower end opening is higher) deform from the upper side. On the other the pouch 202 engaged with the longer dipping tube 231*b* deform from the lower side. Therefore, the shape combining both pouches 202*a, b* will be approximately round column, and enable to discharge the content without residual. For example, it can prevent the folding of the pouch 202 when deforming the pouch 202, and enable to fully discharge the content.

In this embodiment, the top opening of the dipping tube 231*a, b* is located on the bonding part 206 of the connecting member 205, however the top opening 233*a, b* may be inserted inside the engaging portion 26*g* of the housing and have the dipping tube penetrate the connecting member 205. In this case, the penetration of the content through the connecting member 205 may be prevented and the contents can be stored more stably.

Further, the discharging amount (amount per unit of time) of the content may be controlled, by fixing the length of the dipping tube using the drag of the dipping tube. For the ratio of the discharging amount, when two liquid type hair dye are use, it is preferably to have the ratio of the first agent including colorant and the second agent including oxidant such as hydrogen peroxide, etc. to be 1:5 to 5:1, more preferably, 1:3 to 3:1.

Figure 23:
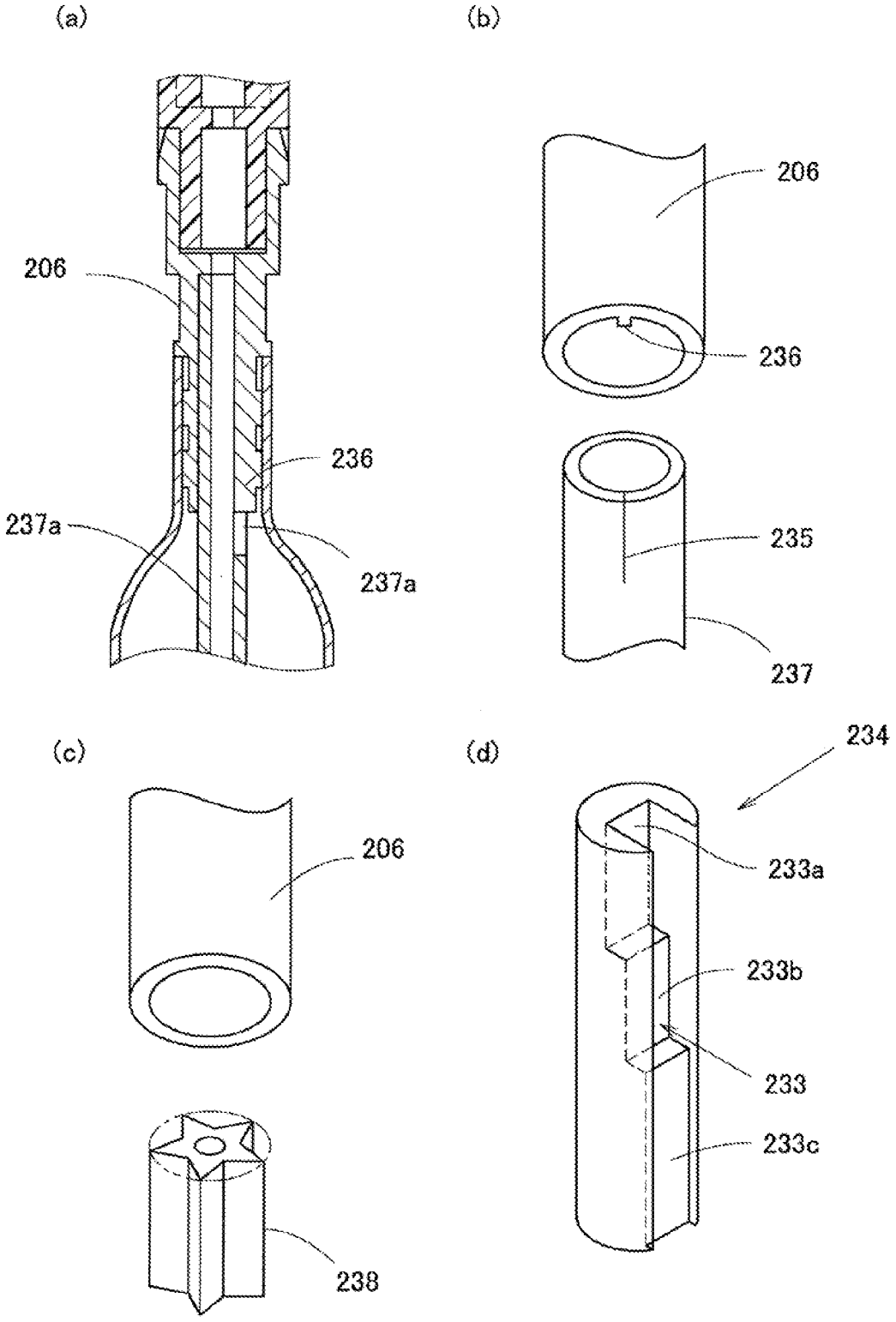
FIGS. 23 *a, b* are a front view, a cross sectional view showing the dipping tube which can be used to the aerosol container of the present invention, and, FIG. 23 *c* is a perspective view showing the other embodiment of the dipping tube, and FIG. 23 *d* is a perspective view showing the column member which can be used to the aerosol container of the present invention.

The disclosure of FIG. 23 shows the other embodiments of the dipping tube. The disclosure of FIG. 23*a, b* shows the condition where the dipping tube 237 is attached to the bonding part 296 of the connecting member 205, in which a protrusion 236 is formed on the inner surface extending in vertical direction. The dipping tube has a slit 235 or a breakage line in vertical direction from the top. Therefore, by inserting the dipping tube 237 into the bonding part 206 of the connecting member 205, the protrusion 236 split the slit 235 and forms a lateral opening 237*a* on the upper part of the dipping tube 237. This dipping tube 237 enables to further lessen the residual of the content by not only vacuuming the content from the bottom opening but also from the lateral opening.

The dipping tube 238 of FIG. 23*c* has a star cross sectional shape. This forms a clearance extending in vertical direction between the outer surface of the dipping tube 238 and the inner surface of the bonding 206 of the connecting member, which can also be used for the path of the content. In this case also, the content can be vacuumed from the bottom opening of the dipping tube 238 and the clearance between the dipping tube 238 and the bonding part 206 of the connecting member, and can lessen the residual.

The dipping tube of FIG. 23*d* is a column member 234 having a groove 233 extending in vertical direction on the lateral face. It is used to insert the upper end into the connecting member. The groove 233 is formed from the top to the bottom, and has a first groove 233*c* extending from bottom, a second groove 233*b* deeper than the first groove formed above of the first groove 233*c*, and a third groove 233*a* deeper than the second groove formed above of the second groove 233*b*. The depth of the groove is formed in staircase pattern getting deeper moving up. The existence of the groove secures the path for the contents, as the pouch shrinks. That is the discharging order of the content in the pouch can be controlled according to the depth and length of the second groove 233*b* and the third groove 233*a*. In other word, the shrinking process of the pouch may be controlled. The number of the groove is not limited and it is preferable to have 2 to 5 steps. It can only provide the first groove 233*c*. The discharge amount of two contents can be regulated by selecting the length and the depth of the groove according to the viscosity of the content.

Figure 20:
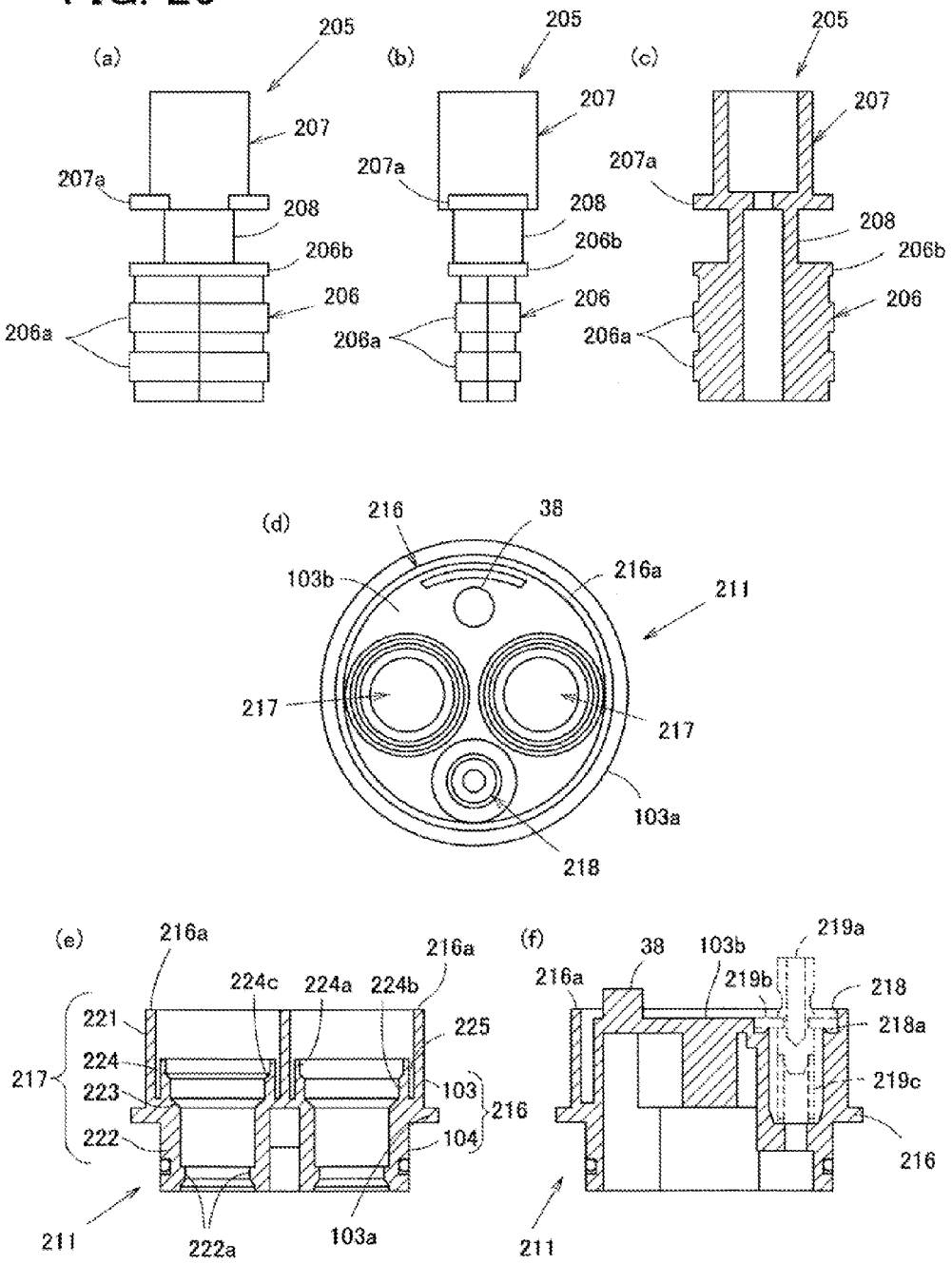
FIGS. 20 *a* to *c* are a front view, a side view, and a front cross sectional view showing the communicating member which can be used to the aerosol container of the present invention, and, FIGS. 20*d* to *f* are a plan view, front cross sectional view, and a side cross sectional view showing the a valve holder which can be used to the aerosol container of the present invention.
Figure 24:
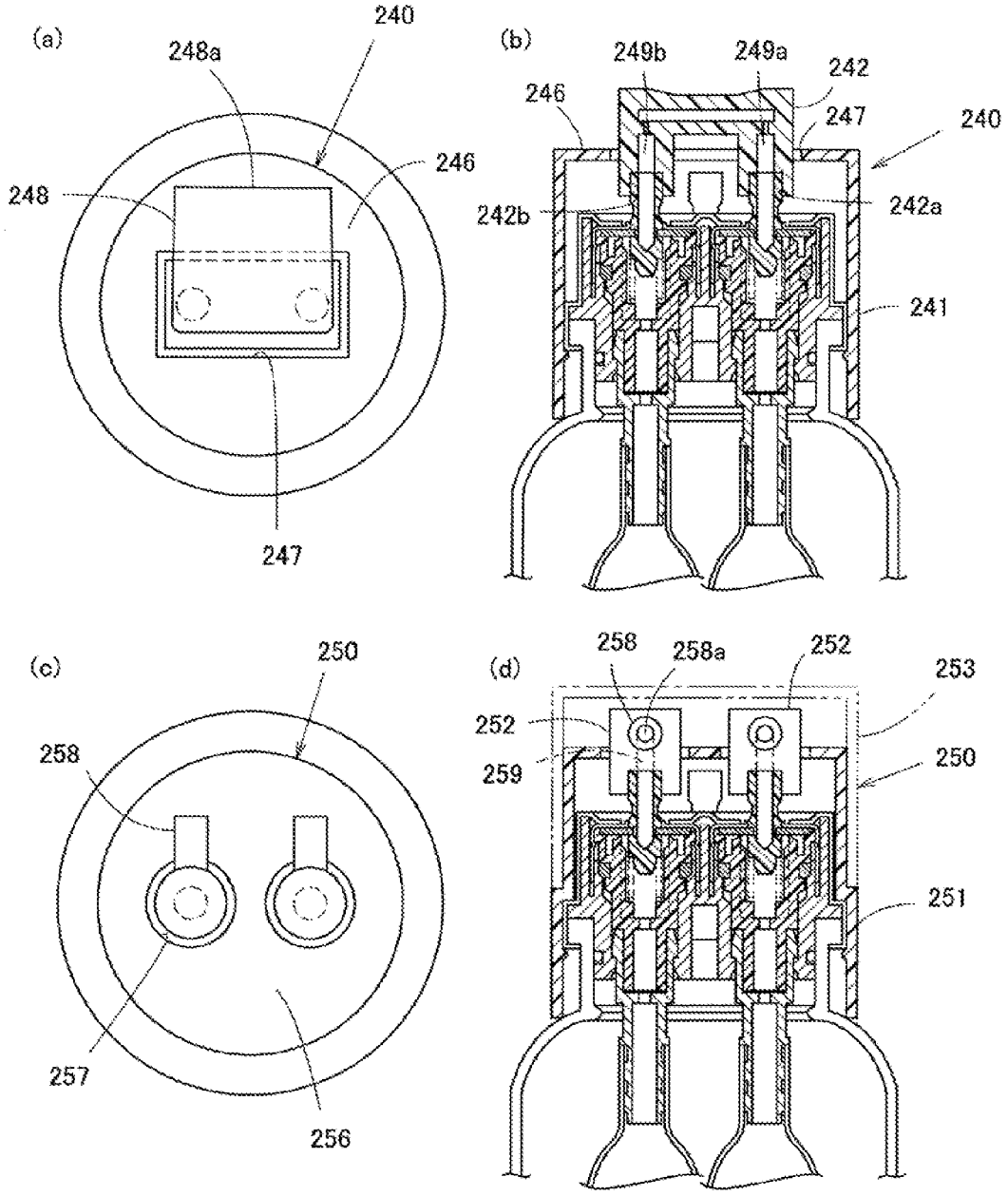
FIGS. 24*a, b* are a plan view and a cross sectional view showing the other embodiment of the discharging member which can be used to the aerosol container of the present invention, and FIGS. 24*c, d* are a plan view and a cross sectional view showing the other embodiment of the discharging member which can be used to the aerosol container of the present invention.

The disclosure of FIGS. 24*a, b* are that the discharging member 240, 250 are attached to the aerosol container 200 of FIG. 20.

The discharging member 240 has an attachment member 241 of tubular shape, and a handling member 242 inserted in the attachment member 241 movable in vertical direction.

The attachment member 241 is a tubular body having a upper base 246 covering the aerosol container 200, and the lower end engages with the fixing part of the mounting cover of the valve assembly. The passing hole 247 is formed on the upper base 246 for passing the handling member 242.

The handling member 242 has a stem engaging part 242*a, b* each engaging with the stem of the aerosol valve, a nozzle part 248 having a rectangular cross section shape of discharging hole 248*a* for discharging the content, and a interior path 249*a, b* communicating the discharging hole 248*a* and the stem engaging part 242*a, b*. The nozzle is protruded in front direction (front of FIG. 24).

Because the discharging hole 248*a* of the nozzle part 248 is protruded outward from the opening of the passing hole 247 of the attachment member 241, the residual which fall of from the discharging hole 248*a* will not infiltrate inside the discharging member 240. Therefore, mounting cover made of metal can be protected from the content.

The discharging member 250 has an attachment member 251 of tubular shape, two handling member 252 inserted in the attachment member 251 movable in vertical direction, and a protecting cover 253 attached to the attachment member 251 and covers the handling member 252.

The attachment member 251 is a tubular body having a upper base 256 covering the aerosol container 200, and the lower end engages with the fixing part of the mounting cover of the valve assembly. Two passing holes 252 are formed on the upper base 256 for passing the two handling member 252.

Each handling member 252 has a stem engaging part 252*a* engaging with the stem of the aerosol valve, a nozzle part 258 having a rectangular cross section shape of discharging hole 258*a* for discharging the content, and a interior path 259 communicating the discharging hole 258*a* and the stem engaging part 242*a*. The nozzle is protruded in front direction.

Because the discharging hole 258*a* of the nozzle part 258 is protruded outward from the opening of the passing hole 257 of the attachment member 251, the residual which fall of from the discharging hole 258*a* will not infiltrate inside the discharging member 250. Therefore, mounting cover made of metal can be protected from the content.

Figure 25:
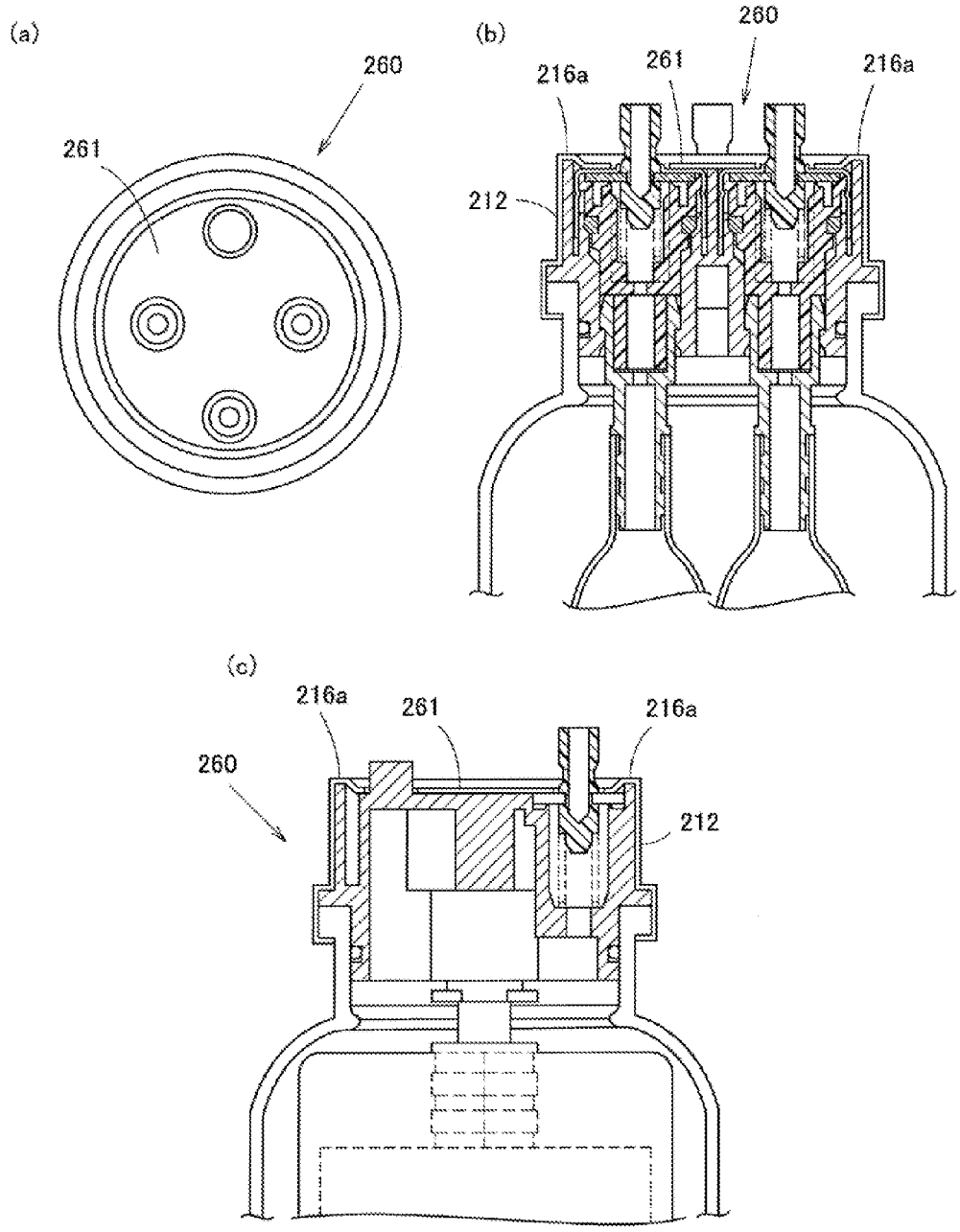
FIGS. 25*a* to *c* are a plan view, a front cross sectional view, and a side cross sectional view showing a part of other embodiment of the aerosol container of the present invention.
Figure 26:
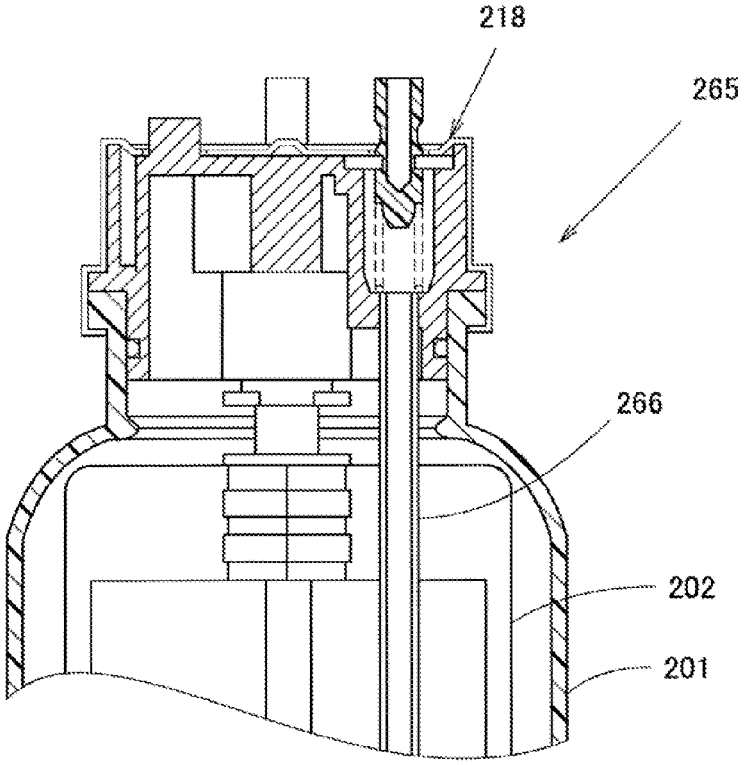
FIGS. 26*a, b* are a side cross sectional view, and a front cross sectional view showing a part of other embodiment of the aerosol container of the present invention.
Figure 26:
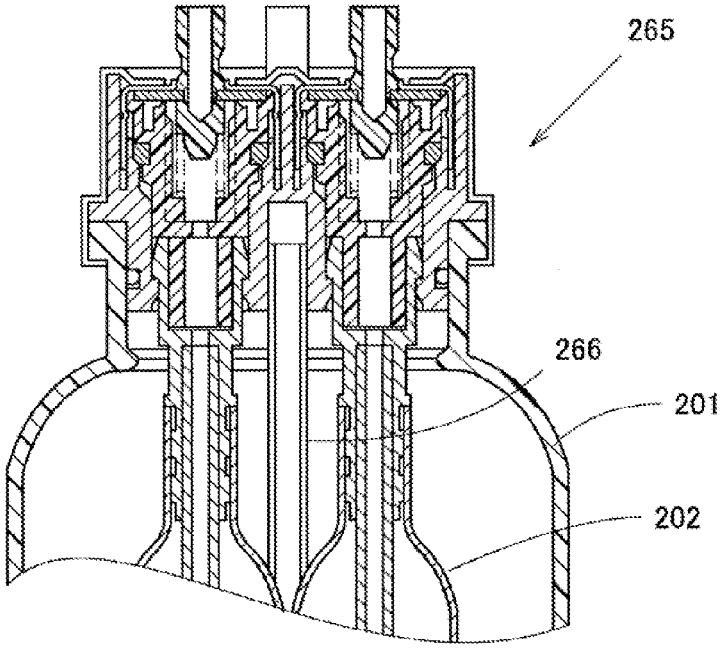

The aerosol container 260 of FIG. 25 is that the recessed part 261 is formed on the mounting cover 212 to fit with the shape of the base part 216. The other configurations are substantially same as the aerosol container 200 of FIG. 19. In this case also, the sealing function and the strength against the interior pressure is enhanced The aerosol container 265 of FIG. 26 has a dipping tube 266 on the lower end of the gas charging part 218. The other configurations are substantially same as the aerosol container 200 of FIG. 19. This dipping tube 266 is for discharging the third content charged in the space between the outer container and the pouch 202.

In this case, since the propellant is charged between the outer container 201 and the pouch 202, the dipping tube 266 is provided to vacuum only the third content from propellant and the third content.

This aerosol container can simultaneously discharge three contents.

Figure 27:
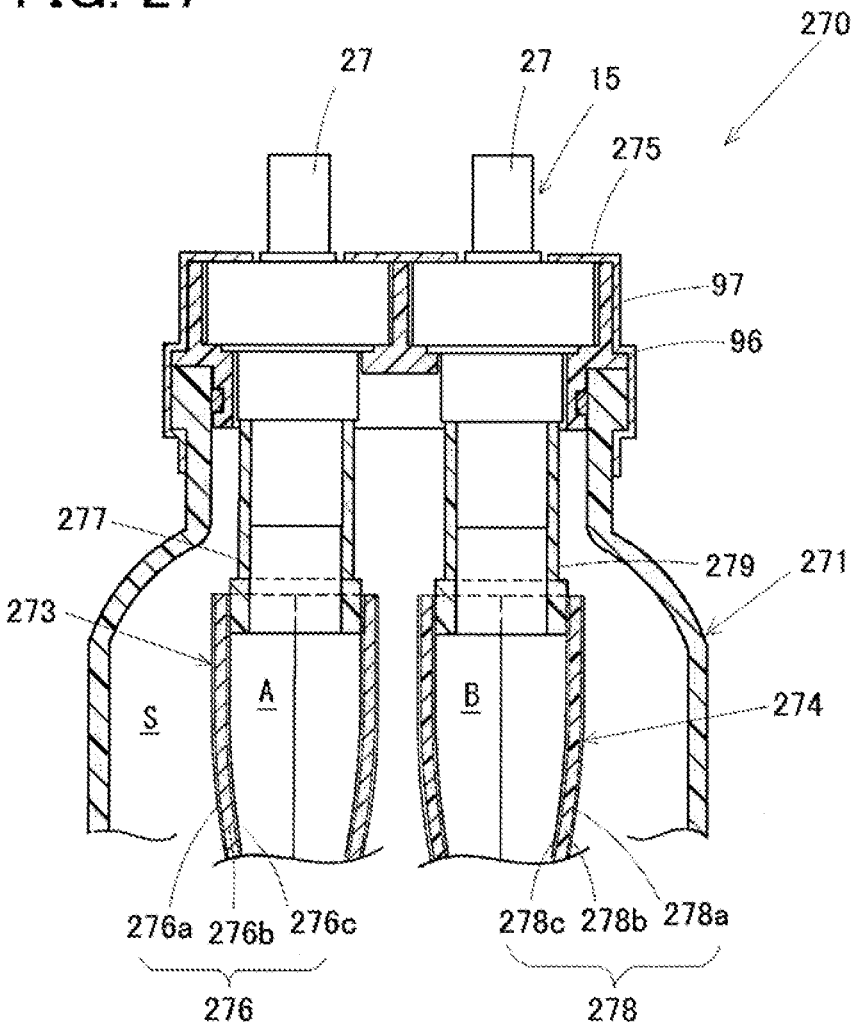
FIG. 27 A cross sectional view showing the other embodiment of the aerosol container of the present invention.

The aerosol container 270 of FIG. 27 is equipped with an outer container 271, a first inner container 273 and a second inner container 274 each having flexibility inserted in the outer container, and a valve assembly closing the outer container 271, the first inner container 273, and the second inner container 274. The first inner container 273 has inner layer made of synthetic resin, and a gas barrier layer made of metal foil provided on the outside of the inner layer. The second inner container 274 has a inner layer made of synthetic resin and a second gas barrier layer made of non metallic material provided on the outside of the inner layer. Therefore, the content charged in the second inner container will not infiltrate into the first inner container 273, in the case that the content charged in the second inner container 274 having weak gas barrier property penetrates the second inner container 274.

In this embodiment, the first inner container 273 and the second inner container 274 work as a content storage part, and the space between the outer container and two inner containers works as a propellant storage part. The outer container 27*a* is substantially same as the outer container 91 of FIG. 13 and is pressure resistant container made of synthetic resin. The valve assembly 275 is substantially same as the valve assembly 93 of FIG. 13 and has the aerosol valve 15, the valve holder 96, and the mounting cover 97.

The first inner container 273 is equipped with a first bag body 276 having a outer layer 276*a* made of synthetic resin, an intermediate layer 276*b* made of metallic foil, and an inner layer 276*c* made of synthetic resin; and a first connecting member 277 having tubular shape fixed to the opening of the first bag body 276. For the first bag body 276, pouch can be cited, in which is formed by overlapping two laminated sheets, each laminated sheet having the outer layer 276*a*, the intermediate layer 276*b*, and the inner layer 276*c* and flexibility, and then bonding or heating adhering the periphery. However, its manufacturing process is not limited. The first connecting member 277 is substantially same as the connecting member 49 of FIG. 7. However, the connecting member 277 may be omitted by directly bonding the opening of the first bag body 276 to the valve assembly 275.

For the synthetic resin used in the outer layer 276*a* and the inner layer 276*c*, polyolefin such as polyethylene (PE), polypropylene (PP) and etc, polyamide such as nylon (NY) and etc, and polyester such as polyethylene terephthalate (PET) and etc, can be cited.

For the metallic foil used in the intermediate layer 276*b*, light metal such as an aluminum foil and etc can be cited. For the gas barrier property of the intermediate layer, oxygen permeation rate of 0.5 ($cm^3/m^2/24$ h/atm) is preferred.

The combination of the outer layer 276*a*, the intermediate layer 276*b*, and the inner layer 276*c* of the first inner container 273 can be selected according to the ingredient of the content. For example, when the first agent of the two liquid type hair dye having alkaline property including the oxidation dye is used as the first content A1, the combination of PE/Al foil/PE, PP/Al foil/PE, PET/Al foil/PE, PE/Al foil/NY, PET/Al foil/NY in order of outer layer 276*a*/intermediate layer 276*b*/inner layer 276*c* can be cited. Further, the bag body 276 of the first container may have two layer structure omitting the outer layer 276*a*, and may have four or more layer structure having such like PE/PET/Al foil/PE, PET/PE/Al foil/PE using synthetic resin or a metallic foil arbitrarily.

Thus, because the first inner container 273 has an intermediate layer 276*b* at least made of metallic foil, the gas barrier property is high and prevent the penetration of the gas from the atmosphere and gas due to the leakage from the inside.

The second inner container 274 is equipped with a second bag body 278 having an outer layer 278*a* made of synthetic resin, an intermediate layer 278*b* made of non metallic material with gas barrier property, and an inner layer 278*c* made of synthetic resin; and a second connecting member 279 having tubular shape fixed to the opening of the first bag body 278. As for the bag body 278, the pouch manufactured by bonding laminated sheets having the outer layer 278*a*, the intermediate layer 278*b*, and the inner layer 278*c*, same as the first bag body 276, can be cited. However, the process is not limited. Further, the second connecting member 279 is substantially same as the first connecting member 277 (connecting member 49 of FIG. 7). In this case also, the second connecting member 279 may be omitted by directly engaging the opening of the second bag body 278 to the valve assembly 275.

For the synthetic resin used in the outer layer 278*a* and the inner layer 278*c*, polyolefin such as polyethylene (PE), polypropylene (PP) and etc, and polyester such as polyethylene terephthalate (PET) and etc, can be cited.

For the material used in the intermediate layer 278*b*, a synthetic resin layer having gas barrier property and chemical resistance property made of polyamide such as ethylene-vinyl alcohol copolymer (EVOH), nylone (NY), and etc; or a non metallic layer such as vapor-deposited layer in which the silica ($SiO_2$), alumina ($Al_2O_3$), carbon (C), or etc is vapor-deposited on the outer layer 278*a* or the inner layer 278*c* can be cited. The gas barrier property of the intermediate layer 278*b* is that under pressure of 0.2 to 1.0 MPa, it prevents the penetration of the water property of moisture or humidity and allows the gradual penetration of the gas such as oxygen and ammonia. The gradual penetration of the gas is to have oxygen permeation rate of 0.7 to 100 ($cm^3/m^2/24$ h/atm).

The combination of the outer layer 278*a*, the intermediate layer 278*b*, and the inner layer 286*c* of the second inner container 274 can be selected according to the ingredient of the content. For example, when the second agent of the two liquid type hair dye having acid property including the oxidant such as hydrogen peroxide and etc. is used as the second content A2, the combination of PE/EVOH/PE, PP/EVOH/PE, PET/EVOH/PE, PE/EVOH/PET, PE/NY/PE, PP/NY/PE, PET/NY/PE, PO/$SiO_2$/PE, PP/$SiO_2$/PE, PET/$SiO_2$/PE, PE/$Al_2O_3$/PE in order of outer layer 278*a*/intermediate layer 278*b*/inner layer 278*c* can be cited. Specifically, it is preferable to use synthetic resin layer as intermediate layer. Further, the bag body 278 of the second container may have two layer structure omitting the outer layer 278*a*, and may have four or more layer structure using synthetic resin or a metallic foil arbitrarily. Moreover, it is preferable to have the second inner container with transparent property when the outer container 271 is made with transparent property.

The product is manufactured by charging the first content A1 into the first inner container 273, charging the second content A2 into the second inner container 274, and charging the propellant into the space S formed between the outer container 271, and the first inner container 273 and the second inner container 274. Therefore, by operating (lowering) the discharging member attached to two stems 27 of the aerosol valve 15 of the valve assembly 276, the first inner container 273 and the atmosphere, and the second inner container 274 and the atmosphere communicates with each other. Then the pressure of the propellant presses the first inner container 273 and the second inner container 274, and the first content A1 and the second content A2 are discharged through the discharging member passing the stems 27 respectively.

For the first content and the second content, two liquid type hair dye or two liquid type permanent ingredients can be cited. Specifically, the two liquid type hair dye is composed of the first agent having alkaline property including the oxidation dye, and the second agent having acid property including oxidant such as hydrogen peroxide and etc.

As for the first agent of the two liquid type hair dye, the oxidation dye such as p-phenylene diamine, p-phenylene diamine sulfate, p-toluoylene diamine, N,N-bis(2-hydroxyether)-p-phenylene diamine, N-phenyl-p-phenylene diamine, diaminodiphenylamine, 2-chrolo-p-phenyldiamine, N,N-dimethyl-p-phenylene diamine, p-aminophenol, m-aminophenol, o-aminophenol may be used as active ingredients. Further, the ingredient selected from the alkaline agent such as formula having amino group like ammonia, monoethanolamin, triethanolamine, diisopropanolamine, 2-amino-2-methyl-1-propanol, potassium hydroxide, sodium hydroxide, potassium carbonate, calcium carbonate, potassium hydrogen carbonate; stabilizing agent; other active agent; surface acting agent; alcohol; oil agent and etc. may be mixed with solvent such as water. The pH of the agent is preferable to be set between 8 to 12, more preferable to be set between 9 to 11.

As for the second agent of the two liquid type hair dye, ingredient selected from oxidant such as hydrogen peroxide, stabilizing agent, other active element, surface acting agent, alcohol, oil component or etc. may be mixed with solvent such as water. The pH of the agent is preferable to be set between 2 to 6, more preferable to be set between 3 to 5.

The first agent and the second agent of the two liquid type hair dye may be charged either of the first inner container and the second inner container. However, in order to maintain the hair dye effect by preventing the penetration of the ammonia, and prevent the gas pile formed by the generation of the oxygen, it is preferable to charge the first agent into the first inner container, and charge the second agent into the second inner container.

As for the propellant, a compressed gas of nitrogen, compressed air, carbon dioxide, nitrogen monoxide, and etc, and liquid gas of liquid petroleum gas, hydro fluoro olefin, and etc. can be cited. The propellant maintain the interior pressure of the outer container under 0.1 to 0.8 MPa, and the first agent and the second agent are stored under pressured state.

The aerosol container 270 has high gas barrier property and can at least stably store the content charged in the first inner container 273 for long period of time, because, the first inner container 273 at least equipped with the intermediate layer made of metallic foil. On the other hand, in the case where the content which generates the oxygen by the autoproteolysis of the hydrogen peroxide or such, is charged in the second inner container, the formation of the gas pile in the second inner container due to the generated oxygen can be prevented. Because the second inner container is equipped with a non metallic gas barrier layer (intermediate layer 278*b*) which prevents the penetration of the water property of moisture or humidity and allows the gradual penetration of the gas such as oxygen and ammonia, and because the generated oxygen can be gradually released to the outside of the second inner container. Therefore, the prevention of the gas pile prevents the splash of the content when discharging, and the decreasing of the volume of the second inner container together with the discharging of the content is secured. Further, the oxygen released from the second inner container 274 is trapped in the space S, and is prevented from penetrating into the first inner container, because the first inner container 273 and the second inner container 274 are inserted in the outer container 271. Further, the remaining amount of the contents may be visually verified by providing the transparent property to the outer container 271 and the second inner container 274.

Figure 28:
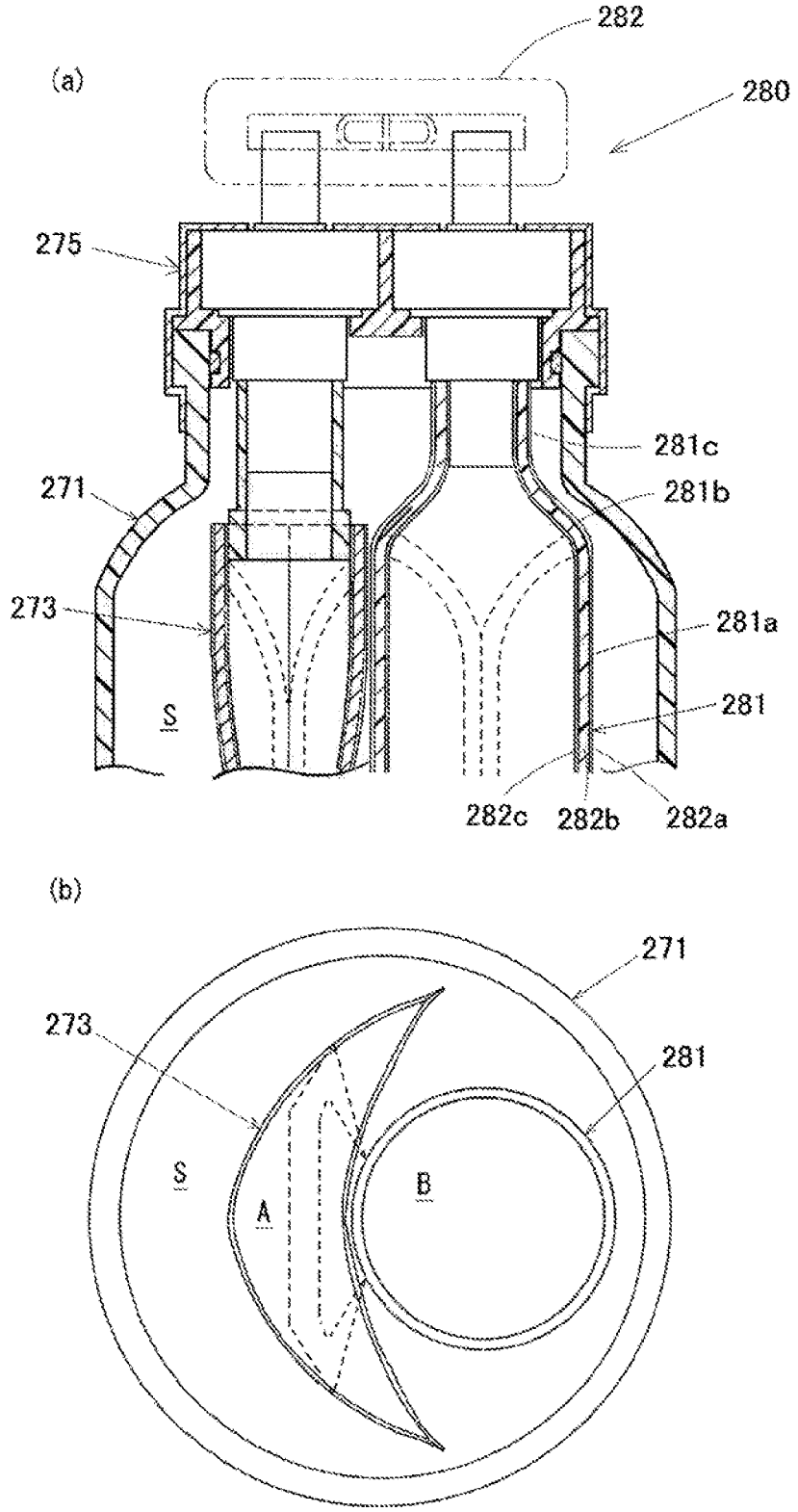
FIGS. 28*a, b* are front cross sectional view and plan sectional view showing a part of other embodiment of the aerosol container of the present invention.

The aerosol container 280 of FIG. 28 is different from the aerosol container 270 of FIG. 27 that it is equipped with a second inner container 281 integrally made having a bottomed cylindrical shape and having a barrel portion 281*a*, a shoulder portion 281*b*, and a neck portion 281*c*. The other configuration is substantially same as the aerosol container 270 of FIG. 27, and is equipped with the outer container 271, the first inner container 273, and the valve assembly 275. Further, the discharging member 282 discharging the contents which is served from each stem 27 of the aerosol valve 15, separately in parallel, is attached to the valve assembly 275. The dotted line of the first inner container 273 and the second inner container 281 of FIG. 28*a* shows the state before the first content and the second content are charged. The second inner container 281 is contracted by vacuuming the air outside.

The second inner container 281 has an outer layer 282*a* made of synthetic resin, an intermediate layer made of non metal having gas barrier property, and an inner layer 282*c* made of synthetic resin. Such a second inner container 281 is manufacture by forming a three layered parison with the extrusion molding, and by using the direct blow processing which the parison is inflated by blowing the air inside. The second inner container 281 has flexibility and contracts with the pressure of the propellant.

The shape of the second inner container 281 will be the same cylindrical even if the second content is charged after the second inner container is contracted by vacuuming the air inside, because the second inner container is a flexible cylindrical container manufactured by blow processing. On the other hand, the shape of the first inner container will not be stabled in the regulated space of inside of the outer container, though the first inner container inflate in planular shape when the first content is charged, after the first inner container is stored in the outer container in folded state. Therefore, by adopting the second inner container 281 formed by blow processing, the first inner container 273 meats with the second inner container 281 like shown in FIG. 28*b* and the shape after the charging of the contents is stabilize. Further, the first inner container 273 may be arranged to wrap the second inner container 281. The combination of these inner containers can effectively use the inner space of the outer container 271, and can increase the charging amount of both contents. In this embodiment, the second inner container 281 is vacuumed after the insertion of the second inner container 281 into the outer container 271, however, because the second inner container forms predetermined shape of cylinder by charging the second content, the shape of the first inner container and the second inner container after the charging of the contents will be stable. Moreover, to further enhance the effectively use of the inner space of the outer container, the center (axis) of the neck portion 281*c* and the center (axis) of the barrel portion 281*a* may be stirred. That is, it may be configured so that the center (axis) of the barrel portion 281*a* is shifted more to the center (axis) of the outer container 271 than the center (axis) of the neck portion 281*c*.

The aerosol container 280 also can prevent the penetration of the oxygen penetrated to the space S from the second inner container to the first inner container, and can prevent the gas pile formed in the second inner container, because, the first inner container 273 and the second inner container 281 is stored in the outer container 271. Therefore, it can prevent the splash of the content, and the volume of the inner container decreases along with the discharge of the content, and the remaining amount of the contents may be checked when the outer container is transmissive.

Figure 29:
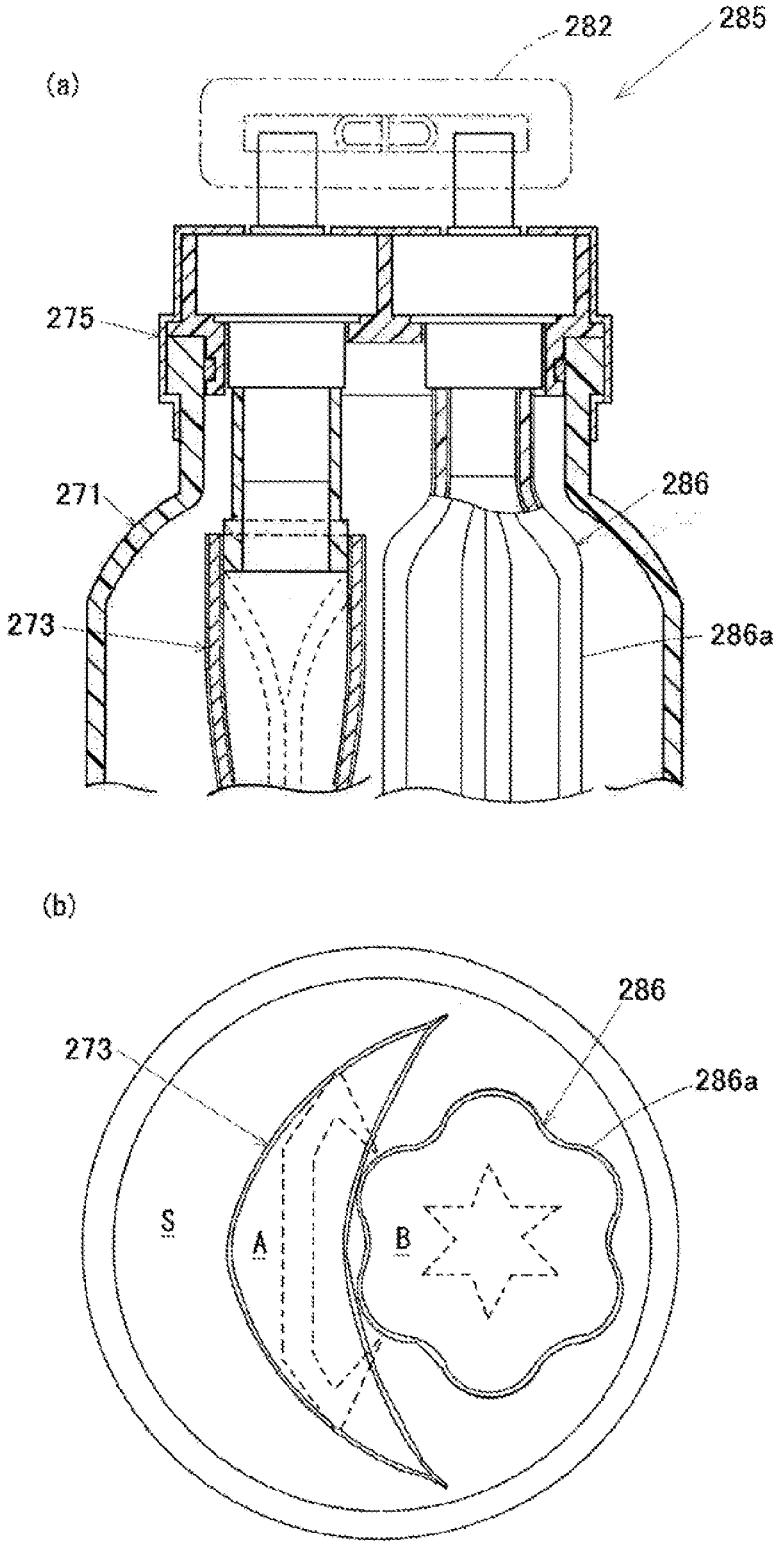
FIGS. 29*a, b* are and a front cross sectional view, and a side cross sectional view showing a part of other embodiment of the aerosol container of the present invention.

The aerosol container 285 of FIG. 29 is equipped with a second inner container 286 where the barrel portion 286*a* has a pleated part. The other configuration is substantially same as the aerosol container 280 of FIG. 28.

By adopting the pleat part, the transformation of the volume before and after the charging of the content can be made large, and the shape of the expanded state and the contracted state is stable. Therefore, the use of the space in the outer container by two inner containers will be further effective.

In this case also, the penetration of the oxygen penetrated to the space S from the second inner container to the first inner container, and formation of the gas pile in the second inner container can be prevented.

The aerosol product 290 of FIG. 30 to 36 is configured so that the remaining amount of the content is visually noticeable. The outer container has an outer window portion of transmissive at least on a part, so that the inside of the outer container is viewable. Further, it has a sign which indicates the remaining amount.

Figure 30:
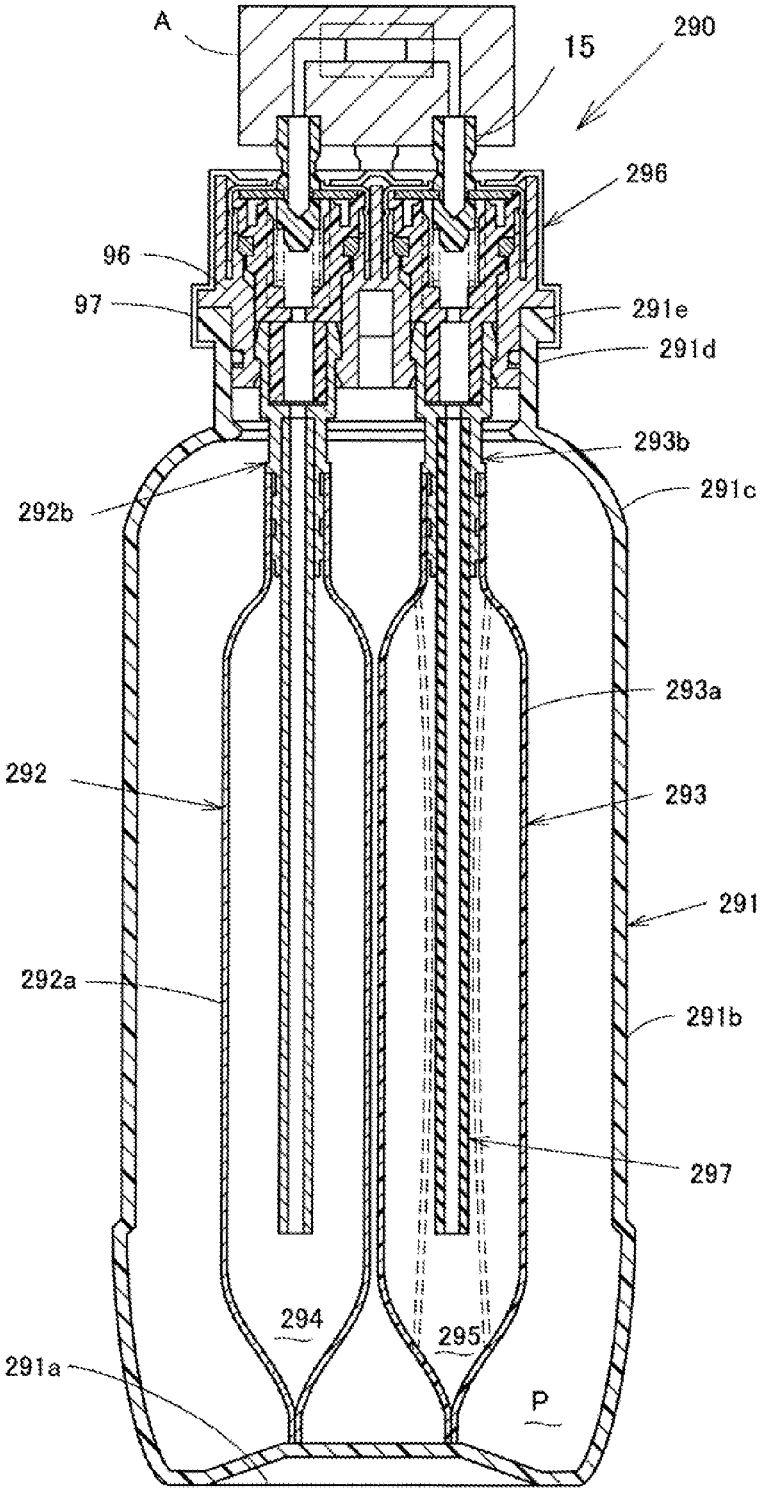
FIG. 30 A front cross sectional view showing the other embodiment of the aerosol container of the present invention.

The aerosol product 290 of FIG. 30 is equipped with an outer container 291 having transparency, a first pouch 292 and the second pouch 293 housed in the outer container, a first content 294 and a second content 295 charged in pouches, a valve assembly closing both outer container 291 and pouches, and a propellant P charged between the outer container 291 and pouches. In this embodiment, the first pouch is not transmissive and the second pouch is transmissive. Further, the dipping tube having a different color to the color of the content is attached between the valve assembly 296 and the second pouch 293. Moreover, the discharging member A discharging two contents simultaneously is attached to the valve assembly 296. In this embodiment, the first pouch 292 and the second pouch 293 work as the content storage part and the space between the outer container and pouches work as the propellant storage part.

The outer container 291 is substantially same as the outer container 91 of FIG. 13, and is pressure resistant container made of synthetic resin. The valve assembly 296 is substantially same valve assembly 93 of FIG. 13, and has aerosol valve 15, valve holder 96, and mounting cover 97.

In this embodiment, the whole of the outer container 291 is transmissive, therefore whole correspond to the outer window portion. However, because the valve assembly 296 is attached to the flange portion 291*e* or the neck portion 291*e*, the part from the bottom portion 291*a* to the shoulder portion 291*c* works as the outer window portion. Therefore, it is acceptable if at least one part of region from the bottom portion 291*a* to the shoulder portion 291*d* is transmissive, when the outer surface of the outer container is formed with printed matter, or is covered with a film or mark. The size and location of the outer window will not be limited, as long as it can see the second pouch from outside, such as hovering the outer window on the second pouch 293. Especially, the aerosol product 290 of FIG. 30 has two pouches aligned, therefore it is necessary not to locate outer window where the second pouch 293 can not be seen due to the shadow of the first pouch 292.

The first pouch 292 is equipped with a bag body 292*a* manufactured by bonding two sheet which is not transmissive, and a connecting member 292*b* engaged with the opening of the bag body.

The second pouch 293 is equipped with a bag body 293*a* manufactured by bonding two sheet with transparency, and a connecting member 293*b* engaged with the opening of the bag body. In this embodiment, the whole of the bag body 293*a* is transmissive, the whole of the bag body 293*a* works as inner window. However, the bag body 293*a* of the second pouch 293 only needs to have a part of transmissive part. More specifically, the part which contact with the dipping tube 297 has a transparency, when predetermined amount of the content is being discharged. The material used for the first pouch and the second pouch is that if it satisfies the transmissive property, the other is substantially same as pouch 46 of FIG. 7.

The first content 294 is not limited, because it is charged into the first inner container. On the other hand the second content 295 is opaque. For such a first content 294 and the second content 295, two liquid type reaction agent such as two liquid type hair dye or two liquid type permanent ingredients in which the effects are obtained by blending can be cited.

In the aerosol product 290, the first pouch 292 and the second pouch 293 are filled with first content 294 and the second content 295, respectively, before the use. Therefore only the second content 295 of opacity can be seen from the inner window portion.

The first content 294 and the second content 295 are simultaneously discharged by lowering the discharging member opening both aerosol valve 15. Because the aerosol product 290 is objected to discharge two contents simultaneously, it is not necessary to check the remaining amount of the first pouch 292 as long as the remaining amount of the second pouch 293 can be verified. Therefore, only the description of the second pouch will be mentioned from now on.

The second pouch 293 is contracted as the both end of the side wall contact with each other, like if the second pouch 293 clip or nip the dipping tube 297, when the second content 295 is discharged form the second pouch 293 (see imaginary line of FIG. 30). The both end of the side wall contacts with the dipping tube 297 just the same time or just before the both end of the side wall meats with each other. Therefore, the second content 295 which had been blocking the inner window is dic295harged outside, and the dipping tube mating with the second pouch 293 can be seen from the inner window. And because the dipping tube 297 is colored differently with the second content, different color will be sighted in the inner window. Further, because the second pouch 293 itself is transparent, the first pouch 292 can be seen from the inner window, when the both end of the side wall contacts with each other. In this embodiment, the dipping tube 297 and the first pouch 292 function as the sign. However, the sign may be either one.

In order to functions the first pouch 292 as a sign, the inner window must be configured to sight the first pouch 292 through the second pouch 293. On the other hand, in order to function the dipping tube 297 as the sign, the inner window must be configured according to the dipping tube 297 inserted in the bag body 293*a*. Specifically, because the dipping tube 297 is inserted along with the axis of the bag body 293*a*, it is preferable to have the inner window formed in the center of the width direction extending vertically. In this case, the inner window may not have to be provided in the both end of the side wall 293*c*, as long as the part of the side wall 293*c* facing the outer container is formed as a inner window.

Figure 31:
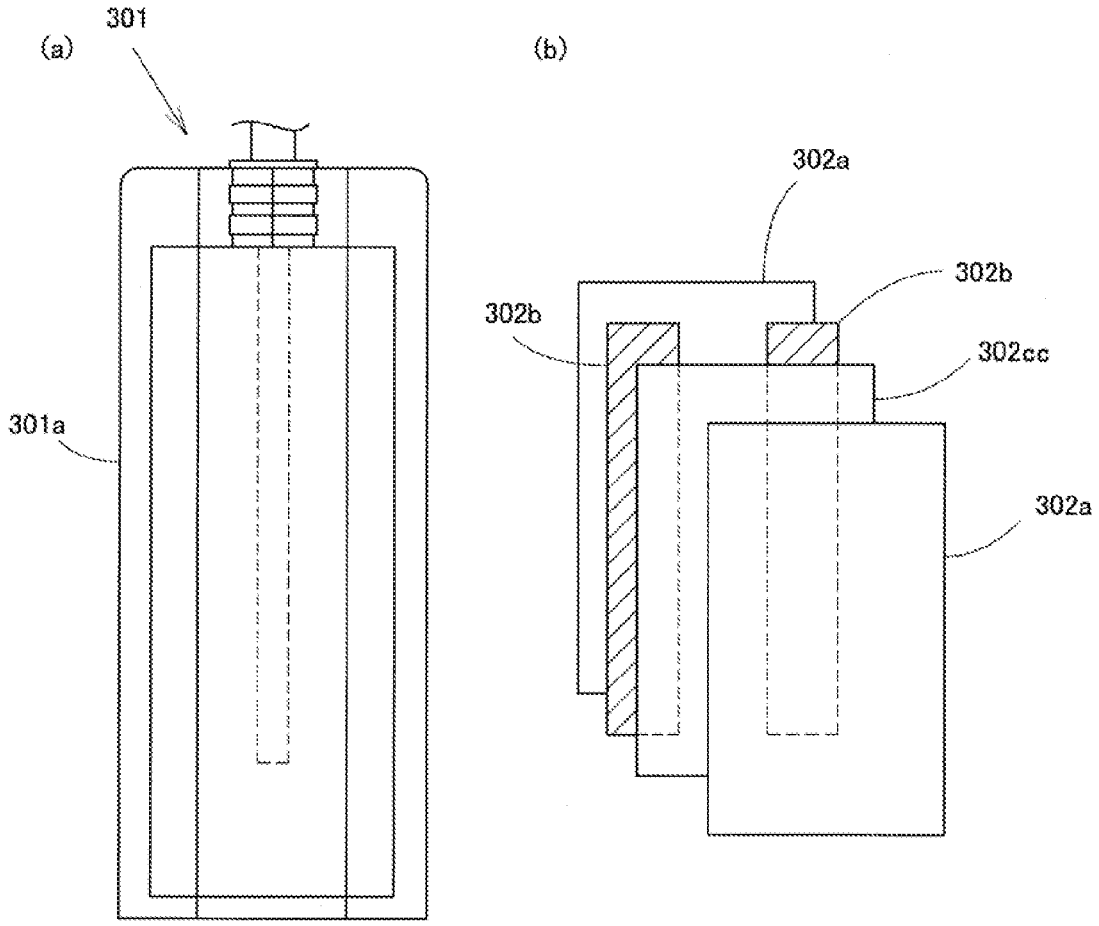
FIGS. 31*a, b* are a pouch which can be used to the aerosol container of the present invention.
Figure 32:
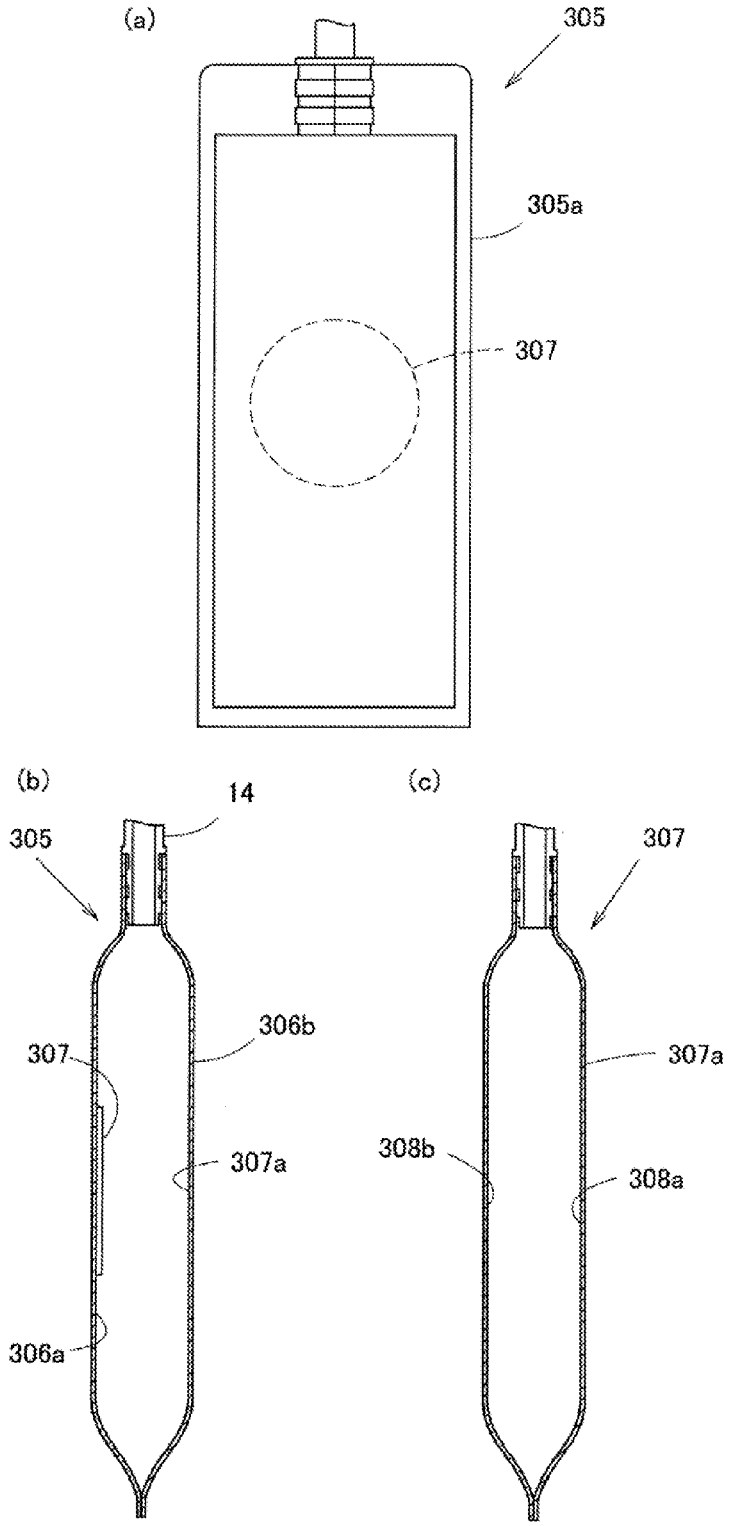
FIGS. 32 *a, b* are a front view and a side cross sectional view showing the pouch of the FIG. 30.

The second pouch 301 which can be used as the second pouch 293 of FIG. 30 is shown in FIG. 31. The inner window of the second pouch 301 is formed on the middle of the bag body 301*a* in the width direction extending vertically. The bag body 301*a* is composed of two transparent synthetic sheets 302*a* having high chemical resistancy located on the exterior surface (such as PE, PET) and the interior surface, a transparent synthetic sheet 302*c* (such as EVOH, NY) having a high gas barrier property located inside of the exterior surface, a metallic sheet 302*b* (such as aluminum foil) located between the interior synthetic sheet 302*a* and the synthetic sheet 302*c*. It is manufactured by, sandwiching the metallic sheet 302*b* having a hole in the middle by the transparent synthetic resin sheets. In this case also, when the second pouch 301 is contracted to the predetermined shape (just before the side wall mates with each other), the first pouch 292 and the dipping tube 297 located along the axis of the bag badoy 391*a* functions as the sign, because the back of the second pouch 301 can be sighted. The transmissive rate of the second pouch may be controlled by the area of the metal sheet, for example the oxygen generated by the self decomposition of hydrogen peroxide in the second agent of the hair dye can be drained from the second pouch, in order to prevent the expansion of the second pouch, and the accurate confirmation of the remaining amount can be visually obtained.

FIGS. 32*a, b* shows the second pouch 305 which can be used as the second pouch 293 of FIG. 31. The second pouch 305 has a mark 307 of printings, seals, or etc is attached to inner surface of the one side of a side wall 306*a* of a bag body 305*a*. And an inner window is formed on the other side (the one which face the outer container) of a side wall 306*b*. In this FIG. 32*a*, the whole of the side wall 306*a* is made to be transmissive, and whole of the side wall 306*a* is constructed as the inner window. However, the inner window may be formed on the part of the side wall 306*b* if it is configured so that the mark 307 is seen when the second pouch 305 shrunk to predetermined volume (just when the both side wall 306*a, b* overlap with each other). The side wall 306*a* may be formed in transmissive, or in opacity. However, it is preferable to be formed in opacity. Further, the mark 307 may be formed on the outer surface if the first pouch 292 or the inner surface of the outer container 291.

The second pouch 307 of FIG. 32*c* is that the side wall 308*a* of the bag body 307*a* is made to be in transmissive, and side wall 308*b* is made to be in opacity. Therefore, the side wall 308*b* can be seen from the side wall 308*a* when the second pouch 307 is shrunk to predetermined volume (just when the both side wall 308*a, b* overlap with each other). Thus, the side wall 308*b* serves as the sign. In this case also, at least the part of the side wall 308*a* is required to be transmissive.

Figure 33:
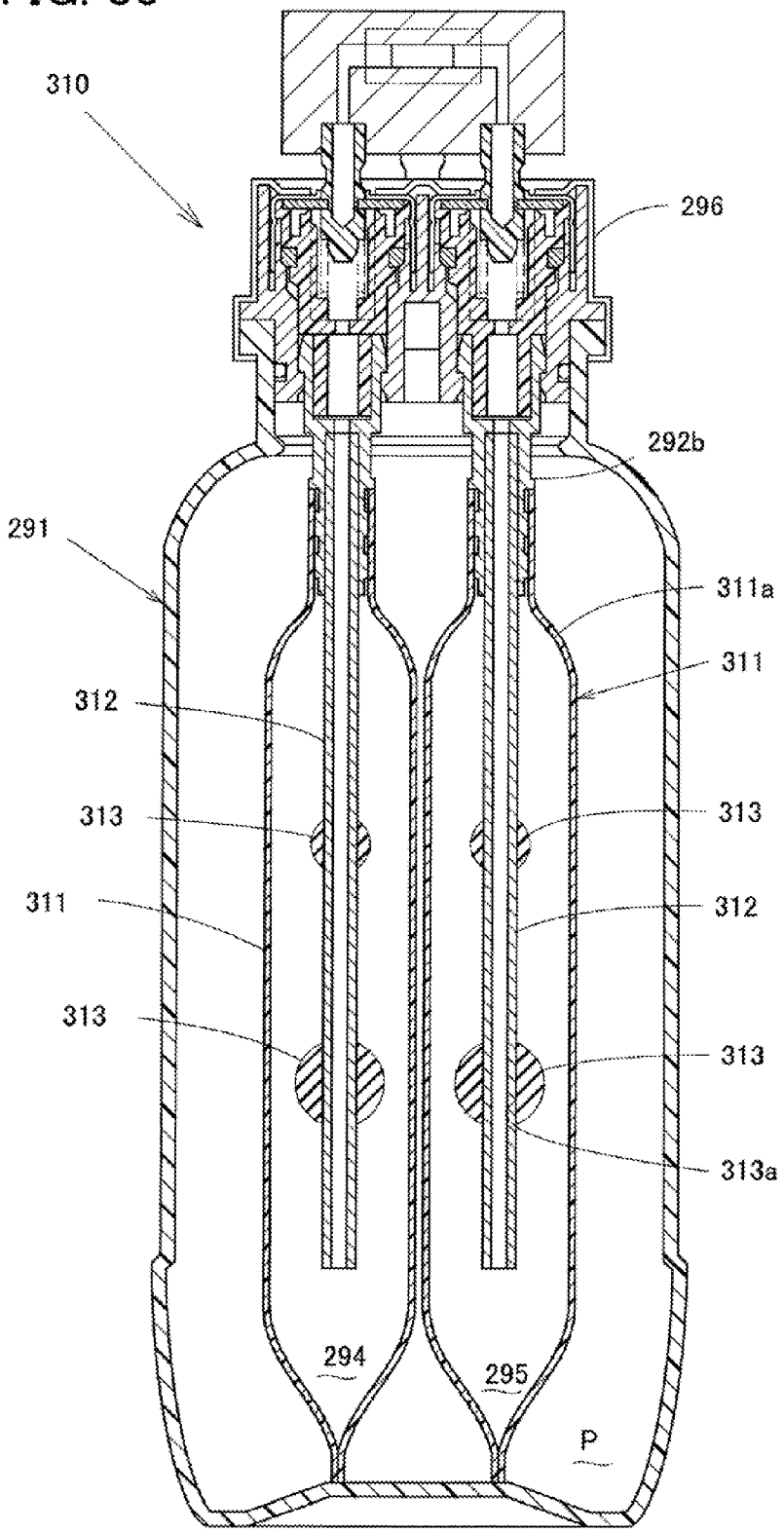
FIG. 33 A front cross sectional view showing the other embodiment of the aerosol container of the present invention.

The aerosol product 310 of FIG. 33 is equipped with an outer container 291 having transmissivity, two pouches 311 stored in the outer container, a first content 294 and a second content 295 each charged in different pouch, a valve assembly 296 closing the outer container 291 and both pouches, and a propellant P charged in a space between the outer container 291, and pouches. Further, the dipping tube 312 is provided between the pouch 311 and the valve assembly 296. The sign body 313 is provided on the outer surface of the dipping tube 312. The outer container 291, the first content 294, the second content 295, the valve assembly 296, and the propellant P are substantially same as those of the aerosol product 290 of FIG. 30.

Further, the discharging member A of FIG. 1 is attached to the valve assembly 296 for operating the aerosol product 310.

The pouch 311 is composed of a bag body 311*a* formed by bonding two sheets, and a connecting member 292*b* fixed on the opening of the pouch 311. The connecting member 292*b* is substantially same as the connecting 2902*b* of FIG. 30. The bag body 311 may be transmissive or nontransmissive. However, it is preferable to visually confirm the deformation of the pouch by forming the bag body 311 in nontransmissive.

The dipping tube 312 has a tubular body, it may also be transmissive or nontransmissive.

The sign body 313 is a spherical body having a center hole 313*a* penetrating the body. The dipping tube 312 is inserted in the center hole 313*a*. In this embodiment, two sign body 313 is provided on the dipping tube aligned in vertical direction. Further, the sign body 313 may be circular plate having a center hole, it is not limited as long as it is a body of rotation having the center hole which is paralleled to the rotating axis.

Figure 34:
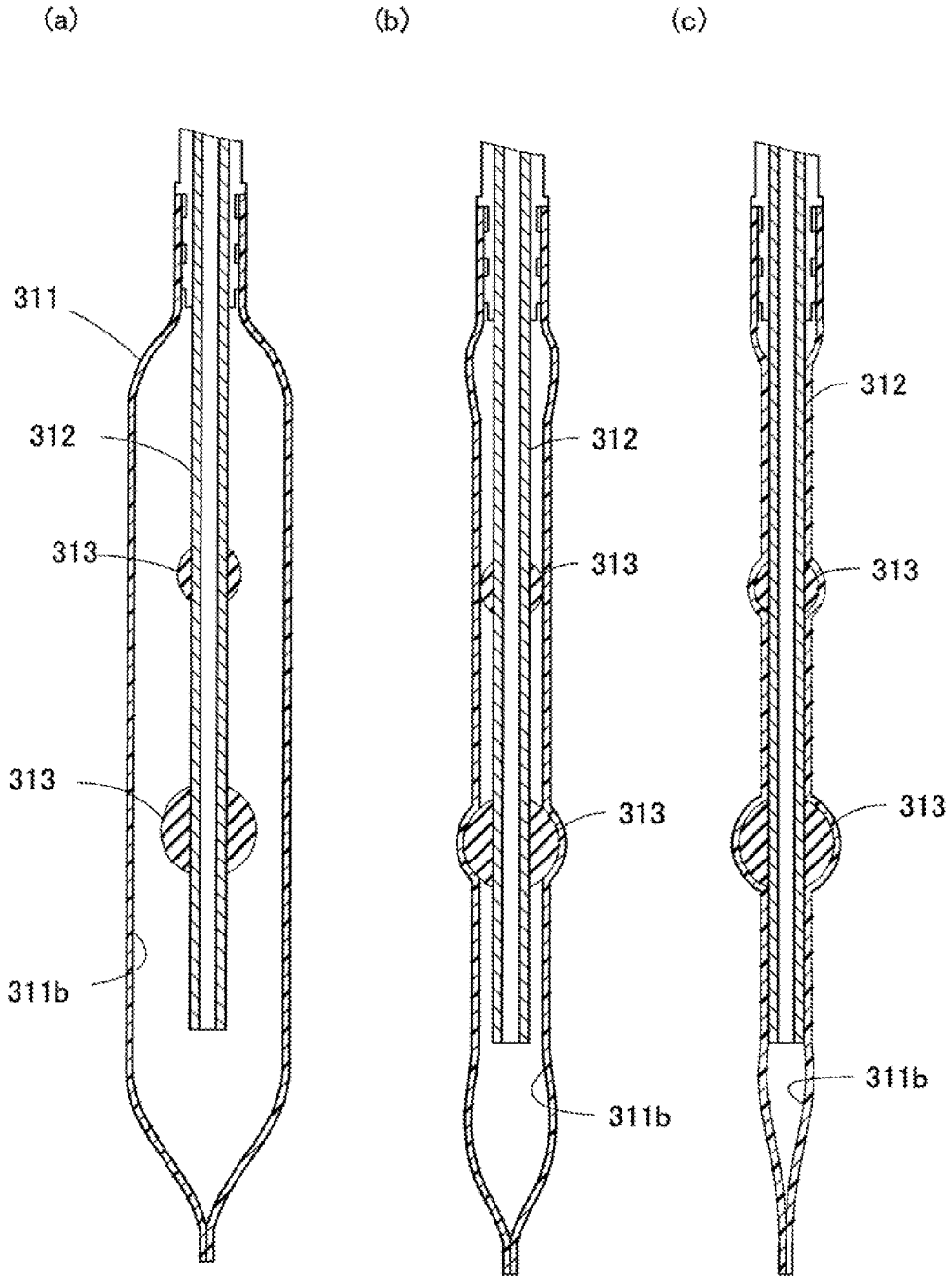
FIGS. 34 *a* to *c* are a side cross sectional view of the pouch of FIG. 33 showing the process of shrinking.

The aerosol product 310 is configured so that the flattened side wall 311*b* extends in the vertical direction, when the pouches 311 before use are filled with the first content 294 and the second content 295, respectively (see FIG. 34). On the other hand, the side wall 311*b* contacts with the sign body 313 and the protrusion part appears on the shrunken pouch 311, when the content is discharged and the pouch is shrunk into first predetermined volume (see, FIG. 34*b*). Further, the side wall 311*b* contacts with the small sign body 313 and two large and small protrusions appear on the shrunken pouch 311, when the content is further discharged and the pouch is shrunk into second predetermined volume (see, FIG. 34*c*). The deformation of the pouch according to two sign body 313 is a sign in this embodiment. In this case, the remaining amount of the content can be noticed in detail, by using different size of the sign bodies.

In this embodiment, the sign body 313 was provided in both pouch 311, however, it may be provided in only one pouch. The remaining amount of both contents may be noticed by having sign body 313 on both pouch 313, and may confirm that the discharging amount of both contents is same.

Figure 35:
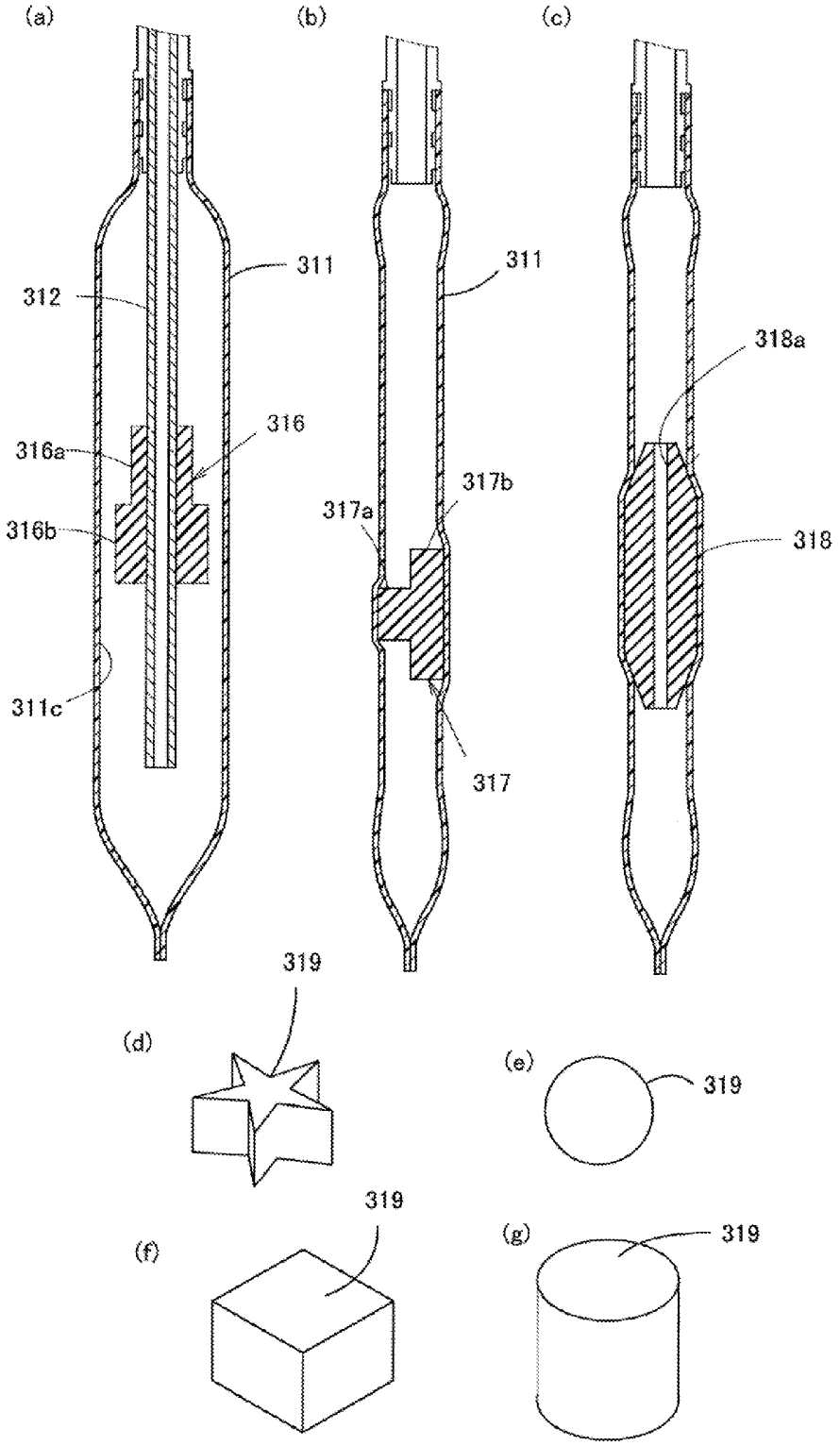
FIGS. 35*a* to *c* are a pouch and sign body which can be used to the aerosol container of the present invention and FIGS. 35 *d* to *g* are a perspective view showing the other embodiment of the sign body.

FIG. 35 discloses the sign body which can be used for the double aerosol product 310.

The sign body 316 of FIG. 35*a* is an integral rotating body in which the dipping tube 312 is inserted. The sign body 316 is composed of an upper tubular part 316*a* and a lower tubular body part 316*b* having lager diameter than the upper tubular part. In this case also, the one protruding portion is formed due to the contact of the lower tubular body 316*b* with the side wall 311*c* when the pouch 311 is shrunken, and the other protruding portion is formed due to the contact of the upper tubular body 316*a* with the side wall 311*c* when the pouch 311 is further shrunken. Therefore, same effect can be seen as FIG. 33.

The sign body 317 of FIG. 35*b* is an integral member having same outer shape of the sign body 316 of FIG. 35*a*. The sign body 317 is composed of an upper column part 317*a* and a lower column part 317*b* having lager diameter than the upper column part. The sign body 316 of this embodiment is not for attaching to the dipping tube but for inserting into the pouch. In this case, the sign body 317 behaves as the flattened part to be parallel to vertical direction, when the pouch 311 is shrunken. In other word, because the height of the sign body 317 is smaller than the diameter of the lower column part 371*b*, the sing body 317 receives the pressure of the side wall 311*c* of the pouch facing side. Therefore, the protruding portion is formed due to the contacting of the sign body 317 with the side wall 311*c* when the pouch 311 is shrunken. The shape of the pouch can be changed according to the shrinkage of the pouch by inserting the sign body 317, therefore the providing of the content to the aerosol valve is easy.

The sign body 318 of FIG. 35*c* have ellipse shape cross section and the center hole 318*a* is provided along the long axis. This sign body also is not for attaching to the dipping tube but for inserting into the pouch. Therefore, the protruding portion is formed due to the contact of the sign body 318 with the side wall 311*c* when the pouch 311 is shrunken. Further, because center hole 318*a* formed on the sign body 318, the sign body 318 also has the effect of the dipping tube.

The sign body 319 of FIG. 35*d* to *g* is composed of several sign body having different shape. The remaining amount may be recognized according to the shape of the protruding portion formed on the pouch.

The disclosures of FIG. 36 to 42 shows the manufacturing method of the aerosol product which can effectively load the contents into the storage part formed in the aerosol container.

Figure 36:
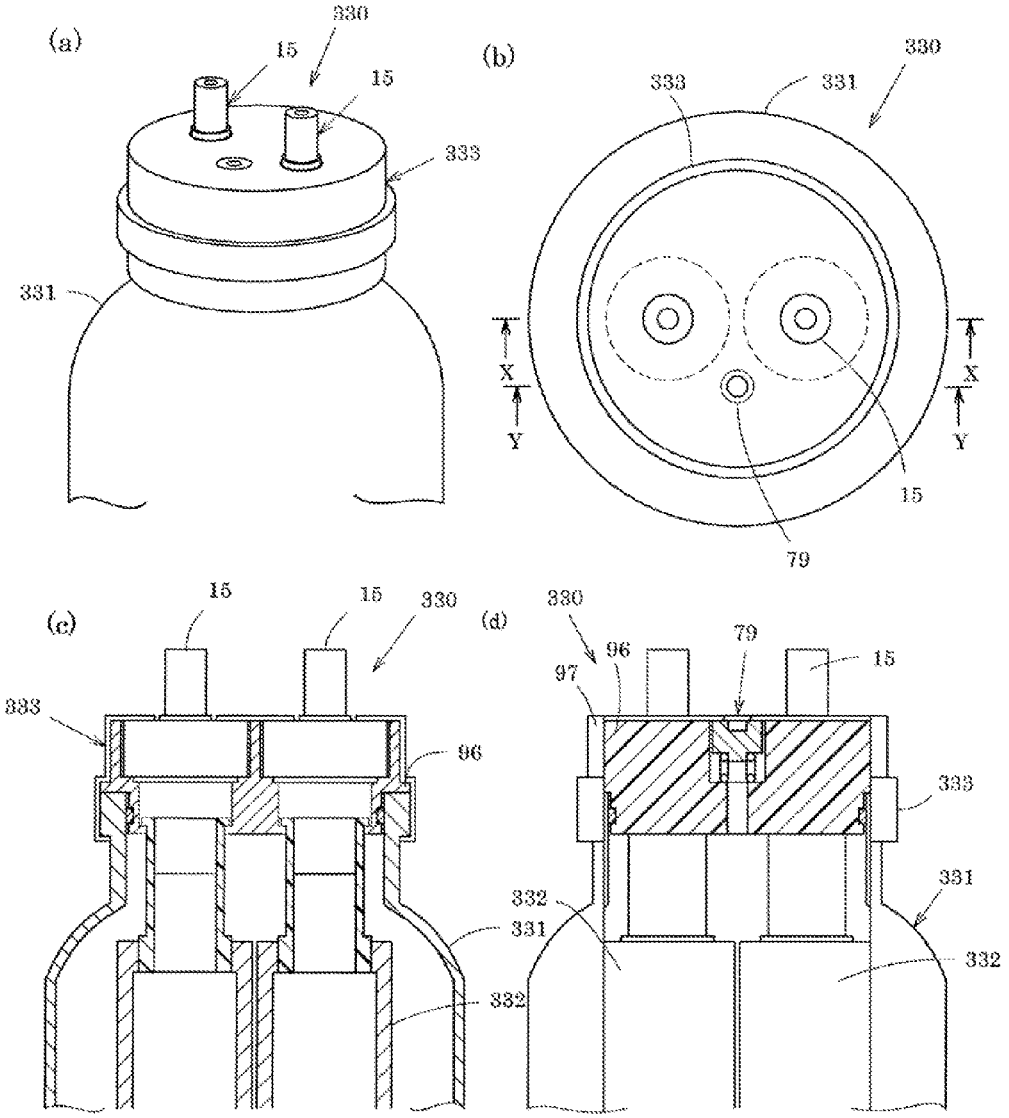
FIGS. 36*a* to *d* are and a perspective view, a front view, and a front cross sectional view, and a side cross sectional view showing a part of other embodiment of the aerosol container of the present invention.

FIG. 36 shows the aerosol container 330 (storage container) which is used for the manufacturing method of the present invention. The aerosol product is manufactured by loading the content into the aerosol container 330. The manufacturing method described next is not only for loading the content into the aerosol 330 of FIG. 36. For example, it may be for a pumping product in which the contents are loaded in the pumping container having a pump valve, or a tube product in which the contents are loaded in the tube container having two storage part partitioned by the partitioning. Further, the aerosol container 330 of FIG. 36 has two storage part, but it may be equipped with three storage part.

Figure 37:
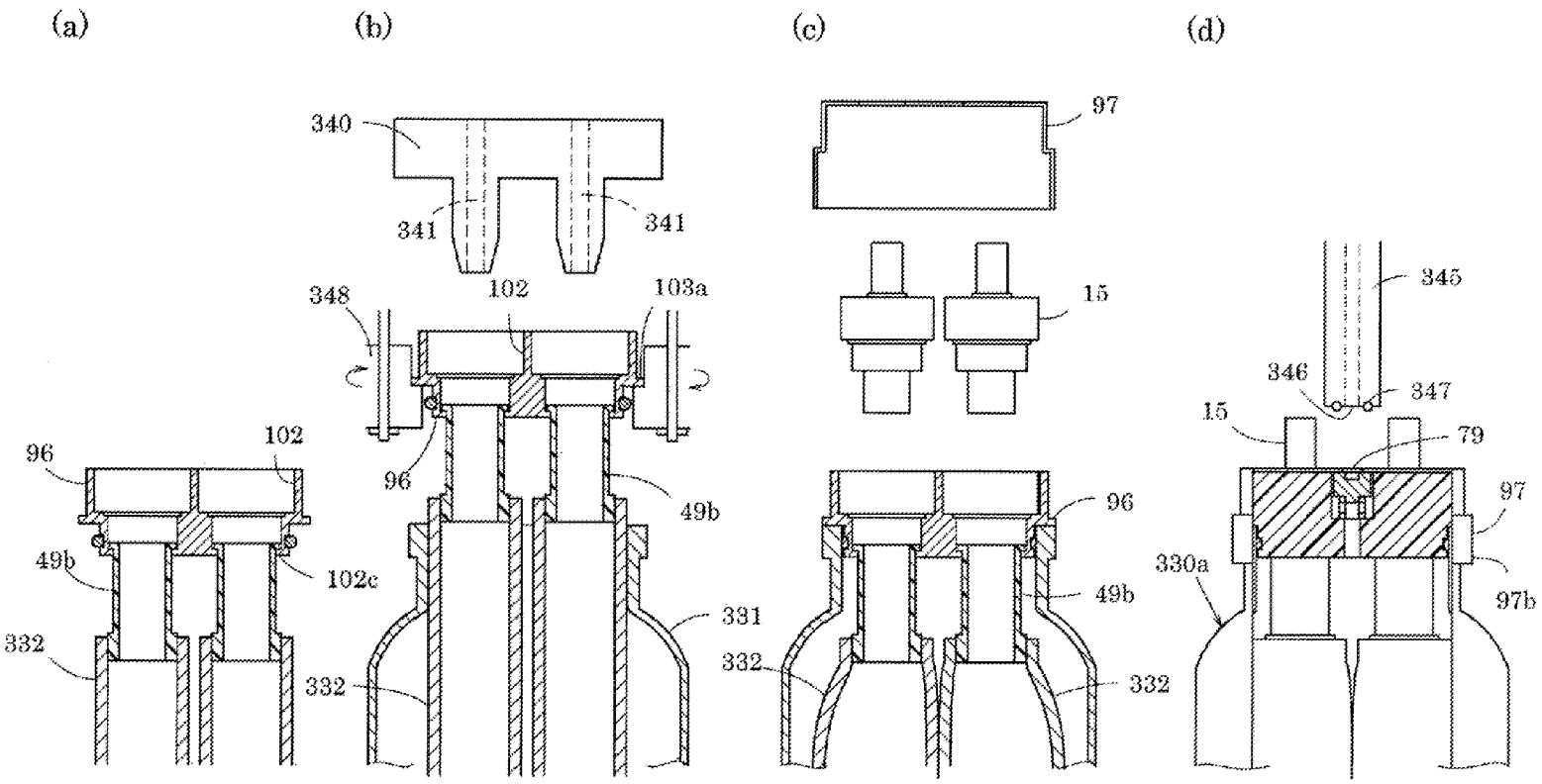
FIGS. 37*a* to *d* are a manufacturing process of the aerosol container of FIG. 36.

The aerosol container 330 of FIG. 37 is equipped with an outer container 331, two pouches 332 inserted into the outer container, and a valve assembly closing both outer container 331 and pouches 332. The outer container is substantially same as the outer container 91 of FIG. 13. The valve assembly 333 is substantially same as valve assembly 93 of FIG. 13 except that the valve assembly 333 do not equipped with the positioning protrusion 38, equipped with a valve holder 96 holding two aerosol valve 15 and having the check valve (gas charge opening) 79. The pouch 332 is substantially same as the pouch 49 of FIG. 7. The aerosol product 330*a* (see, FIG. 37*d*, FIG. 38*d*, FIG. 39*d*) are manufactured by loading two different contents into pouches 332 of the aerosol container 330 respectively, and by charging the propellant into the space (propellant storage part) between the outer container 331 and the pouch 332.

Next, the manufacturing method of aerosol product 330*a* using the loading method of the present invention is described.

The first manufacturing method of FIG. 37 is a method to set the location of the valve holder 96 fixed with the connecting member 49*b* of the pouch 332 by rotating the valve holder 96 according to the location of the content loading nozzle 340, before the aerosol valve 15 and the pouch 332 are connected. The contents are loaded from the opening of the connecting member.

The content loading nozzle 340 for loading the content has two nozzle opening 341 aligned protruding downward, like shown in FIG. 37*d*.

The gas charging nozzle 345 for charging the propellant has a tubular gas nozzle opening 346 at the bottom, and a sealing member 347 which seals between the gas nozzle opening 346 and the gas charging hole (check valve) 79 at the bottom.

The first manufacturing method is achieved first by connecting the valve holder 96 and the pouch 332 in which the lower end (holding part) of the holder part 102 of the valve holder 96 and the upper end of the connecting member 49*b* are engaged, like shown in FIG. 37*a*. Next, the valve holder 96 attached to the pouch 332 is set above the outer container 331 concentrically. The setting is conducted by the supporting member where the flange portion 103*a* of the valve holder 96 is lifted. The part of the pouch 332 is inserted in the outer container 331. In this condition, two connecting member 49*b* are aligned parallely, because the upper opening of the connecting member 49*b* are supported by the holder part 102 of the valve holder 96.

In this state, the two nozzle opening 341 and two connecting member 49*b* are aligned on the straight line, and the contents are loaded into the pouch 322 from the opening of the connecting member using the content loading nozzle located above. If the opening of two connecting member 49*b* and two nozzle opening 341 of the content loading nozzle 340 is not arranged on the straight line up and down, the nozzle opening 341 and the opening of the connecting member 49*b* will not mates with each other, when the content loading nozzle 340 is descended. Therefore, the valve holder 96 is rotated around the center axis of the valve holder 96, arranged so that the two opening of the connecting member 49*b* and two nozzle opening 341 of the content loading nozzle 340 are aligned in the straight line. The rotation of the valve holder 96 is conducted by having the supporting member 348 to support the valve holder. Further, the rotation rate of the valve holder is controlled by the controlling device using such like an infrared ray sensor.

The contents are loaded from the content loading nozzle 340 to the pouch 332, after the nozzle opening 341 and the connecting member 49*b* are attached.

The aerosol valves 15 are inserted in the valve holder 96, and the aerosol valve 15 and the connecting member 49*b* are connected, after the loading of the content into the pouches 332, like shown in FIG. 37*c*. Further, the mounting cover 97 is capped, and the lower end is crimped so as to form the fixing part 97*b* (see, FIG. 37*b*). Lastly, the aerosol product is manufactured after the propellant is charged into the space between the outer container 331 and the pouch 332 from the gas charging hole 79 by sealing the gas charging hole 79 and the gas nozzle opening 346 with the sealing member 347 after the gas nozzle opening 346 of the gas charging nozzle 345 is engaged to the gas charging hole (check valve) 79.

In this first manufacturing method, only the valve holder 96 connected to the connecting member 49*b* is rotated, and the outer container 331 is held. In other word, the part of the pouch 332 and the outer container 31 is rotated. Further, because the contents are loaded through the opening of the connecting member 49*b*, the loading speed can be enhanced and the productivity is high.

Figure 38:
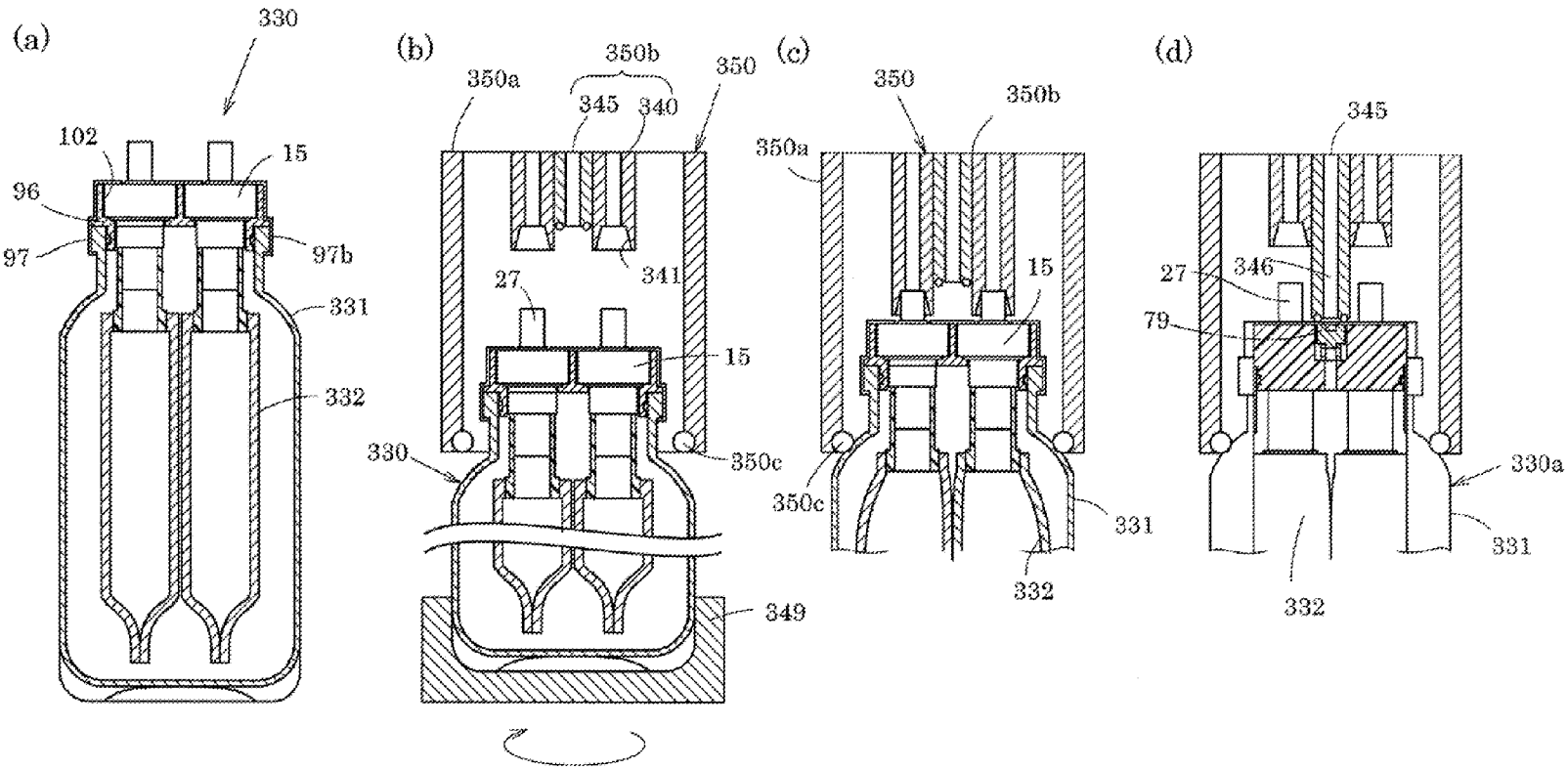
FIGS. 38*a* to *d* are the other embodiment of the process of manufacturing the aerosol container of FIG. 36.

The second manufacturing method of aerosol product 330*a* of the present invention is shown in FIG. 38. This manufacturing method is achieved first by assembling the aerosol container 330 after connecting the aerosol valve 15 and the pouch 332. Then the aerosol container 330 is rotated to have it positioned with the content loading nozzle 340, and the contents are loaded into the pouch 332 from the aerosol valve 15. The pouch 332 of FIG. 38 does not have the flange portion on upper end. However, the pouch with the flange may be used in the same method.

The content loading nozzle 340 and the gas charging nozzle 345 are substantially same as the content loading nozzle 340 and the gas charging nozzle 345 of FIG. 37. However, because the content and the propellant are charged after the assembling of the aerosol container 330, a loading device 350 composed of the content loading nozzle 340 and the gas charging nozzle 345 may be used. The loading device 350 has an outer tubular portion 350*a* which covers the upper part of the aerosol container, and loading machine equipped with the equipped with the content loading nozzle 340 and the gas charging nozzle 345. The lower end of the outer tubular portion 350*a* engages with the outer container (in this embodiment it engages with the shoulder portion) of aerosol container 330, and equipped with the sealing portion 350*c* which holds the aerosol container 330. The sealing portion 350*c* has the effect to hermetically close the inner space of the outer tubular portion 350*a*. Further, the opening of the nozzle opening 341 of the content loading nozzle 340 is formed to be tapered where the diameter is been widened in lower direction.

The manufacturing method of FIG. 38 first shows the assembling of the aerosol container 330 in FIG. 38*a*. In other words, the aerosol valve 15 is inserted into the holder part 102 of the valve holder 96, and then the pouch 332 is attached to the lower end of the aerosol valve 15 sandwiching the valve holder 96. Further, the mounting cover 334 is placed engaging with the outer container, and lastly, the aerosol container 330 is manufactured by forming the fixing part 97*b* crimping the lower end of the mounting cover 334.

Next the aerosol container 330 and the charging device 350 is arranged concentrically, like shown in FIG. 38*b*. Then the aerosol container 330 is rotated so the stem 27 of the aerosol valve 15 and the nozzle opening 341 of the content loading nozzle 340 are arranged on the straight line. In this embodiment, the rotation of the aerosol container 330 is worked by arranging the aerosol container 330 on the rotating plate 349 and the rotation of the rotating plate is controlled by motor, rotating roller, or etc. However, the aerosol container 330 may be rotated directly by the rotating roller. The rotation of the aerosol container 330 is regulated by the regulation device using sensor of above.

Then the charging device 350 is lowered to have the charging device 350 to hold the aerosol container 330 by engaging the lower end sealing part 350*c* of the outer tubular portion 350*a* to the shoulder part of the outer container 331 of the aerosol container, like shown in FIG. 38*c*, after the arranging of the aerosol container 330 and the charging device 350, in which the stem 27 of the aerosol valve 15 and the nozzle opening 341 of the content loading nozzle 340 are arranged on the straight line. At the same time, the stem 27 of the aerosol valve 15 and the nozzle opening 341 of the content loading nozzle 340 are connected. And the content is loaded into the pouch 32 by opening the aerosol valve in which the stem 27 is lowered by content loading nozzle 340.

The stem 27 is released and the stem 27 is back to the initial position, like shown in FIG. 38*d*. Lastly the propellant is charged into the space between the outer container 331 and the pouch 332 from the gas charging opening, by connecting the gas nozzle opening 346 of the gas charging nozzle 349 to the gas charging opening (check valve) 79, and the aerosol product 330*a* is manufactured.

Figure 39:
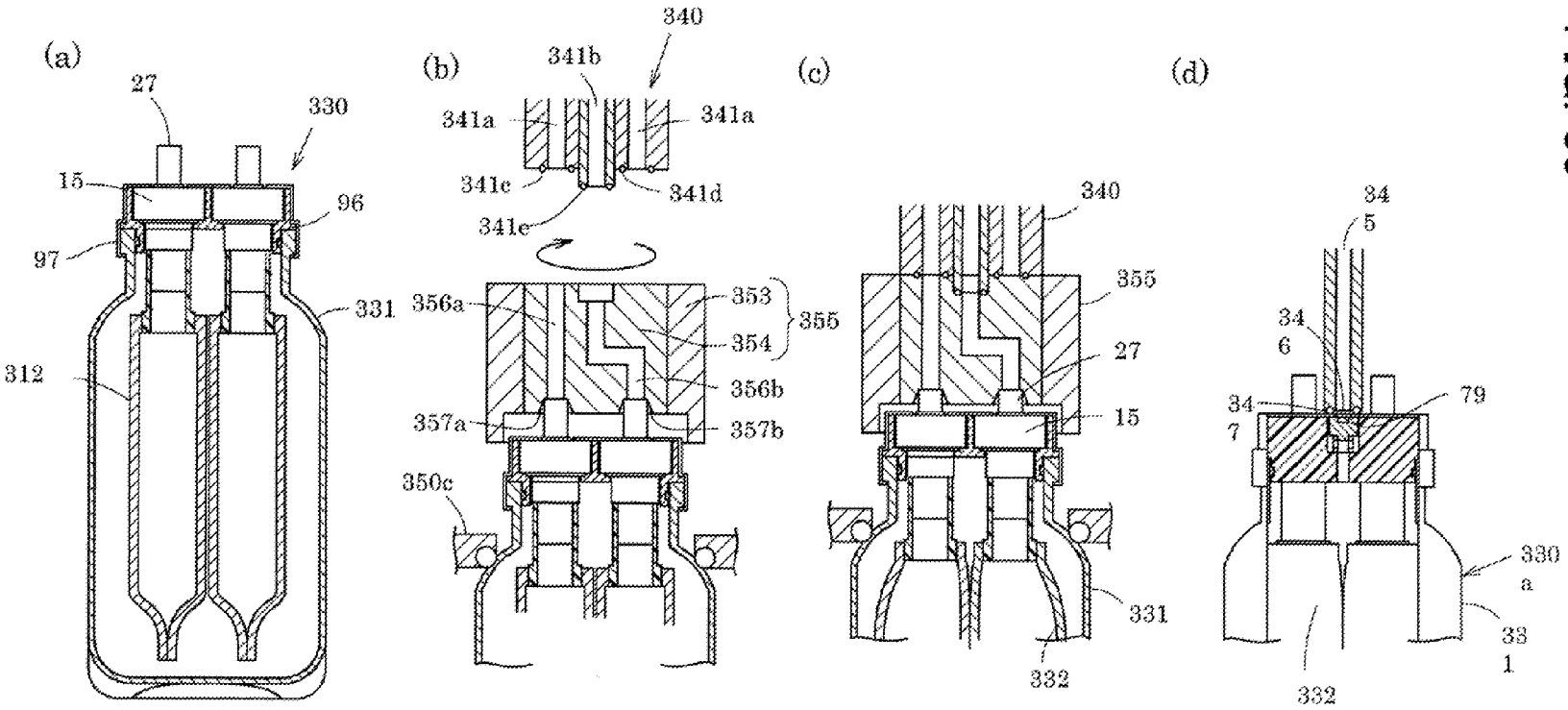
FIGS. 39*a* to *d* are the other embodiment of the process of manufacturing of the aerosol container of FIG. 36.

The third manufacturing method of aerosol product 330*a* of the present invention is shown in FIG. 39. That is the provisional adapter 355 is arranged to have the nozzle opening of the provisional adapter and the stem 27 in straight line by rotating. The provisional adapter 355 is attached to the aerosol container 330 with the content loading nozzle 340 and the aerosol valve 15 being communicated through the provisional adapter 355. And the contents are loaded. The provisional adapter 355 and the content loading nozzle 340 construct the charging nozzle. In other word, the arrangement is operated by rotating the part (provisional adapter 355) of the charging nozzle.

The content loading nozzle 340 is a cylindrical body which can be inserted in the main body 353 of the provisional adapter 355, and is equipped with an annual path 341*a* and a center path 341*b* for providing the contents. The charging device 350 having a content loading nozzle 341*a* is equipped with a sealing portion 350*c* holding the aerosol container 330. Further, two annual sealing member 341*c, d* are provided sandwiching the lower end opening of the annual path 341*a*, and an annual sealing member 341*e* is provided on the periphery of the lower end opening of the center path 341*b*.

The provisional adapter 355 is composed of a main body 353 having a tubular shape, and a rotating adapter 354 adapted inside the main body rotatably. However, the main body 353 and the rotating adapter 354 may integrally rotate.

The rotating adapter 354 is composed of a first path 356*a* communicating the annual path 341 a of the content loading device 340 and one of the stem 27, and a second path 356*b* communicating the center path 341*b* of the content loading device 340 and the other stem 27.

The upper opening of the first path 356*a* is located away from the center axis of the rotating adapter 354 for engaging with the annual path 341*a*, and the lower opening is located away from the center axis of the aerosol container 330. In this embodiment, the distance from the center axis of the rotating adapter 354 to the upper end opening (radius of the annual path 341*a*) and the distance from the center axis of the rotating adapter 354 to the lower end opening (distance from center axis of the aerosol container 330 to stem 27) are same, and the first path 356*a* is a straight path penetrating the rotating adapter in vertical direction. Further, the lower end opening of the first path 356*a* is a stem inserting portion 357*a* in which the diameter is widened in lowering direction.

The upper opening of the second path 356*b* is located away from the center axis of the rotating adapter 354 for connecting the center path 341*b*, and the lower opening is located away from the center axis of the aerosol container 330 for connecting the stem 27. In this embodiment, the second path 356*b* is a path which has two turns communicating the upper end opening and the lower end opening. The lower end opening of the second path 356*b* is a stem inserting portion 357*b* in which the diameter is widened in lowering direction.

The structure of above enables the communication of the first path 356*a* of the rotating adapter 354 and the annual path 341*a* of the content loading nozzle 340, and the second path 356*b* of the rotating adapter 354 and the center path 341*b* of the content loading nozzle 340, despite the position (rotational position) of the rotating adapter 354. Further because the annual sealing member 341*c, d, e* are provided between the rotating adapter 354 and the content loading nozzle, the leakage of the content from the rotating adapter 354 and the content loading nozzle 340 may be prevented.

The manufacturing method of FIG. 39 is also performed first by assembling the aerosol container 330 like shown in FIG. 39*a*, like the method of FIG. 38*a*. In other words, the aerosol valve 15 is inserted into the valve holder 96, and then the pouch 332 is attached to the aerosol valve 15. Further, the mounting cover 97 is fixed to the outer container 331.

Next, the aerosol container 330 is held, and the rotating adapter 354 is rotated so that the stem 27 and the stem inserting portion 357*a* of the rotating adapter 354 are aligned, like shown in FIG. 39*b*. The rotating adapter 354 may be rotated with the content loading nozzle 340 in connected state.

The provisional adapter 355 and the content loading nozzle 340 are lowered and the stem 27 of the aerosol valve 15 and the stem inserting portion 357*a*, 357*b* are connected after the rotational adjustment of the provisional adapter 355 and the connecting of the provisional adapter 355 and the content loading nozzle 340, like shown in FIG. 39*c*. At the same time, the content is loaded while the aerosol valve 15 is opened by lowering the stem 27 of the aerosol valve 15.

Lastly, the provisional adapter 355 is detached from the aerosol container 330. And the aerosol product 330*a* is manufactured by charging the propellant into the space between the outer container 331 and the pouch 332 through gas charging opening 79 while the gas charging opening 79 and the gas nozzle opening 346 are sealed with the sealing member 347 after the gas charging opening (check valve) 79 is connected with the gas nozzle opening 346 of the gas charging nozzle 345.

Figure 40:
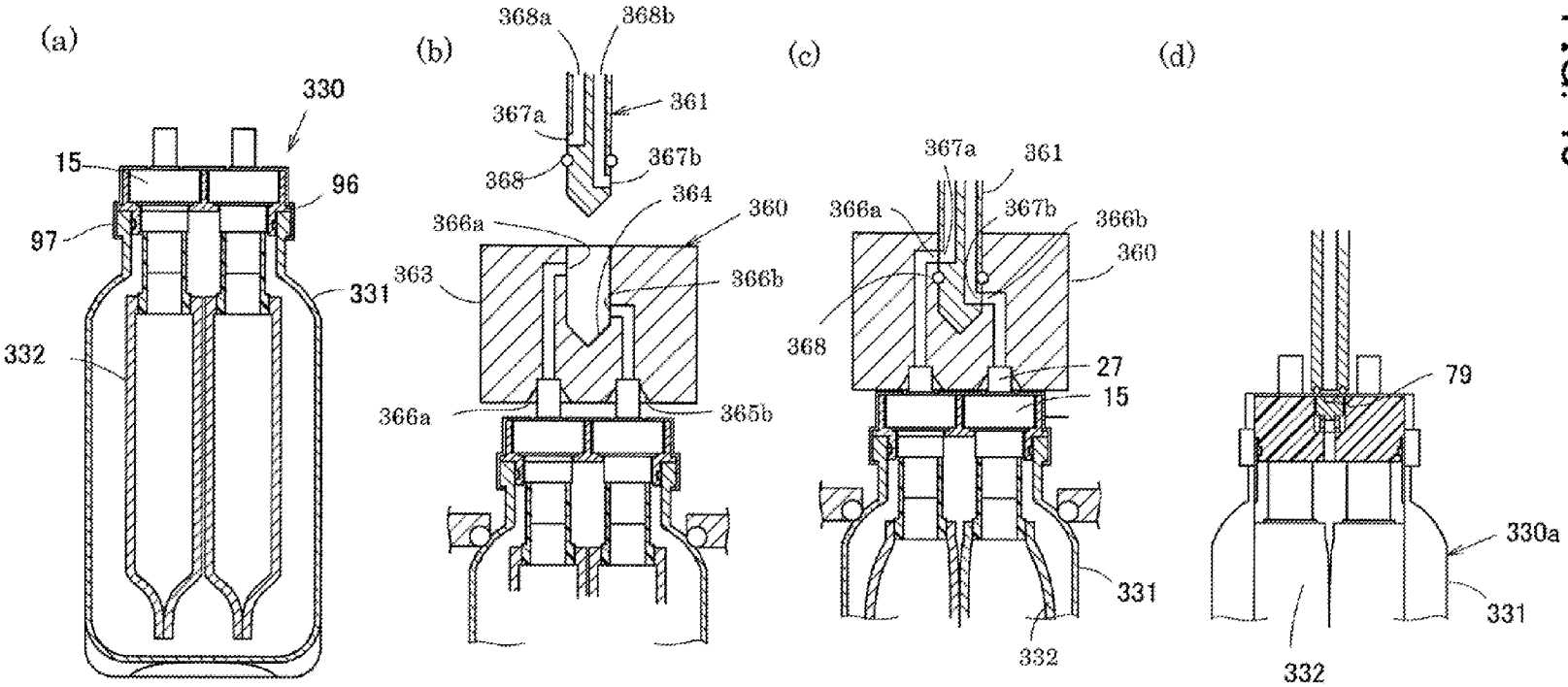
FIGS. 40*a* to *d* are the other embodiment of the process of manufacturing of the aerosol container of FIG. 36.

The forth manufacturing method of aerosol product 330*a* of the present invention is shown in FIG. 40. This method also assembles the aerosol container 330 first like method of FIG. 39, and then, the provisional adapter 360 is fixed to the aerosol container 330 after the rotatably adjusted, the content loading nozzle 361 and the aerosol valve 15 are communicated through the provisional adapter, and the contents are loaded. This provisional adapter 360 also adjusts the rotational position as part of the content loading nozzle 361.

The provisional adapter 360 has a main body 363 having a tubular shape, and a bottom part formed on its lower end. Two stem engaging hole 365*a, b* for inserting the stem 27 of the aerosol valve 15 are formed on the lower end of the side wall of the main body 363. An upper communicating hole 366*a* which communicates with one stem engaging hole 365*a* is formed on the upper side of the inner surface of the main body 363. An lower communicating hole 366*b* is which communicates with the other stem engaging hole 365*b* is formed on the lower side of the inner surface of the main body 363. Further, two stem engaging hole 365*a, b* are formed in tapered shape in which the diameter is to be widen toward the opening to ease the reception of the aerosol valve 15. Moreover, the bottom portion 364 is formed in a concave shape for the tip of the content loading nozzle 361 to be engaged.

The content loading nozzle 361 is a circular column body having a conical tip. The content loading nozzle 361 is composed of an upper nozzle opening 367*a* formed on the upper side of the side wall, a lower nozzle opening 267*b* formed on the lower side of the side wall, an inner path 368*a* communicates with the upper nozzle opening 367*a*, an inner path 368*b* communicates with the lower nozzle opening 367*b*, and an annual sealing member 368 provided between the upper nozzle opening 367*a* and the lower nozzle opening 367*b* of the outer surface of the side wall.

Because it is configured as above, the upper nozzle opening 367*a* and the upper communicating hole 366*a*, and the lower nozzle opening 367*b* and the lower communicating hole 366*b* communicate with each other independently, just by inserting the content loading nozzle 361 into the center hole of the provisional adapter 360, despite the direction relationship of the content loading nozzle 361 and the provisional adapter.

The manufacturing method of FIG. 40 is also performed first by assembling the aerosol container 330 like shown in FIG. 40*a*, like the method of FIG. 38*a*. In other words, the valve holder 96 and the aerosol valve 15 are engaged, and then the aerosol valve 15 and the pouch 332 are engaged. And, the mounting cover 97 is fixed to the outer container 331.

Next, the aerosol container 330 is engaged to the provisional adapter 360. In this process, the stem engaging portion 365*a, b* of the provisional adapter 360 is adjusted by rotating the provisional adapter 360, to have it engage with the stem 27 of the aerosol valve. However, the aerosol container 330 may be rotated to have the provisional adapter attached.

Then, the content loading nozzle 361 is inserted into the provisional adapter 360 like shown in FIG. 40*c*. There is no need for the direction adjustment as long as the content loading nozzle 36*a* and the provisional adapter 360 are in coaxial, because, the upper nozzle opening 367*a* and the upper communicating hole 366*a*, and the lower nozzle opening 367*b* and the lower communicating hole 366*b* communicate with each other independently like said above. The content is then loaded while the aerosol valve 15 is opened by lowering the stem 27.

Lastly, the provisional adapter 360 is detached from the aerosol container 330 by rising the content loading nozzle. Further, the propellant is charged into the outer container 331 from the gas charging part.

Figure 41:
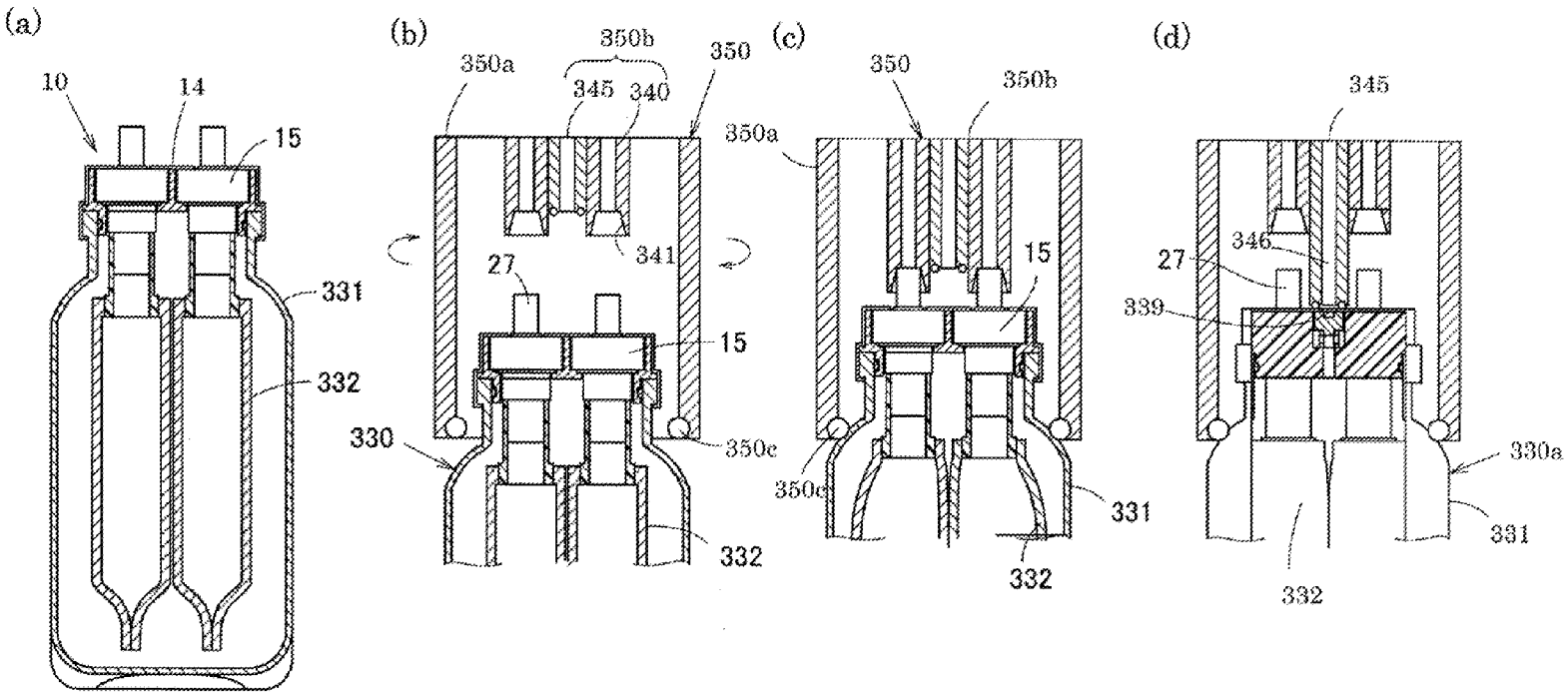
FIGS. 41*a* to *d* are the other embodiment of the process of manufacturing the aerosol container of FIG. 36.

The fifth manufacturing method of aerosol product 330*a* of the present invention is shown in FIG. 41. In this method, contents are loaded into the pouches 332 respectively through each aerosol valve 15 after the positioning adjustment of the content loading nozzle 340 (loading device 350) and the aerosol container 330 by rotating the content loading nozzle 340 (loading device 350) after the assembling of the aerosol container. The charging device 350 is equipped with a charging machine 350*b* having the content loading nozzle 340 and the gas charging nozzle 345 which rotates to have the positioning adjusted with the aerosol container. The other configurations are substantially same as the charging device 350 of FIG. 38.

The method of FIG. 41 also assembles the aerosol container 330 first like the method of FIG. 38*a*, like shown in FIG. 41*a*.

Next the assembled aerosol container 330 and the loading device 350 are placed concentrically, like shown in FIG. 41*b*. Then, the charging machine 350*b* of the charging device is rotated to have the stem 27 of the aerosol valve 15 and the nozzle opening 341 of the content loading nozzle to align on a straight line.

Then, the charging machine 350 is lowered, the nozzle opening 341 and the aerosol valve 15 are connected, and the contents are loaded after the positioning of the nozzle opening 341 of the content loading nozzle 340 and the stem 27 of the aerosol valve 15 are arranged on the straight line. This process is substantially same as the process of FIG. 38*c*.

The aerosol product 330*a* is manufactured by charging the propellant through the charging opening (check valve) 79 after the loading of the contents like shown in FIG. 41*d*.

Figure 42:
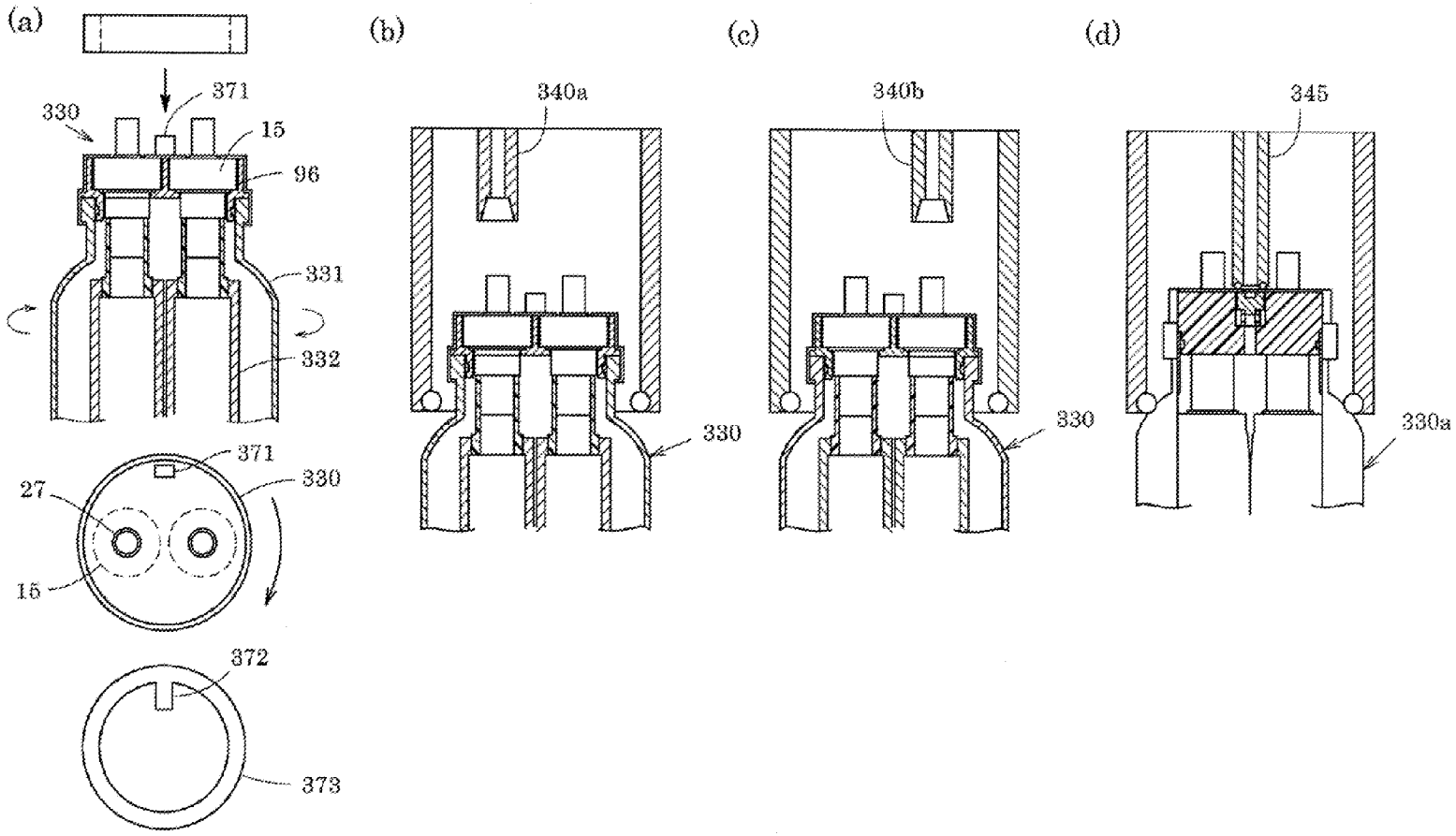
FIGS. 42*a* to *d* are the other embodiment of the process of manufacturing the aerosol container of FIG. 36.

The sixth manufacturing method of aerosol product 330*a* of the present invention is shown in FIG. 42. In this method, contents are loaded after the aerosol container 330 is assembled, and connecting the aerosol valve 15 with the content loading nozzle 340*a, b* by rotating the aerosol container 330.

In this embodiment, the positioning protrusion 371 is provided on the peripheral of the upper end of the aerosol container 330. The positioning protrusion 371 is provided on the outer side from the center axis of the aerosol container 330 than the stem 27.

This positioning protrusion 371 is used for stopping the rotating aerosol container 330. For example, the fixing ring 373 having a stepped portion 372 for engaging the positioning protrusion 371, may be arranged on the upper end of the rotating aerosol container 330 (or rotating aerosol container which in motion placed on the conveyor belt). Therefore, the aerosol container 330 stopped by fixing ring 373 will always arranged in same rotational position. Further, because the positioning protrusion 371 is provided on the outer side from the center axis than the stem 27, the damage of the stem 27 due to the contact of the fixing ring 373 may be prevented.

The positioning protrusion 371 may also be used in the first method of FIG. 37. This can secure the coupling of the valve holder 96 with the content loading nozzle 340.

For the present invention, for example, like the aerosol container 90*a* of FIG. 13, a sealing structure where the gasket (O-ring 105) is inserted between the outer container 91 having the inner surface 91*e* of the opening formed in tubular shape and the plug part 104 inserted along the inner surface 91*e* of the outer container is presented. In this case, because, it is not necessary to crimp the mounting cover while pressuring the sealing member like the aerosol container 10 of FIG. 1, predetermined sealing pressure may be obtained despite the variability of the attaching position or the attaching property of the mounting cover. In this application, the aerosol container 90*b* to 90*d* of FIG. 14, the aerosol container 200 of FIG. 19, the aerosol container 230 of FIG. 22, the aerosol container 260 of FIG. 25, the aerosol container 265 of FIG. 26, the aerosol container 279 of FIG. 27, the aerosol container of FIG. 28, the aerosol container 286 of FIG. 29, the aerosol product 290 of FIG. 30, the aerosol product 310 of FIG. 33, the aerosol container 330 of FIG. 37 to FIG. 42 is provided with the above sealing structure besides the aerosol container 90*a* of FIG. 13.

The sealing structure of FIG. 43 to 46 will be explained according to the aerosol container 200 of FIG. 13. However, the sealing structure may be used in above aerosol container or aerosol product. Further, the sealing structure may be used to aerosol container having the valve holder holding one aerosol valve, and the aerosol container equipped with an aerosol valve having a housing with a plug portion inserted into an outer container along the opening.

Figure 43:
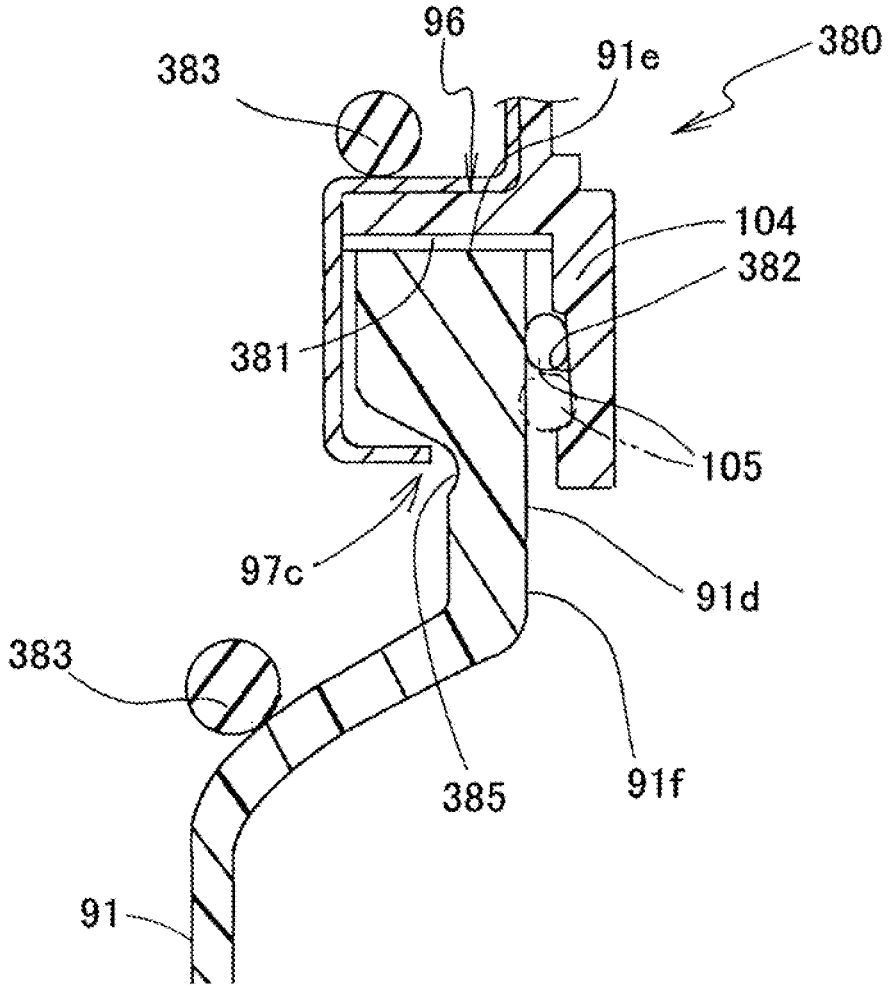
FIG. 43 a cross sectional view showing the sealing structure which can be used for the aerosol container of the present invention.
Figure 44:
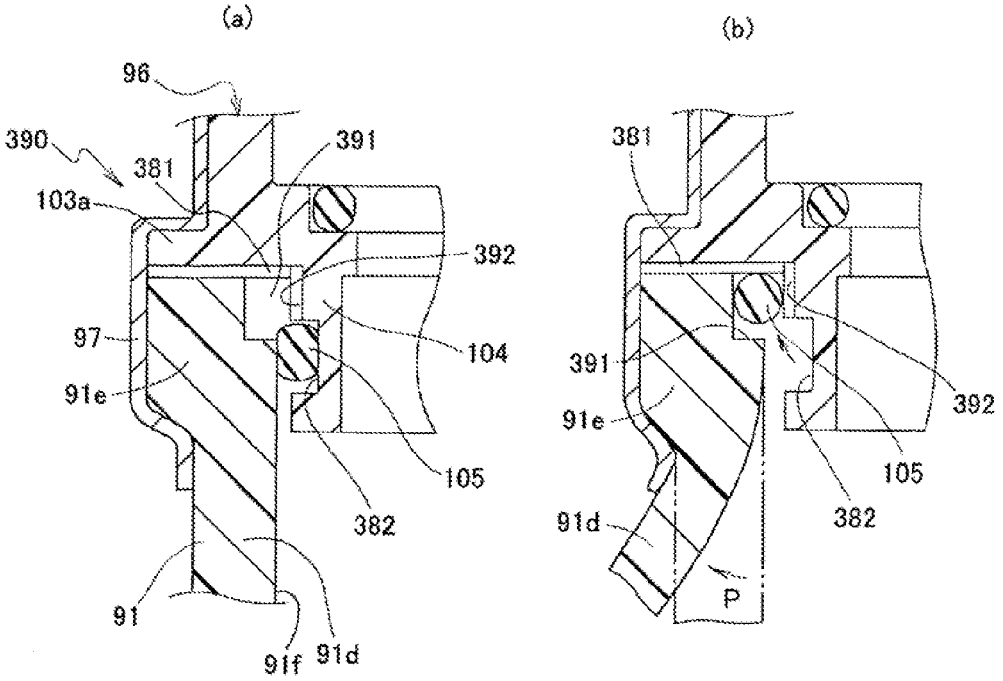
FIGS. 44*a, b* are a diagram of the sealing structure of FIG. 33, each showing the gas charging phase and outer container deforming phase, respectively.

In the sealing structure 380 of FIG. 43, the channel 381 for the propellant to pass is formed on the under surface (contacting part) of the flange 103*a* of the valve holder 96. The channel 381 is not limited as long as it communicates the inside with outside. Generally, one to four channels 381 are formed in radius direction or radially. The channel 381 enables the smooth charging of the propellant even when the mounting cover 97 (the cover member) is crimped and the valve holder 96 and the outer container 91 are fixed together. The number 382 and 383 of FIG. 43 are the sealing point of the charging device when charging the propellant. The channel for the propellant to pass also work as the prevention mens to prevent the plug to jump off or the container to blow, by letting the propellant eject outside when the aerosol product is exposed in high temperature abnormal condition. The channel for the propellant to pass may be formed on the upper end surface of the flange (mouth portion) 91*e* of the outer container 91, or may be formed both on the upper end surface of the flange 91*e* and the contacting part of the valve holder. Further, the channel extending vertically may be formed on the outer periphery of the flange portion 91*e* of the outer container 91.

In the sealing structure 380 of FIG. 43, the long O-ring channel 382 (annual recessed part) is formed on the periphery wall of the plug part 104 of the valve holder 96. The long O-ring channel 382 extends vertically up and down, and the bottom of the channel is formed to be tapered as the diameter of the bottom of the channel decrease in descent direction. Therefore, when the O-ring 105 is arranged on the upper side (sealing part), the seal function is secured. On the other hand, during the charging of the propellant the O-ring 105 stirs downward like shown in imaginary line (released part), the sealing pressure between the outer periphery of the O-ring 105 and the inner surface of the opening 91*f* decreases, and the clearance is likely to be formed. Therefore, the charging of the propellant can be smoothly performed. After the charging, the O-ring 105 moves upward due to the inner pressure, and the sealing pressure increases. The long O-ring channel 381 extending vertically is preferred to adopted together with the above channel 381 for the propellant to pass. However, the channels 381 for the propellant to pass and the long O-ring channel 382 formed vertically having tapered shape may be formed alone.

The O-ring channel 383 have a tapered bottom where the diameter decrease downwardly, however, it may be formed into two part with step portion, where the upper part (sealing part) has large diameter and the lower part (release part) has small diameter. However, to ease the movement of the O-ring 105, the border of the step part need to be made smooth. Also, the periphery wall of the plug part may be formed to be in tapered shape without forming O-ring channel. However, in this case, it is preferable to have the annual protrusion or step portion in order to hold the O-ring 15 from falling. Further, the O-ring channel may be formed on the inner surface 91*f* of the opening of the outer container 91 together with or substitute for the O-ring channel 381 of the valve holder 96. In this case also, the O-ring 105 is pressed in radius direction and deforms elastically, and exercises the sealing effect. Further, when the O-ring channel is formed on the inner surface 91*f* of the opening of the outer container, it is preferable to have it formed in tapered shape or in stepped shape and have the upper side (sealing part) to be small in diameter and lower side (released part) to be large in diameter.

In the sealing structure of 380 of FIG. 43, the channel for passing the propellant is formed on the border of the neck portion 91*d* and the flange portion 91*e* of the main container 91. The channels 385 are formed on the periphery of the neck portion 91*d* in vertical direction. However, the channel may be formed circularly. Further, the vertical channel for passing the propellant may be formed on the outer periphery of the flange 103*a* of the valve holder above the upper end of the neck portion 91*d*. In this embodiment of FIG. 43, the vicinity of the lower end part 97*c* of the mounting cover 97 is not crimped along the engaging step part of the under surface of the flange 103*a*, but crimped so as the lower end part 97*c* to be perpendicular. Therefore, the clearance will be formed between the engaging step part and the lower end of the cover member. However, this clearance ease the charging of the propellant. Further, this clearance secure the ejection of the propellant when the main body deform due to the heat or increase of the inner pressure.

In the sealing structure of 390 of FIGS. 44*a, b*, the notched part 391 is formed on the inner surface of the upper end of the flange 91*e* of the main container 91 for moving the O-ring 105. Further, the vertical channel 392 is formed on the side wall of the plug part 104 of the valve holder 96. The sealing structure 390 has approximately tubular inner face 91*f* of neck portion 91*d* and the flange portion 91*e*, and the O-ring 105 is inserted in the O-ring channel 382 in the ordinary condition. And when the temperature rises to the abnormal temperature, the outer container 91 of synthetic resin expands downwardly or deforms like the arrow P of FIG. 44*b*, then the O-ring 105 is pushed out from the O-ring channel 381 into the notched portion 391. In this state, the space is formed between the inner surface of the O-ring 105 and the outer surface of the side wall of the plug part 104, and it is communicated through vertical channel 392. Therefore, the propellant in the main container is ejected outside through the vertical channel 392, channel 381 formed in radius direction, and the jump off of the valve holder 96, mounting cover 97, and etc is prevented.

Figure 45:
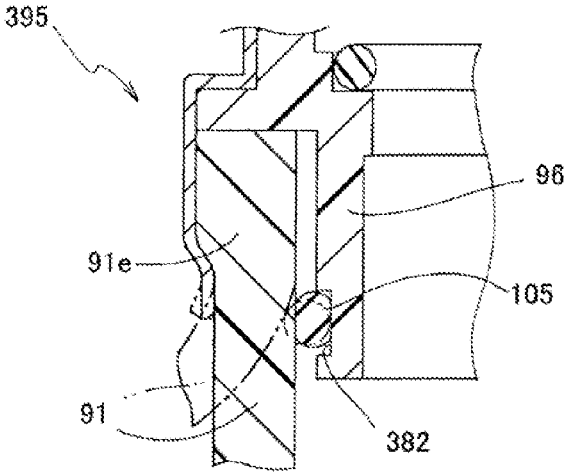
FIG. 45 a cross sectional view showing the other embodiment of the sealing structure which can be used for the aerosol container of the present invention.

In the sealing structure 395 of FIG. 45, the O-ring channel 382 is formed on the thin part of the outer container 91, more specifically, on the part below the flange portion 91*e*. The other configuration is substantially same as the sealing structure of FIG. 43. This embodiment also deforms like the imaginary line when it is exposed to the abnormal high temperature. Thus, the press force in radius direction to the O-ring 105 decreases, the seal is released, and the propellant will be ejected. Therefore, the jump off of the valve holder 96 and etc, are prevented.

Figure 46:
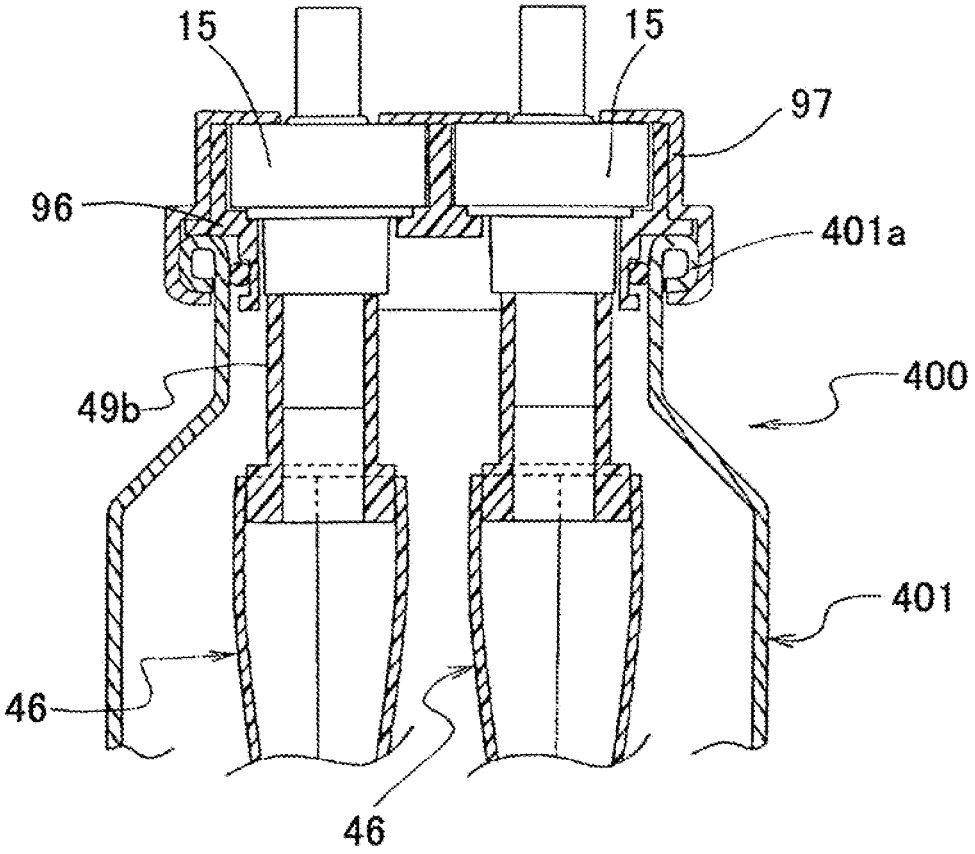
FIG. 46 a cross sectional view showing the other embodiment of the aerosol container of the present invention.

The aerosol container 400 of FIG. 46 uses metal container as the outer container, other than that it is substantially same as the aerosol container 90 of FIG. 13. The bead portion 401*a* of the upper end of the outer container 401 is formed to be in rectangular shape in cross sectional view. Two aerosol valve 15, valve holder 96, mounting cover 97, and the connecting member 49*b* are same as those of FIG. 13. And the pouch 46 of FIG. 7 is used.

The sealing member used in the sealing structure of this disclosure, is the O-ring having round ring shape as a whole, and having cross sectional view of circle in normal condition. However, sealing member having ellipse ring shape and etc, or having cross sectional view of polygonal shape, or other shape may be used.

Further, FIG. 47 to FIG. 55 shows an aerosol container having the other sealing structure using O-ring.

Figure 47:
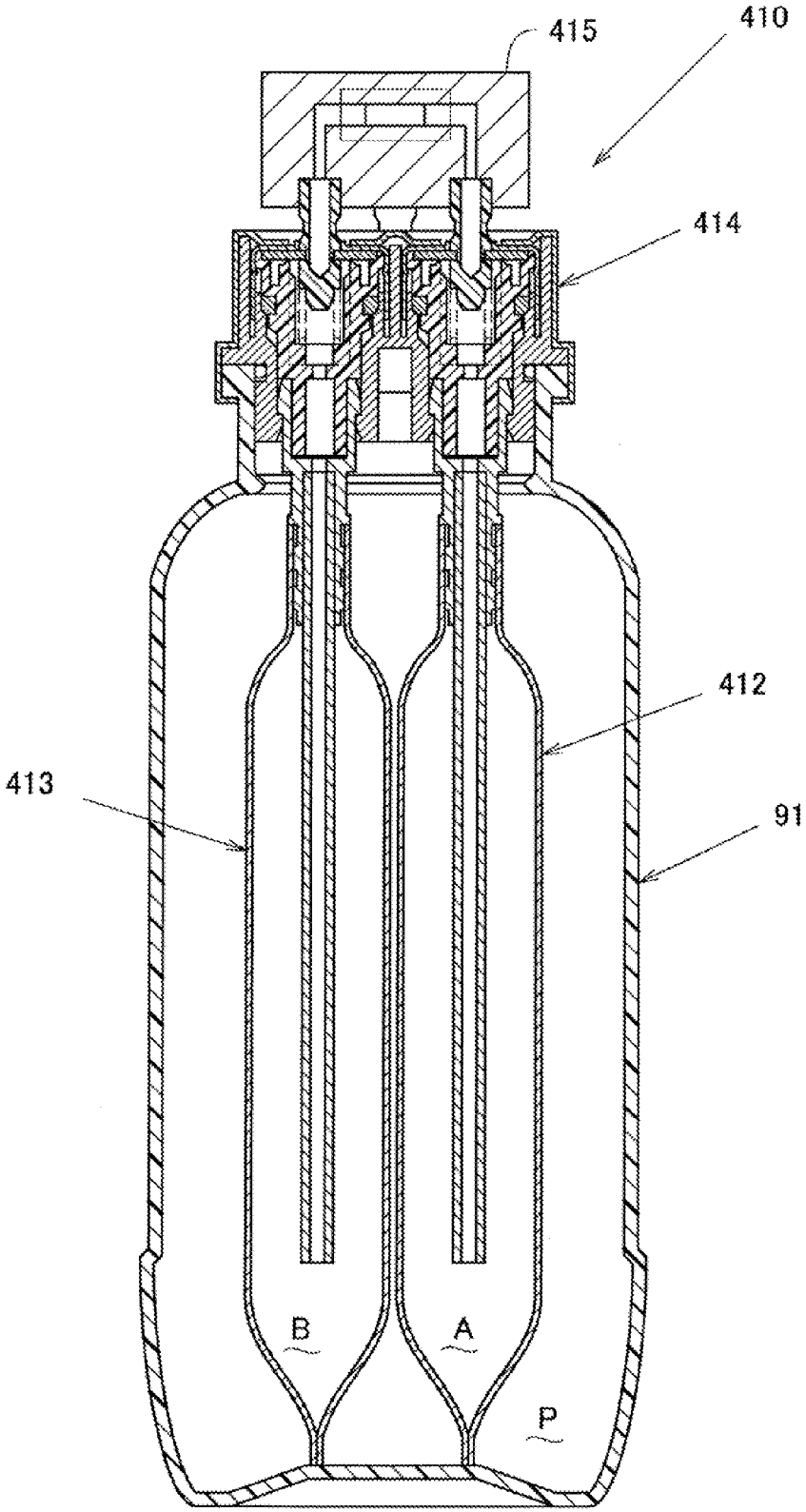
FIG. 47 a cross sectional view showing the other embodiment of the aerosol container of the present invention.
Figure 48:
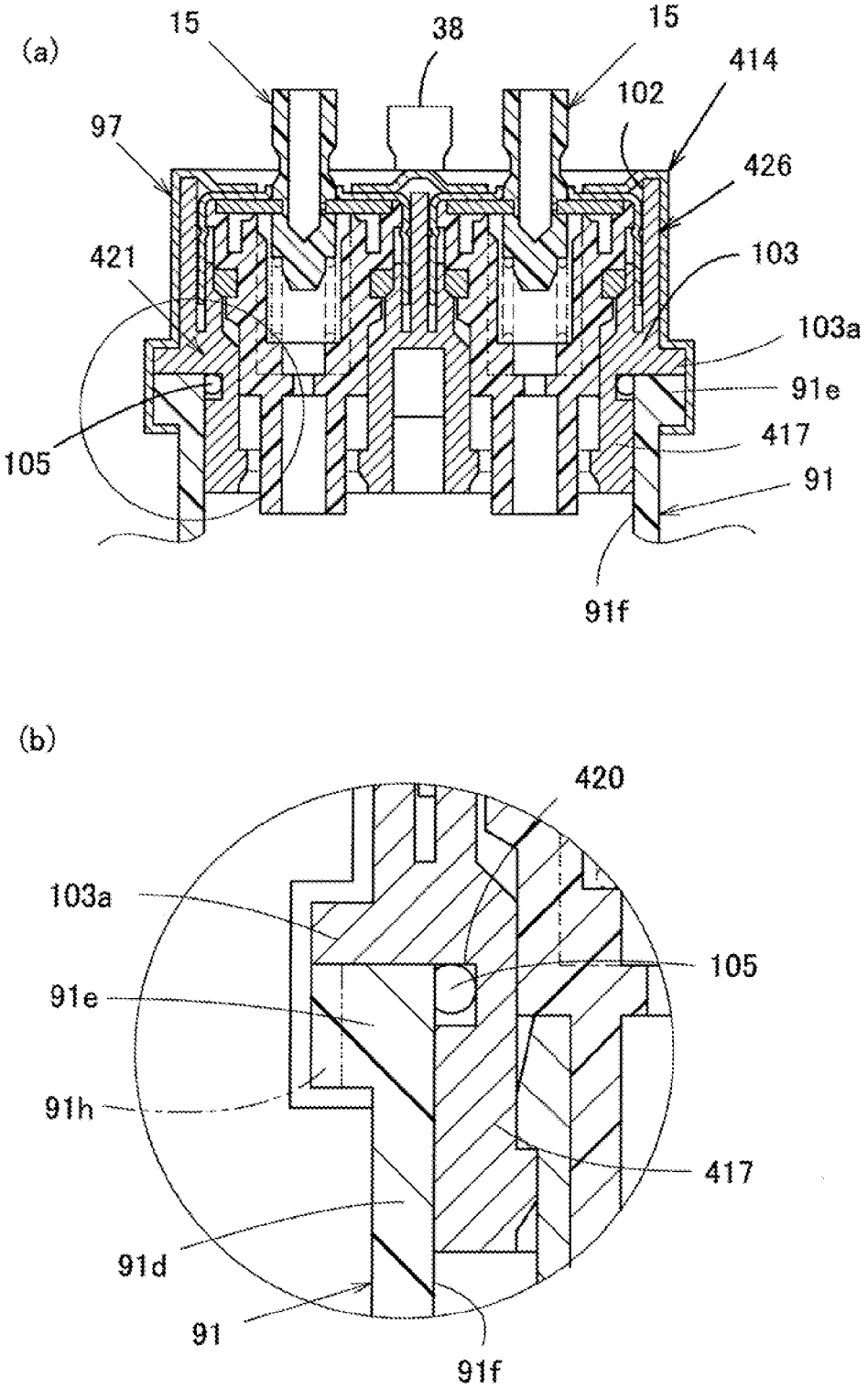
FIGS. 48*a, b* are enlarged part of the aerosol container of FIG. 47.
Figure 49:
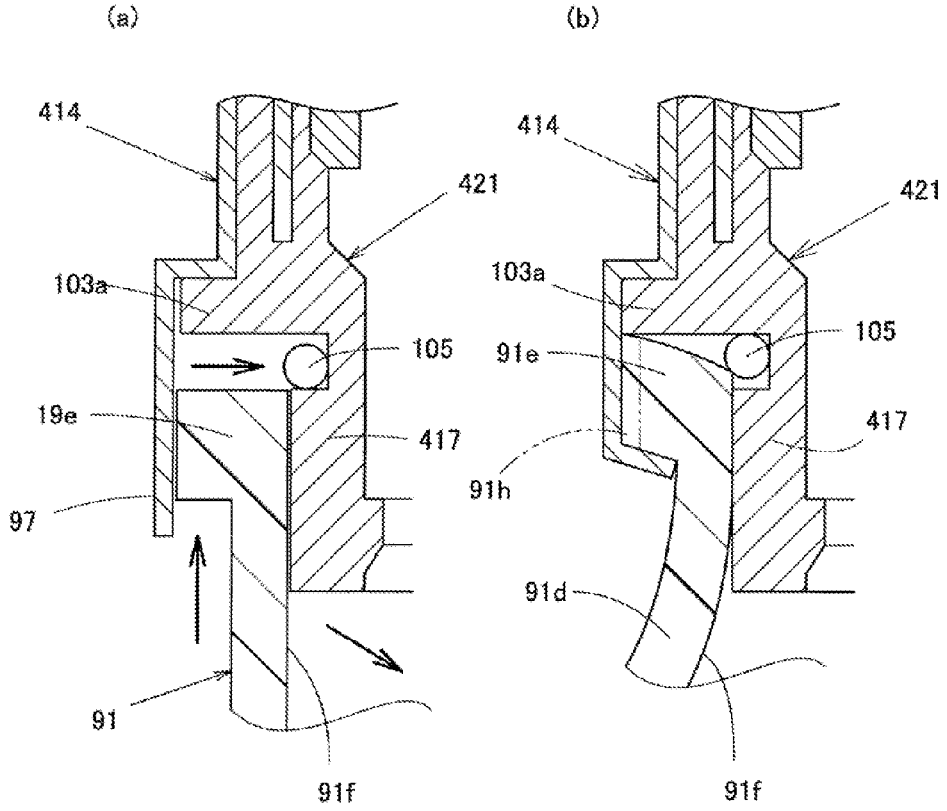
FIGS. 49*a, b* are a diagram of aerosol container of FIG. 47 each showing the gas charging phase and outer container deforming phase, respectively.
Figure 50:
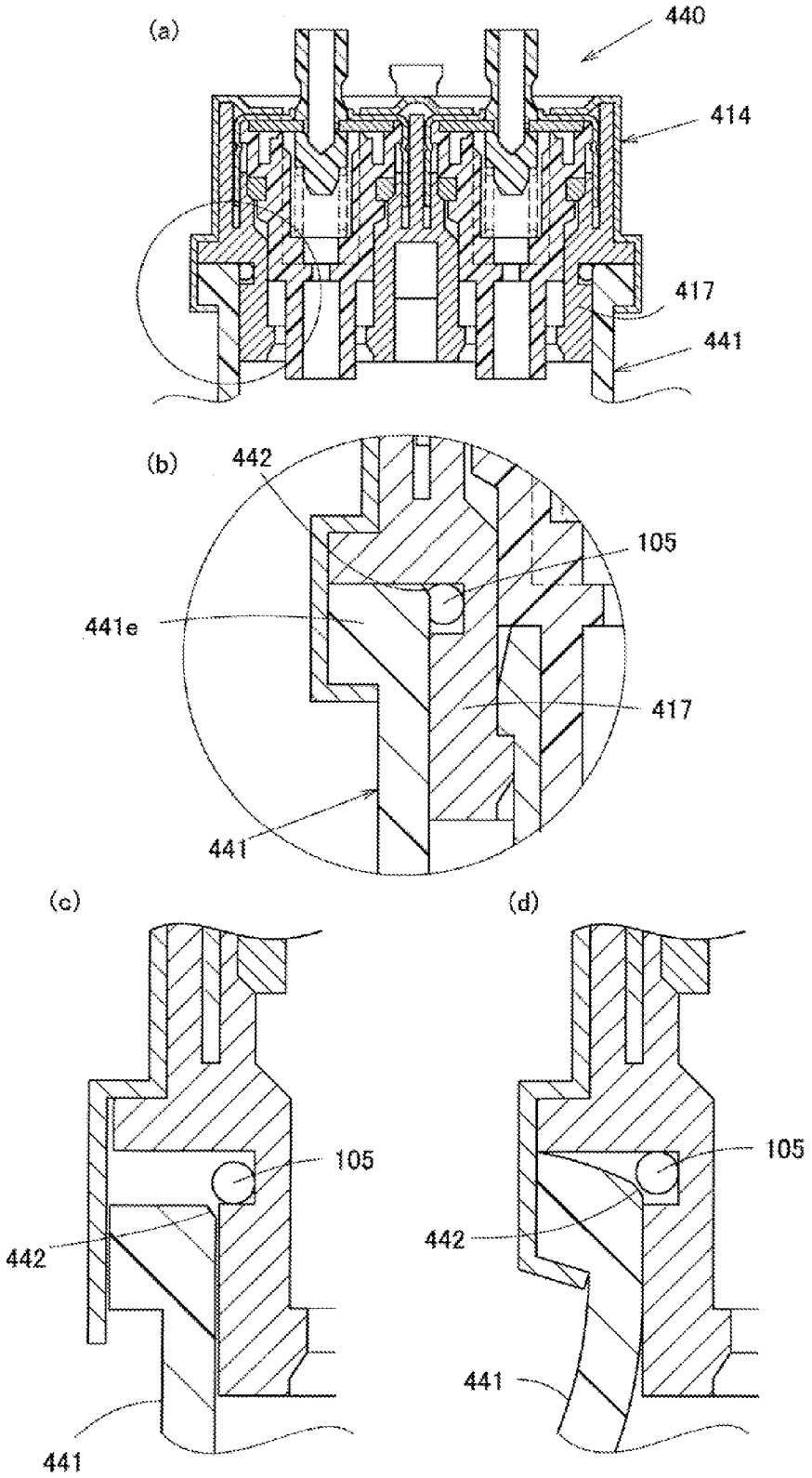
FIGS. 50*a, b* are a cross sectional view and a cross sectional view of the enlarged part showing the other of the aerosol container of the present invention and FIGS. 50 *c, d* are a diagram each showing the gas charging phase and outer container deforming phase, respectively.

The double aerosol container 410 of FIG. 47 is equipped with an outer container 91, a first inner container 412 and a second inner container 413 housed in the outer container, a valve assembly 414 closing the outer container 91, the first inner container 412, and the second inner container 413. A discharging member 415 may be attached for operating the aerosol valve of the valve assembly and discharge the content. The outer container 91 is substantially same as the outer container 91 of FIG. 13, and the first inner container 412 and the second inner container 413 are substantially same as the pouch 46 of FIG. 7.

The valve assembly 414 is comprises a valve holder 421 closing the outer container 91; two aerosol valve independently held by the valve holder 421 closing inner container 412, 413 respectively; and a mounting cover 97 covering the valve holder 421 and the aerosol valve 15, fixing the aerosol valve 15 to valve holder 421, and fixing the valve holder 421 on the opening of the outer container 91. The valve assembly 414 is preferably used in integral state where the valve holder 421 is attached to the mounting cover 97, the side surface of the mounting cover 97 is annually crimped to the valve holder 421 side, and etc. The aerosol valve 15 and the mounting cover 97 are substantially same as the aerosol valve 15 and the mounting cover 97 of FIG. 13.

The valve holder 421 comprises a base part 426 of column shape, two holder part 102 penetrating the base part in vertical direction, and a positioning protrusion 38 formed on the top of the base part. The holder part 102 and the positioning protrusion 38 are substantially same as the holder part 102 and the positioning protrusion 38 of FIG. 13.

The base part 426 is composed of a plug portion 417 of column shape inserting into the outer container 91 along the inner surface 91*f* of the opening, a lid portion 103 of column shape placed on the upper side of the outer container 91, and a flange portion 103*a* protruding outwardly in radius direction formed between the plug portion and the lid portion. The flange portion 103*a* is placed on top of the mouth portion 91*e* of the outer container 91 (see, FIG. 48). O-ring channel (annual recessed portion) 420 for holding the O-ring 105 is formed on the upper end of the outer periphery of the plug portion 417. The upper surface of the annual recessed portion 420 and the under surface of the flange portion 103*a* is connected continuously. That is, this disclosure is characterized in that the O-ring 104 is held on the upper side or the upper end of the outer surface of the plug portion 417. And this O-ring 105 seals the outer container 91 and valve assembly 414.

Back to FIG. 47, the first content A and the second content B are loaded into the first inner container 412 and the second inner container 413 of the double aerosol container, respectively to manufacture the double aerosol product. For such a content to load into the inner container, for example, two liquid type reaction ingredients such as two liquid type hair dyes, two liquid type permanent wave agents, and etc can be cited. For such a propellant, for example, a compressed gas of nitrogen gas, compressed air, carbon dioxide gas, nitric oxide gas, and etc, and a liquid gas of liquid petroleum gas, dimethyl ether, hydro fluoro olefin, and etc can be cited.

In such a double aerosol container 410, it simplify the charging of the propellant into the space S between the outer container 91 and both inner container. Specifically, the valve assembly is held on above to form the clearance between the outer container 91 and the flange 103*a*. Then the propellant can be charged into space S (under cup charging, arrow direction of FIG. 49*a*) from the clearance between the mouth portion 91*e* of the outer container 91 and the mounting cover 97, through between the mouth portion 91*e* of the outer container and the flange 103*a* of the valve assembly 414 and between the outer surface of the plug portion 417 of the valve assembly 414 and the inner surface 91*f* of the outer container 91. In this condition, because the O-ring 105 is held at the upper side of the outer surface or the upper end of the outer surface of the plug portion 417 of the valve assembly 414, and the O-ring 105 can be kept off from the inner surface 91*f* of the outer container, the O-ring 105 won't be an obstruction when charging the propellant. Further, when the pressure of the propellant is acted to the O-ring, the O-ring will be pressed against the O-ring channel (annual recessed portion) 42*d*, therefore it will not inhibit the flow of the propellant. After the charging of the propellant, the O-ring 105 will be moved between the inner surface 91*f* of the outer container 91 and the plug portion 417 of the valve assembly and form the sealing effect, just by slightly lowering the valve assembly 414. Therefore, the propellant can be efficiently charged without letting out. The fixing of the mounting cover 97 is completed by crimping the lower end of the mounting cover 97 to the lower end of the outer surface of the mouth portion 91 of the outer container (lower engaging part). And it can be operated easily. The valve assembly may be held above by having the charging device hold the integrally assembled valve assembly, held by having the lower end of the inner container support the valve assembly, or etc.

After the fixing of the valve assembly 414 to the outer container 91, the air remaining in the first inner container 412 and the second inner container 413 are ejected using the pressure of the propellant by lowering stems 27 of the aerosol valve 15, and contents are loaded into the first inner container 412 and the second inner container 413 from stems to manufacture the double aerosol product.

The double aerosol container 410 can safely eject the propellant outside without letting the valve assembly 414 pop, when the aerosol container deforms due to the weakening of the outer container 91 caused by the heating such as temperature rise or etc. Specifically, the sealing function between the O-ring 105 held on the top of the plug portion and the inner surface 91*f* of the outer container 91 is weaken, and the propellant is ejected outside passing the opposite route of the charging, when the shoulder portion 91*c* to the mouth portion 91*e* of the outer container 91 is expanded outwardly due to the heat and the pressure of the propellant. Therefore, the propellant can be ejected outside before the valve assembly 414 jump off. Further, the vertical channel 91*h* extending from the upper end of the outer surface of the mouth portion 91*e* of the outer container to the lower side may be provided like shown in imaginary line of FIG. 48*b*, FIG. 49*b*. This will enhance the ejection of the propellant. Such a vertical channel 91*h* may be made plurally around the outer surface.

The aerosol container 440 of FIG. 50*a* has an inner surface channel 442 (annual notch) extending from the upper end to lower side formed on the inner surface of the mouth portion 441*e* of the outer container 441 like shown in FIG. 50*b*. Other configuration is substantially same as the aerosol container 410 of FIG. 47 and has the first container 412, the second container 413, and the valve assembly 414. For the outer container 441, it is substantially same as the outer container 91 of FIG. 47 except for the mouth portion.

The depth of the inner surface channel 442 is formed to have the O-ring 105 to form the sealing effect between the outer container 441 and the valve assembly 414, when the plug portion 417 of the valve assembly 414 is inserted into the opening of the outer container 441.

To have such a structure, the charging of the propellant will be eased, because the charging route of the propellant will be secured while the under cup charging like shown in FIG. 50*c*. Further, the ejection of the propellant will also be eased, because the ejection route of the propellant will be formed shortly when the outer container 441 is heated and deform due to the temperature rise and etc, like shown in FIG. 50*d*.

Figure 51:
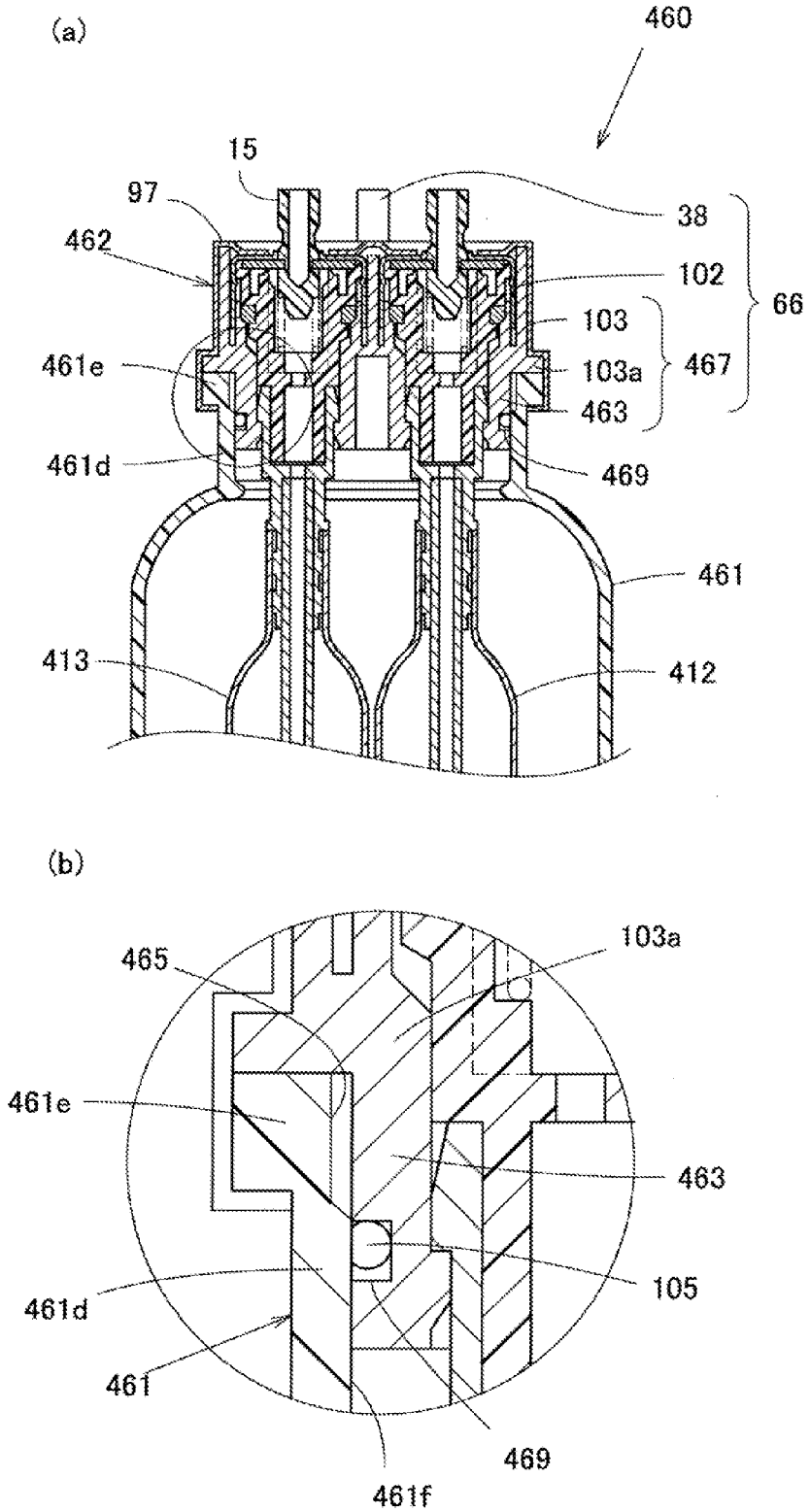
FIGS. 51*a, b* are a cross sectional view and a cross sectional view of the enlarged part showing the other embodiment of the aerosol container of the present invention.
Figure 52:
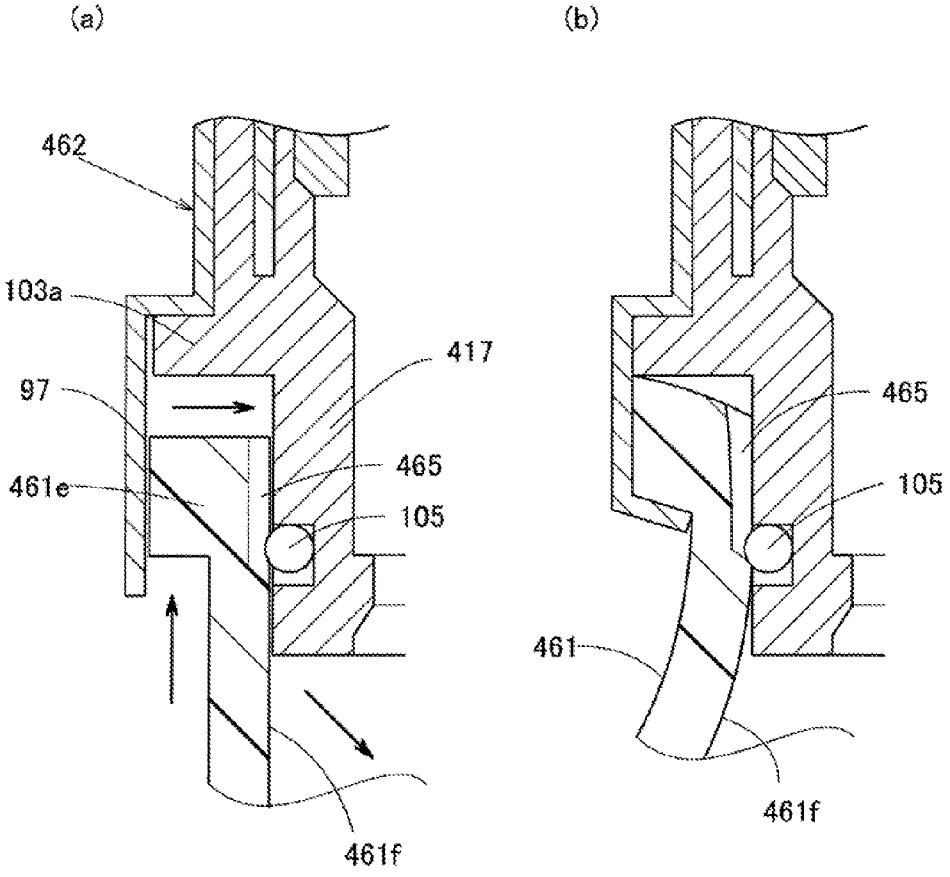
FIGS. 52*a, b* are a diagram of aerosol container of FIG. 50, each showing the gas charging phase and outer container deforming phase, respectively.

The double aerosol container 460 of FIG. 51 is equipped with an outer container 461, a first inner container 412 and a second inner container 413 housed in the outer container, a valve assembly 462 closing the outer container 461, the first inner container 412 and the second inner container 413.

The valve assembly 462 comprises a plug portion 463 inserted in the outer container along the inner surface 461*f* of the opening of the outer container 461; a flange portion 103*a* placed above the opening, formed on the top of the plug portion 463 having a diameter larger than the diameter of the plug portion, and an O-ring 105 sealing between the opening and the plug portion. And the inner channel 465 formed from the top to the above of the O-ring extending in vertical direction is formed on the inner surface 461*f* of the opening of the outer container 461.

The double aerosol container 460 and the double aerosol container 410 of FIG. 47 are different in the sealing structure formed between the outer container 461 and the valve assembly 462.

The outer container 461 is a pressure resistant container made of synthetic resin and has a bottom portion, a barrel portion of tubular shape, a shoulder portion of tapered shape, a neck portion 461*d* of cylinder shape, and a thick mouth portion 461*e* formed on the top. The outer surface of the mouth portion 461*e* is protruded outwardly in radius direction than the neck portion 461*d*. On the inner surface 461*f* of the opening of the outer container composed of inner surface of the neck portion 461*d* and the mouth portion 461*e*, inner channels 465 are formed annually extending vertically from the top. It is preferably to have from 2 to 8 of the inner channel 465. However, the inner channel may be formed in ring. It is not limited as long as the O-ring 105 contacts with the inner surface 461*f* of the opening below the inner channel 465, when the valve assembly 462 is fixed to the outer container 461.

The valve assembly 462 is equipped with a valve holder 466 closing the outer container 461; two aerosol valves 15 independently held by the valve holder 466, and closing the inner container 412 respectively; and a mounting cover 97 covering the valve holder 466 and aerosol valve 15, fixing the aerosol valve to the valve holder 466, and fixing the valve holder to the opening of the outer container 461. The aerosol valve 15 and the mounting cover 97 are substantially same as the aerosol valve 15 and the mounting cover 97 of FIG. 13.

The valve holder 466 comprises a base portion 467 of column shape, two holder portion 102 of tubular shape penetrating the base portion in vertical direction, and a positioning protrusion 38 extending upward from the top of the base portion. The holder portion 102 and the positioning protrusion 38 are substantially same as the holder portion 102 and the positioning protrusion 38 of FIG. 12.

The base part 467 is composed of a plug portion 463 of tubular shape inserted into the outer container 461 along the inner surface 461 of the opening; a lid portion 103 of column shape arranged above the outer container 461; and a flange portion 103*a* formed between the plug portion and the lid portion extending outward in radius direction. The flange portion 103*a* is arranged on top of the mouth portion 461*e* of the outer container 461. The annual recessed portion 469 for holding the O-ring 105 is formed on the outer surface of the plug portion below the inner channel 465 when the valve assembly 462 is inserted or attached to the outer container 461. The lid portion 103 and the flange portion 103*a* are substantially same as the lid portion 103 and the flange portion 103*a* of FIG. 13.

In such structured double aerosol container 460, the charging of the propellant into the space between the outer container 461 and both inner container will be simplify. That is, the propellant may be charged into space S from the clearance between the mouth portion 461*e* of the outer container 461 and the mounting cover 97 through the clearance between the mouth portion 461*e* of the outer container 461 and the flange portion 103*a* of the valve assembly 462 to the clearance between the inner surface 461*f* of the outer container 461 and the outer surface of the plug portion 463 of the valve assembly 462 (under cup charging, arrow direction of FIG. 52*a*). In this state, because the inner channel 465 is formed on the inner surface 461*f* of the outer container 461, the propellant passes the inner channel 465 avoiding the O-ring 105. Thus, the O-ring 105 will not be obstruction of charging the propellant. After the charging of the propellant, the O-ring 105 will be easily arranged between the inner surface 461*f* of the outer container 461 and the plug 463 of the valve assembly 462, just by slightly lowering the valve assembly 462. Therefore, it can be handled easy after the charging of the propellant.

After the fixing of the valve assembly 462 to the outer container 461, the air remaining in the first inner container 412 and the second inner container 413 are ejected using the pressure of the propellant by lowering stems 27 of the aerosol valves 15, and contents are loaded into the first inner container 412 and the second inner container 413 from stems to manufacture the double aerosol product.

The double aerosol container 460 can safely eject the propellant outside without letting the valve assembly 414 pop, when the aerosol container deforms due to the weakening of the outer container 461 caused by the heating such as temperature rise or etc. That is, when the neck portion of the outer container 461 expands, the lower end of the inner channel stirs downward, the contact between the O-ring 105 and the inner surface 461*f* of the outer container 461 let off, so the propellant can be ejected outside from the opposite route of the charging. Thus the propellant can be ejected outside before the valve assembly 462 jump off. Specifically, when the sealing effect is generated by having the O-ring 105 contacts with the inner surface 461*f* of the neck portion 461*d*, the sealing between the inner surface 461*a* and the plug portion 463 can be released at the early stage where the internal pressure is not yet abnormally high, and before the strength of the outer container is not yet weaken. Further, the vertical channel extending from the top may be formed on the outer surface of the mouth portion 461*e* of the outer container 461, like shown in FIG. 48*b*. This will further enhance the ejection of the propellant.

The aerosol container of FIG. 3 shows the sealing structure which does not use O-ring.

Figure 53:
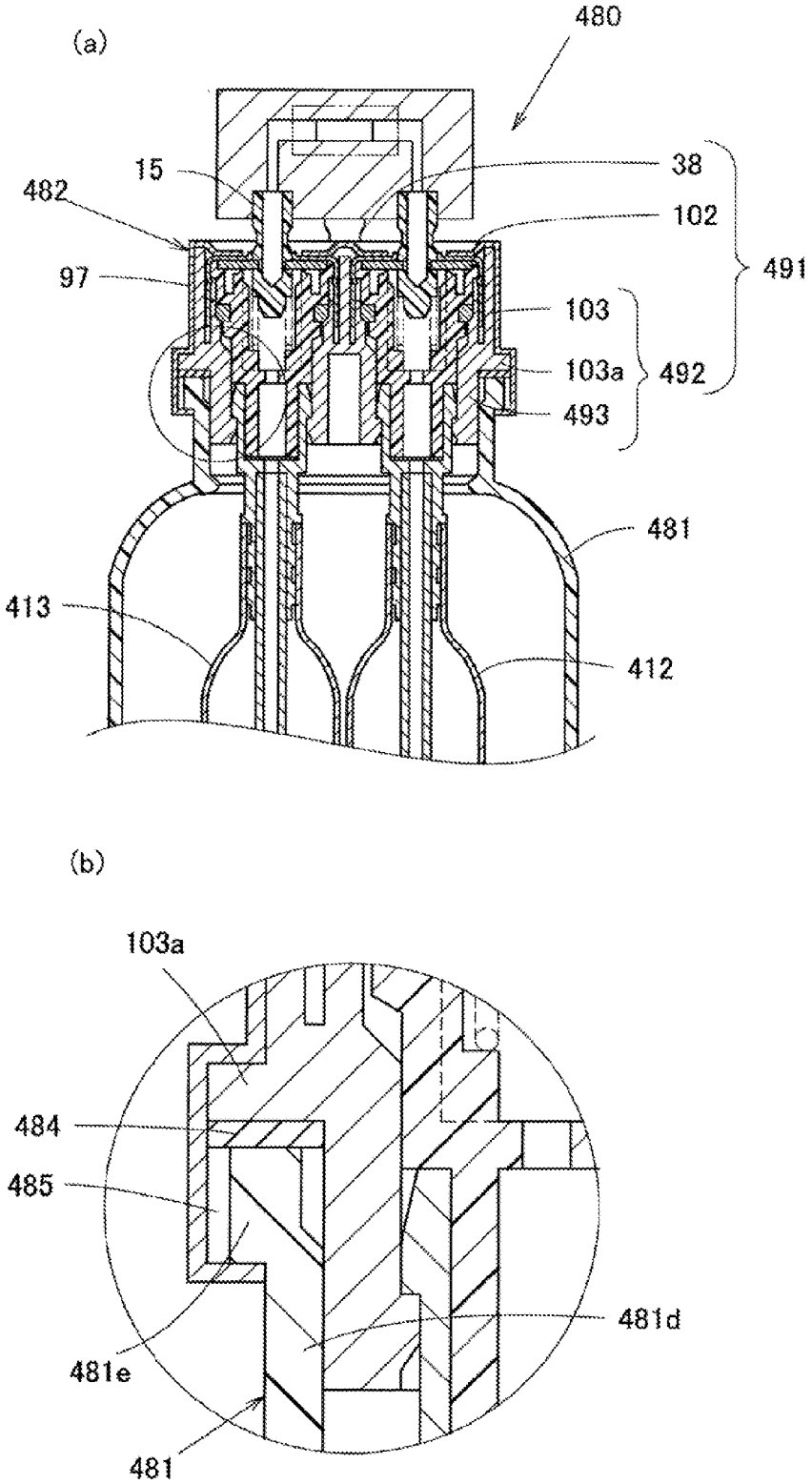
FIGS. 53*a, b* are a cross sectional view and a cross sectional view of the enlarged part showing the other embodiment of the aerosol container of the present invention.
Figure 54:
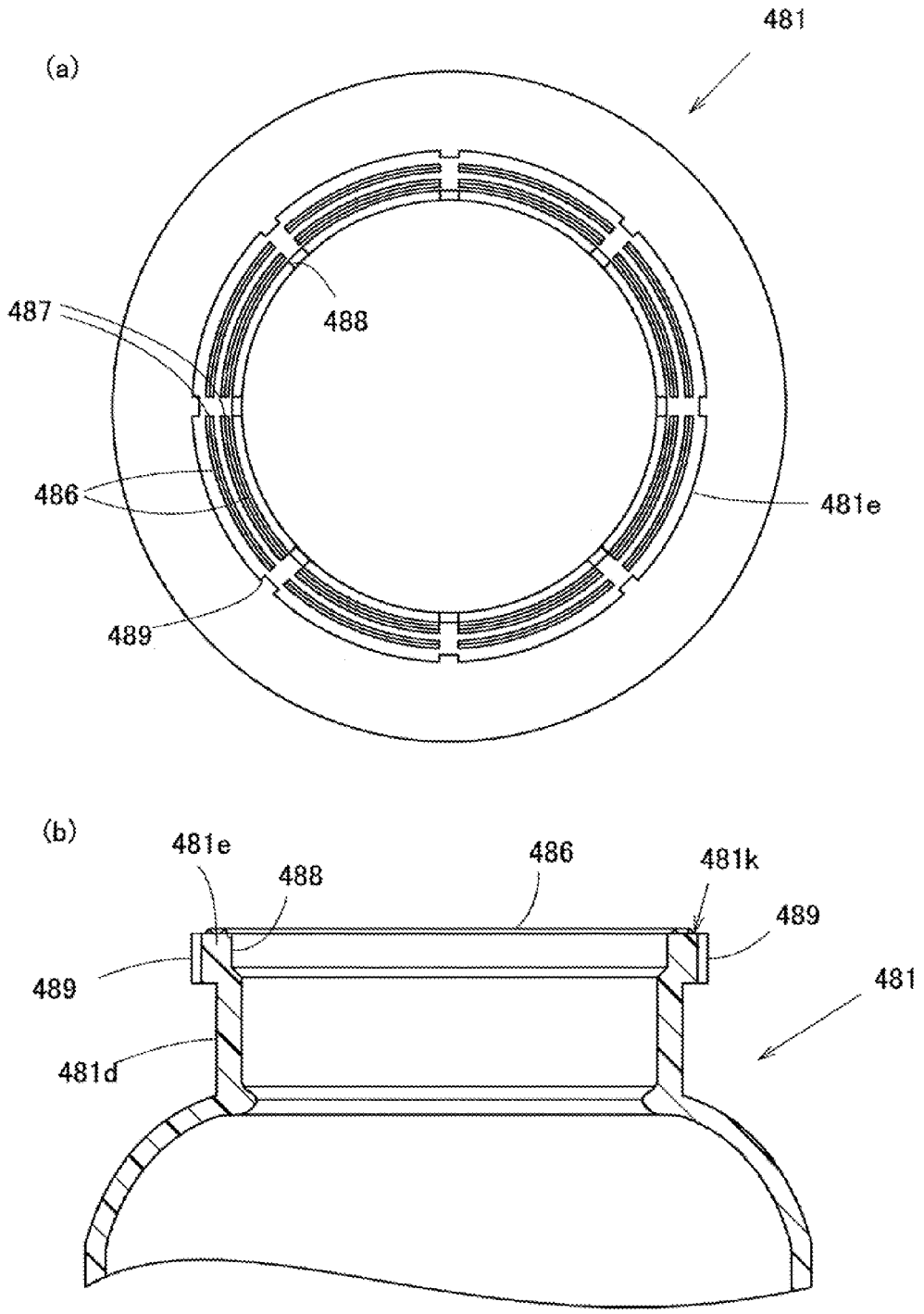
FIGS. 54*a, b* are a plan view and a cross sectional view of the outer container of the aerosol container of FIG. 53.
Figure 55:
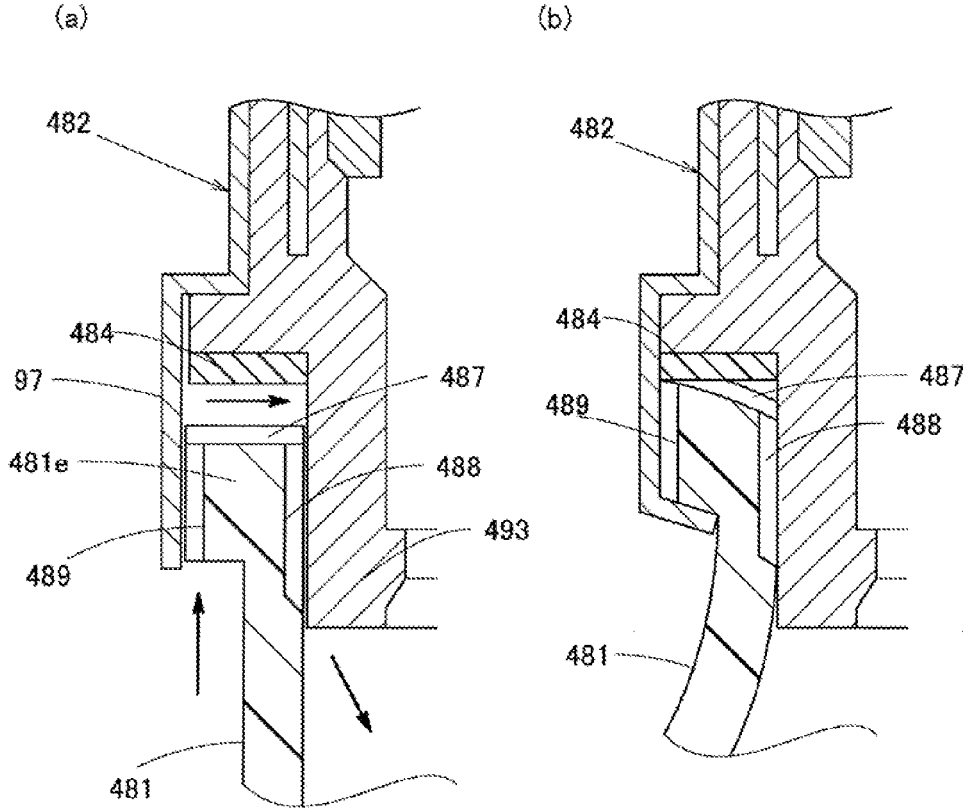
FIGS. 55*a, b* are a diagram of aerosol container of FIG. 54, each showing the gas charging phase and outer container deforming phase, respectively.

The double aerosol container 480 of FIG. 53 is equipped with an outer container 481, a first inner container 412 and a second inner container 413, and a valve assembly closing the outer container 481, the first inner container 412, and the second inner container.

The double aerosol container 480 has a gasket 484 provided between the upper surface of the outer container 481 and the flange 013*a* of the valve assembly 482, like shown in FIG. 53*b*. Further, the communicating pathway 485 communicating inside and outside of the outer container 481, is formed on the upper surface of the outer container 481, where it is always blocked by the gasket 484.

The double aerosol container 480 differs from the aerosol container 410 of FIG. 47 and the aerosol container 460 of FIG. 51, in the sealing structure between the outer container 481 and the valve assembly 482.

The outer container 481 is a pressure resistance container made of synthetic resin composed of a bottom portion, a barrel portion of tubular shape, a shoulder portion of tapered shape, a neck portion of cylindrical shape, and a thick mouth portion. The outer surface of the mouth portion 481*e* is protruded outwardly than the outer surface of the neck portion 481*d*. On the top surface of the opening 481*k* of the outer container, sealing protrusions 486 are formed concentrically (two rings in this disclosure). Further, a slit 487 penetrating the sealing protrusion 486 is formed extending in radius direction. Moreover, in the inner surface 481*f* structured by the inner surface of the neck portion 481*d* and the mouth portion 481*e*, a inner channel 488 is formed extending in vertical direction from the upper end. In this case also, it may be formed circularly. Additionally, in the outer surface of the mouth portion 481*e*, outer channels 489 are formed extending in vertical direction from the upper end, arranged annularly. The gasket 484 is arranged to cover the sealing protrusion 486, and the slit 487 forms above mentioned communicating path 485.

The valve assembly 482 is equipped with the valve holder 491 closing the outer container 481; two aerosol valve 15 held independently by the valve holder 491, closing the inner container 412, 413, respectively; and a mounting cover 97 covering the valve holder 491 and the aerosol container, fixing the aerosol valve 22 to the valve holder 91, and fixing the valve holder 491 to the opening of the outer container 481. The aerosol valve 15 and the mounting cover 91 are substantially same as the aerosol valve 15 and the mounting cover 97 of FIG. 13.

The valve holder 491 comprises a base part 492 of column shape, two holder part 102 of tubular shape penetrating the base part in vertical direction, and a positioning protrusion 38 formed on the upper end of the base part extending upward. The holder part 102 and the positioning protrusion 38 are substantially same as the holder part 102 and the positioning protrusion 38 of FIG. 3.

The base part 492 comprises a plug portion 493 of column shape, inserting into the outer container 481 along the inner surface 481 *f* of the opening; a lid portion 103 of column shape, arranged above the outer container 481; and a flange portion 103*a* protruding outwardly in radius direction, formed between the plug portion and the lid portion. The flange 103*a* is arranged on top of the mouth portion 481*e* of the outer container 481 sandwiching the gasket 484. No sealing member of O-ring etc. is fixed on the outer surface of the plug portion 493. The lid portion 103 and the flange portion 103*a* is substantially same as the lid portion 103 and the flange portion 103*a* of FIG. 13.

Because, the double aerosol container 480 is structured like above, it is easy to charge the propellant into the space S between the outer container 481 and both inner container. The slit 487 forms the communicating pathway 485 of the propellant on the upper end of the outer container 481, when the valve assembly 482 is held above such that the clearance is formed between the outer container 481 and the gasket 484, and the seal function between the mouth portion 481*e* of the outer container 481 and the gasket 484 is released, like shown in FIG. 55*a*. Therefore, the charging of the propellant into the space S can be conducted, through between the outer channel 489 of the mouth portion 481*e* of the outer container 481 and the mounting cover 97, through between the outer container 481 and the gasket 484 (slit 487 (communicating pathway 485)), and through between the outer container 481 and the plug part 493 of the valve holder (inner channel 488). Thus, the gasket 484 and the sealing protrusion 486 won't be obstacle when charging the propellant. After the charging of the propellant, the sealing between the gasket 484 and the upper end surface 481*k* of the outer container 481 can be formed just by lowering the valve assembly 482.

After the fixing of the valve assembly 482 to the outer container 481, the remaining air in the first inner container 412 and the inner container 413 are ejected by lowering stems 27, and then, the contents are loaded into the first inner container 412 and the second inner container 413 through stems 27, which resultantly manufactures the double aerosol product.

The double aerosol container 480 can safely eject the propellant outside without letting the valve assembly 482 pop, when the aerosol container deforms due to the weakening of the outer container 461 caused by the heating such as temperature rise or etc. Specifically, when the outer container 481 deforms like show in FIG. 11*b*, the sealing function of the upper end surface 481*k* and the gasket 484 slightly decreases, and forms the pathway according to the slit 487 opposite of the charging. Thus, the ejection of the propellant can be performed before the jump off of the valve assembly 462. Additionally, the ejection of the propellant outside can be enhanced by forming the inner channel 488 on inner surface extending from the mouth portion 481*e* to the neck portion 481*d*, in which the clearance between the inner channel 488 and the plug portion 493 increases as the neck portion 481*d* deforms at the early stage of the temperature rise.

In this disclosure, the inner channel 488 and the outer channel 489 are formed on the outer container 481, however, these channels may be omitted. The charging of the propellant and the ejection of the propellant while deforming of the outer container can be performed, as long as the pathway (slit 487) communicating the inside and the outside of the outer container 481 is formed on the upper end surface 481*k* of the outer container 481. Further, a penetrating hole penetrating the inside and the outside of the mouth portion 481*e* or a sealing protrusion 481*e* having a low protrusion part made partially can be substituted for the slit 487. The slit 487 may be formed on the mouth portion of the outer container of FIG. 1 to 9, for the propellant to be charged easy, and for the propellant to be ejected easy when the outer container deforms due to the heat or etc.

Figure 56:
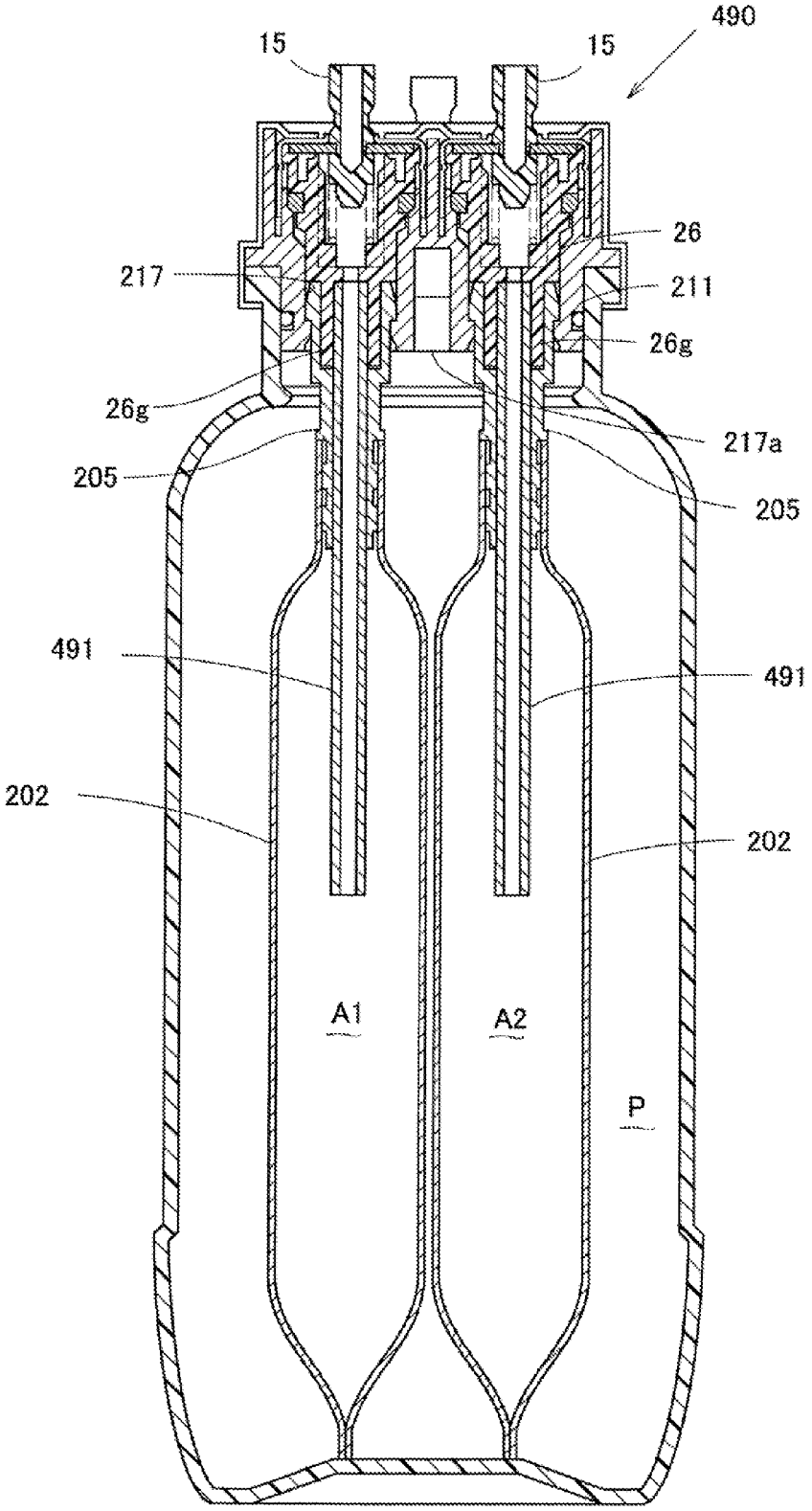
FIG. 56 a cross sectional view showing the other embodiment of the aerosol container of the present invention.

The aerosol container 490 of FIG. 56 has the dipping tube 491 arranged in the pouch between the inside surface of the pouch and the aerosol valve 15 of aerosol container 200 of FIG. 19. Specifically, the connecting member 205 of the pouch 202 is attached to the outer surface of the engaging tubular portion 26*g* of the housing of the aerosol valve 15, and the dipping tube 491 is inserted into the engaging tubular portion 26*g*.

As structured as above, the content loaded in the pouch 202 will not contact with the inner surface of the connecting member 205. Thus, the transmission of the content through the connecting member 205 will be prevented, and as a result, the degradation of the product is prevented. Further, although the element of one content passes through one pouch, the element will be prevented to intrude into the other pouch from the connecting member 205 attached to the other pouch. Therefore, the degradation of the product, due to the mixture of two contents can be prevented.

Additionally, in the aerosol container 490 (aerosol container 200), the lower end 217*a* of the holder part 217 of the valve holder 211 is formed to cover the top of the dipping tube 491 of the aerosol valve 15. In other word, the lower end 217*a* of the holder part 217 is located below the top of the dipping tube 491. Thus, the housing 26 will not be directly exposed in the space outside of the pouch, therefore, the transmissiveness of the content from the housing 26 is low.

Next, the other embodiment of the bag body of the pouch for the above mentioned aerosol container is disclosed.

Figure 57:
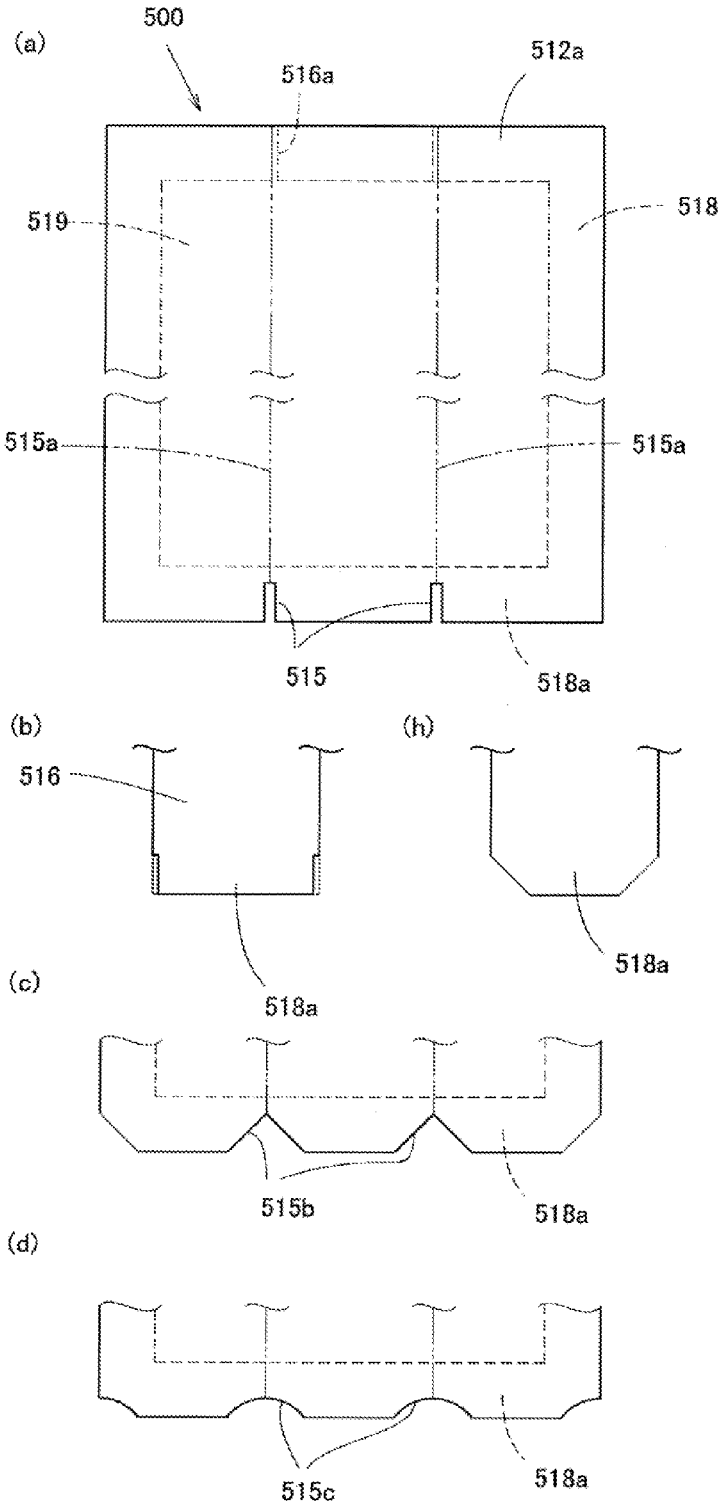
FIGS. 57*a, b* are development view and lower side view of pouch of aerosol container, FIGS. 57*c, d* are development view, process figure of other of the pouch.
FIG. 57*e* is development view of other embodiment of the pouch.

The bag body 500 of FIG. 57 forms a pouch with the connecting member 205 of tubular shape attached to the opening 516*a*. The connecting member 205 is substantially same as the connecting member 205 of FIG. 19.

The bag body 500 is composed of a bonding part 518 where the periphery of two sheets 512*a* are bonded, and a storage part 519. The opening 516*a* of the bag body is formed of clearance made between the center of the upper part. In other words, both side of the bonding part 518 forms the barrel portion of the pouch. Additionally, by bonding the lower ends of sheets 512*a* which forms the lower end of the bonding part, constructs the barrel portion 518*a*. In this barrel portion 518*a*, two notches 515 are formed extending from the lower end extending vertically. Further, the thin bended line 515*a* is formed extending vertically parallel to the notched line. The bended line is a bended line elastically formed to have the bag body in open state. The bag body 500 may be inserted into the outer container in a folded state folded along the bended line or in curled state. In FIG. 57*a*, the notches 515 are formed on the leg portion 518*a* in slit shape or in rectangular shape, however, notch 515*b* of triangle shape or notch 515*c* of are shape may be formed like shown in FIGS. 57*c, d*. Further, the half shape of the notch 515 may be formed on the both side end of the leg portion. In this case, the shape of the folded bag body 500 will have the shape where both edge of the lower end being cut down, therefore, the insertion of the pouch into the outer container will be easy. Further, by folding the pouches into same shape, the size of the leg portion can be accommodated and the support of the leg portion can be controlled. The leg portion 518*a* will not receive rib effect of bend line. The number of the notches is set according to the design or shape of the folded shape. For example, the bag body may be folded in five by forming four notches and four folded line.

Figure 58:
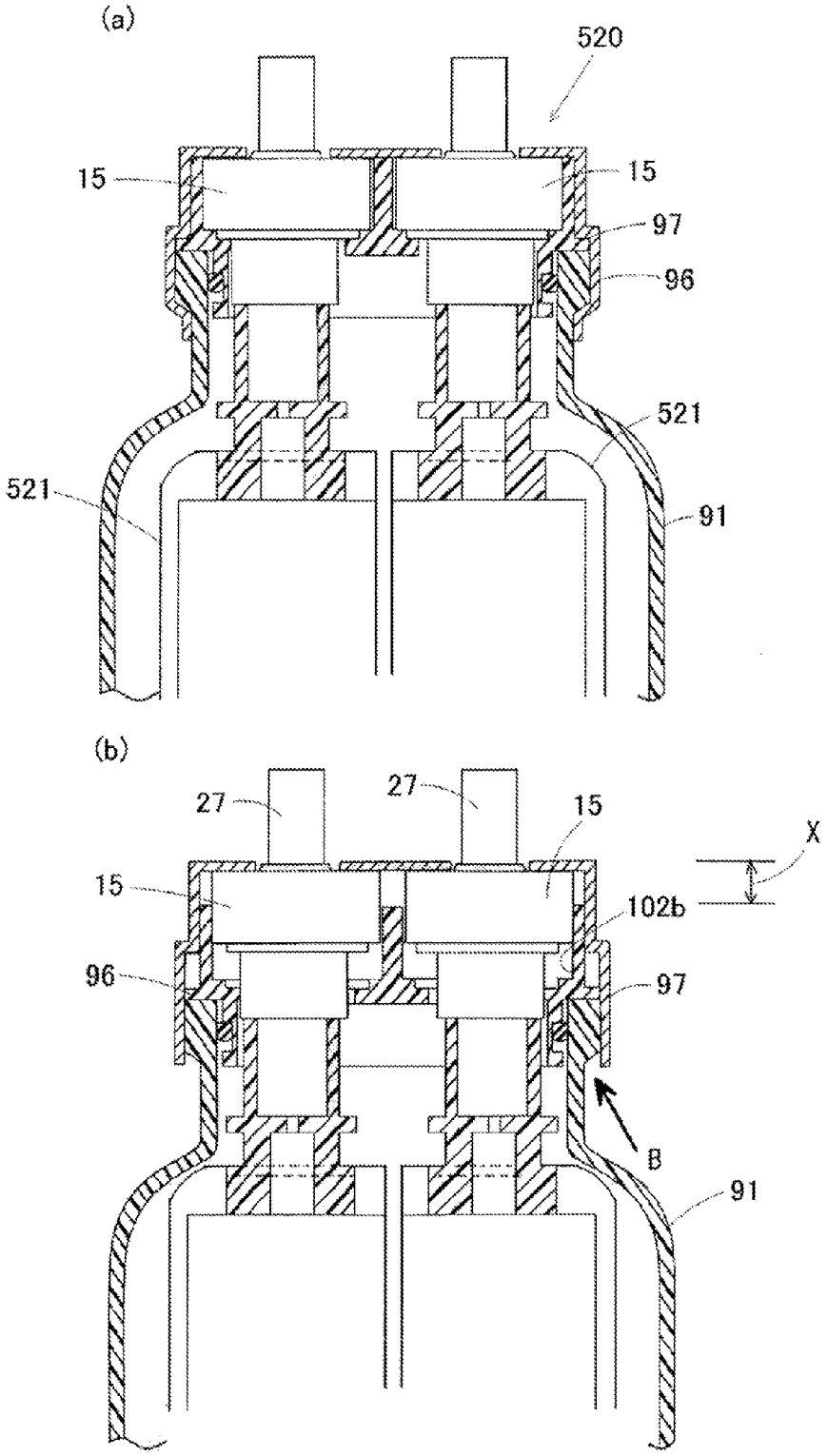
FIGS. 58*a, b* are cross sectional view and a diagram of gas charging phase showing the other embodiment of the aerosol container of the present invention.

The height of the bag body 500 is constructed to have it lower than the barrel portion of the outer container, in other word it is constructed to have it housed in the barrel portion of the outer container. Further, the bag body 500 is larger than the conventional one, in which the aerosol valve 15 is arranged some what higher (distance X of FIG. 58) than the state where it is fixed to the outer container, when it is attached to the aerosol valve 15 through connecting member 205 like described later. However, the connecting member 205 or the aerosol valve 15 may be enlarged using the conventional size.

The sheets 12*a* used for the pouch is substantially same as the pouch of FIG. 7.

The aerosol container 520 of FIG. 58*a* is equipped with an outer container 91, two pouches 521 housed in the outer container, two aerosol valve 15 connected to the pouches respectively, a valve holder 96 fixed to the opening of the outer container 91 and holds two aerosol containers, and a mounting cover 97 covering the aerosol valve 13 and the valve holder 96 and fixing the valve holder 96 to the outer container 91. The outer container 91, the aerosol valve 15, the valve holder 96, and the mounting cover 97 are substantially same as the outer container 91, the aerosol valve 15, the valve holder 96, and the mounting cover 97 of FIG. 13.

The loading process of the content and the propellant are shown next. First, the pre-folded pouches 521 and the aerosol valves 15 are connected sandwiching the valve holder 96. In this state, the pouch 521 is held in the folded state with tapes or etc. Next, the valve holder 96 is held above the outer container 91 (see FIG. 58*b*).

In this state, aerosol valves 15 are held some what higher (distance X) than the holder part 102 of the valve holder 96 being supported by each of leg portion 518*a* of the pouch 521 on the bottom of the outer container 91. The propellant is charged into the outer container through the lower end of the mounting cover 97 through the holder part 102 of the valve holder (arrow of FIG. 58*b*).

After the charging of the propellant with the propellant charging machine, the aerosol valve 15 is then pressed to the outer container 91 (valve holder 96) side (downward), and the lower end of the mounting cover is crimped to the boundary of the neck portion and the mouth portion of the outer container 91, fixing the valve holder 96 and the aerosol valve 15 to the outer container 91. During this process, because the leg portion 518*a* of the pouch 521 deforms by absorbing the press force, the barrel portion of the inner container will not be bended or deform in disorder. As a result, the content which will be loader afterward can be smoothly loaded.

Lastly, the different kinds of two contents are loaded into the pouches 521 through stem 127 of aerosol valve 15. However, the contents may be loaded before the charging of the propellant. When the pouches are held in folded state with tapes and etc, the loading of the contents unfold the pouch.

Next inner container is another disclosure which can be used such for the inner container 12 of FIG. 1.

Figure 59:
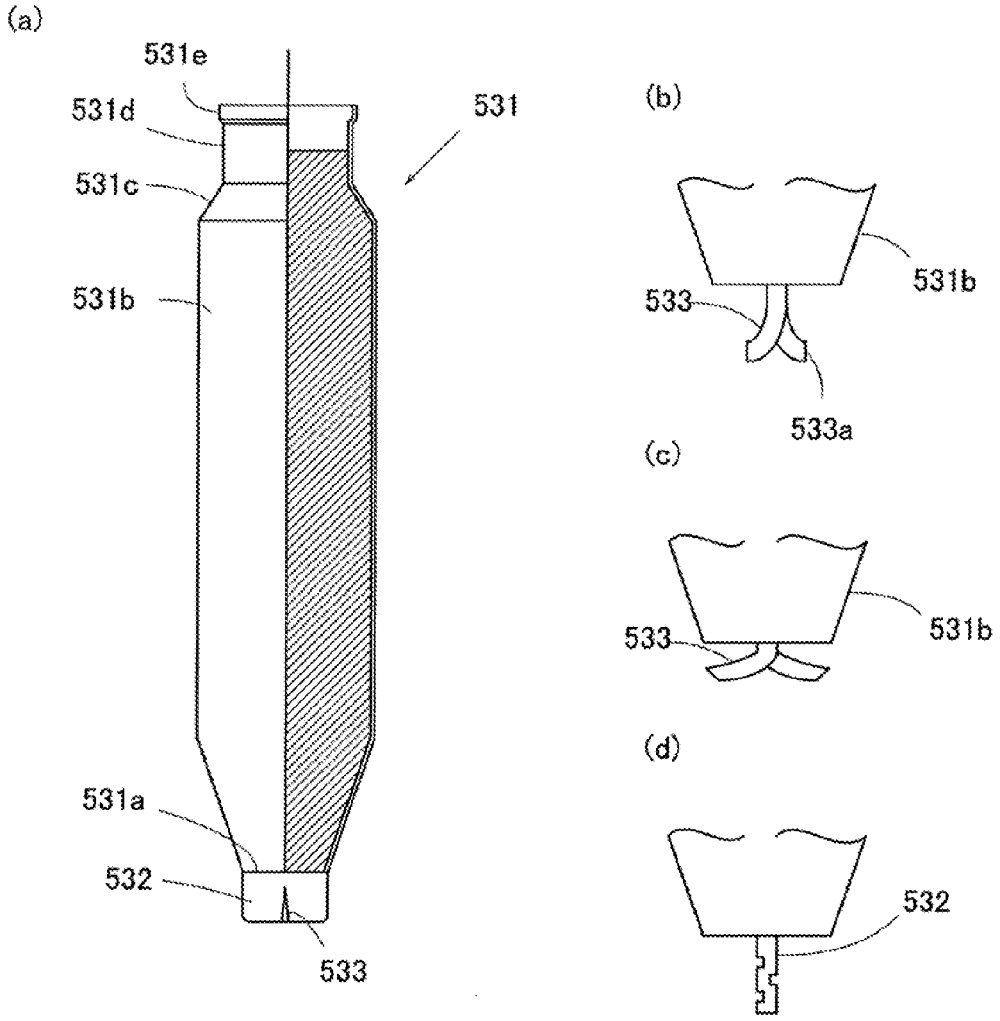
FIG. 59*a* is side view of inner container used for aerosol container of present invention.
FIG. 59*b* to *d* are lower side view showing the other embodiment.

The inner container 531 of FIG. 59 is a blow molded body formed by blow molding the parison of synthetic resin.

The inner container 531 comprises a bottom portion 531*a*, a barrel portion 531*b* of tubular shape, a shoulder portion of tapered shape formed on the top of the barrel portion, a neck portion 531*d* of tubular shape formed on the top of the shoulder portion, and an opening 531*e* of tubular shape having larger diameter than the neck portion. The lower side of the barrel portion 531*b* is formed in tapered shape where the diameter decreases downwardly. The pinch-off portion 532 is formed on the bottom portion 531*a* protruding downward. The pinch-off portion 532 has a plate shaped formed on the center of the bottom portion 531*a*, extending parallel with the diameter of the bottom portion. On the center of the pinch-off portion 532, the notch 533 is formed extending vertically from the lower end. The pinch off portion 532 is divided into two part by the notch 533, which enhance the flexibility when receiving the press force of vertical direction. In other word, the pinch-off portion 532 configures the leg portion of the present invention. Further, when using the inner container 531, the lower portion 533*a* of the pinch-off portion 532 divided by the notch 533, preferably deforms in curvature state or in bended state where each facing opposite, like show in FIG. 59*b*.

Further, the inner container 531 is configured so that the upper end of the inner container 531 protrudes when the inner container is placed on the bottom surface of the outer container.

Because the inner container 531 is stored with the lower part 531*a* of the pinch-off portion being folded, it can lower the possibility of the barrel portion of the inner container 531 to deform. Therefore, it prevent the linkage of the content while loading, and detachment or loosening of the aerosol container 15 and the inner container 531.

In this disclosure, the notch was made on the pinch-off portion, however, a horizontal bend line 533*b*, or recessed channel may be formed on the pinch-off portion 532 to give the elasticity deforming when receiving of the press force of vertical direction. The bend line or recessed channel may be shaped when forming the pinch-off part.

The invention claimed is:

1. A valve assembly, comprising:

aerosol valves in which each aerosol valve is independent and isolated, and a holding member holding the aerosol valves and fixing the aerosol valves on an opening of an outer container having pressure resistance, wherein each aerosol valve has a housing having a tubular shape, a stem inserted in the housing movable in up and down direction, a stem rubber closing a stem hole of the stem, a spring pressuring the stem upward, and a cover fixing the stem and stem rubber to the housing, in which the cover is a cup shaped body closing a top opening of the housing, and a lateral face of the cover is deformed to a lateral face of the housing to have the cover fixed to the housing, wherein the holding member has a valve holder holding the aerosol valves, and a mounting cover covering the aerosol valves and the valve holder, wherein the valve holder has holding portions penetrating the valve holder in a vertical direction and holding the aerosol valves by inserting the aerosol valves, wherein the valve holder comprises a lid portion of a column shape, and a flange portion formed on a lower end of the lid portion and arranged on an upper end of an opening of the outer container, wherein the mounting cover has a cover portion fixing the aerosol valves to the lid portion of the valve holder by pressing from above, and a fixing portion fixing the flange portion of the valve holder to the outer container by pressing from above, wherein stem inserting holes are formed on an upper face of the cover portion of the mounting cover for the stems of the aerosol valves to be inserted, and wherein an outer shape of the lid portion of the valve holder and an outer shape of the cover portion of the mounting cover are a round shape with a part notched.

2. A valve assembly according to claim 1, wherein the valve holder has a plug portion inserting along an inner surface of an opening of the outer container, and wherein an annular shaped sealing member is provided between the inner surface of the opening of the outer container and an outer surface of the plug portion of the valve holder, and wherein a sealing channel of an annular shape for holding the sealing member is formed on an outer surface of the plug portion.

3. A valve assembly according to claim 1, wherein a valve gasket of an annular shape is provided between an inner surface of each holding portion and an outer surface of a housing of the corresponding aerosol valve.

4. A valve assembly according to claim 1, wherein a recessed portion holding the aerosol valves is formed on an upper face of the cover portion of the mounting cover, the recessed portion is positioned above the aerosol valves and the recessed portion presses the aerosol valves from above.

5. A valve assembly according to claim 1, wherein a channel for a gas to pass is formed on an upper end of the opening of the outer container, or formed on an under surface of the flange portion of the valve holder.

6. An aerosol container, comprising, an outer container having pressure resistance, a propellant storage part for charging a propellant, compartmentalized in the outer container, content storage parts for charging contents respectively, compartmentalized in the outer container and the valve assembly of claim 1 closing the outer container, wherein the aerosol valves of the valve assembly communicate with the content storage parts, respectively.

7. An aerosol container according to claim 6, wherein the outer container is made of synthetic resin.

8. An aerosol container according to claim 6, further comprising, an activating part attached to the aerosol valves, wherein the activating part has two stem engaging portions where stems of the aerosol valves are attached respectively, a discharging opening discharging two content having a rectangular cross sectional view, and an inner path which communicates the stem engaging portion with the discharging opening, wherein the inner path has two independent paths which communicates with the stem engaging portions respectively, and an unified path which extend to the discharging opening in horizontal direction, and in which the contents served from independent paths are converged, and wherein a width of the discharging opening and a distance of two independent path is substantially same.

9. An aerosol container according to claim 8, wherein the activating part has a translucency.

10. An aerosol container according to claim 6, wherein each content storage part is a flexible pouch formed by bonding a periphery of two planate side walls, which are inserted in the outer container, the outer container has an outer window portion having translucency, wherein it is structured so that a sign which shows an amount of the contents remaining is seen from the outer window portion, when the contents are discharged and the volume of the pouch is reduced.

11. An aerosol container according to claim 10, wherein the pouch has an inner window portion having translucency which can be seen from the outer window portion, the contents which are to be charged in the pouch are opaque, wherein it is structured so that the sign can be seen from the inner window portion, when the contents are discharged and the volume of the pouch is reduced.

12. An aerosol container according to claim 6, wherein each content storage part is an inner container, the inner container has a barrel portion in which the content is charged, and a leg portion integrally formed on a lower end of the barrel portion, wherein when the inner containers are connected to the aerosol valves respectively and laid on a bottom surface of the outer container, a position of the valve assembly is higher than the position of the valve assembly to be fixed to the outer container, supported by the leg portion of the inner container, and the leg portion is bent when the valve assembly is fixed to the outer container.

13. An aerosol container according to claim 12, wherein each inner container is a pouch formed by bonding two flexible sheets, and the leg portion is a lower end bonded part in which a lower end of the sheets are bonded.

14. A method for charging the propellant and charging the contents into the aerosol container of claim 12, wherein the inner containers and the aerosol valves are connected, each inner container is inserted into the outer container in the connected state, each inner container is laid on the bottom surface of the outer container having the leg portion of the inner container to support the inner container and secure a space between the valve assembly and the outer container, the propellant is charged from the space into the propellant storage part formed between the outer container and the inner container, the valve assembly is lowered, covered on the outer container, and fixed to the outer container by bending the leg portion, and the contents are charged into the inner containers.

15. An aerosol container according to claim 6, wherein two content storage parts are provided.

16. An aerosol container according to claim 15, wherein each content storage part is a first inner container and a second inner container respectively, which are inserted in the outer container, the first inner container has an inner layer made of synthetic resin, and a first gas barrier layer made of metallic foil provided on the outside of the inner layer, the second inner container has an inner layer made of synthetic resin, and a second gas barrier layer made of non metal provided on the outside of the inner layer.

17. An aerosol container according to claim 16, wherein the outer container and the second inner container have translucency.

18. An aerosol product, comprising, the aerosol container of claim 15, a propellant charged into the propellant storage part, and two contents charged into the content storage parts, respectively, wherein the two contents are two liquid type reaction ingredients.

19. An aerosol product according to claim 18, wherein the two liquid type reaction ingredients are two liquid type hair dye agents.

* * * * *